US006871946B2

(12) United States Patent
Yanagi et al.

(10) Patent No.: US 6,871,946 B2
(45) Date of Patent: Mar. 29, 2005

(54) RECORDING APPARATUS

(75) Inventors: Haruyuki Yanagi, Machida (JP); Kenji Kawazoe, Yokohama (JP); Seiji Takahashi, Yokohama (JP); Takao Nakamura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/614,065

(22) Filed: Jul. 8, 2003

(65) Prior Publication Data

US 2004/0061757 A1 Apr. 1, 2004

(30) Foreign Application Priority Data

Jul. 10, 2002 (JP) ..... 2002-201570

(51) Int. Cl.[7] ..... B41J 2/01; B41J 2/315; B41J 17/00

(52) U.S. Cl. ..... 347/101; 400/120.01; 101/35; 101/486; 347/153; 369/30.99

(58) Field of Search ..... 347/101, 153, 347/104, 221; 400/48, 120.01, 542, 70; 101/35, 41, 486; 369/30.93, 30.97, 30.99

(56) References Cited

U.S. PATENT DOCUMENTS 6,312,174 B1 11/2001 Drynkin et al. ..... 400/120.16

FOREIGN PATENT DOCUMENTS

| | | |
|---|---|---|
| EP | 1 057 651 | 12/2000 |
| EP | 1 190 857 | 3/2002 |

*Primary Examiner*—Eugene H. Eickholt
(74) *Attorney, Agent, or Firm*—Fitzpatrick, Cella, Harper & Scinto

(57) ABSTRACT

A recording apparatus effects recording on a recording material by a recorder. The apparatus includes a tray, mountable to the recording apparatus, for stacking a recording material, a portion to be detected, provided on the tray to permit detection of a position of the tray, and a tray position detecting portion for detecting the portion to be detected. A position of the recording material stacked on the tray is detected by detecting the position of the portion to be detected.

21 Claims, 50 Drawing Sheets

(a)

(b)

(a)

(b)

(a)

(b)

(a)

(b)

RECORDING APPARATUS

FIELD OF THE INVENTION AND RELATED ART

The present invention relates to a recording apparatus, for example, a printer, an image forming apparatus, etc., in particular, a recording apparatus capable of recording on such recording medium as a compact disc, or the like, in a tray.

Various recording media have been proposed as recording media on which images can be recorded by such a recording apparatus as a printing apparatus, an image forming apparatus, etc. Some of recording media are small and thick, for example, a CD-R or DVD (which hereinafter will both be referred to as compact disc or CD). Image forming apparatuses, which are widely in use have the problem that if the conveyance path through which sheets of recording medium are conveyed one by one, are used to record an image on such recording medium as a CD or the like, the media cannot be efficiently conveyed, or the media are damaged because of the higher level of rigidity thereof, or that the media fail to be conveyed because of the relationship between the size of the media and the distance between the conveyance rollers. Thus, it is common practice to use a recording medium conveyance path different from the ordinary sheet conveyance path, along with a special tray designed for this purpose, when conveying a recording medium, such as a CD, which is small and thick.

The above mentioned tray is thicker than an ordinary recording sheet. Therefore, serious consideration must be given to such matters as how to insert the tray between the pair of conveyance rollers, how to nip the tray by the pair of conveyance rollers, and how to maintain a proper amount of gap between the recording head and the recording medium. As one of the means for successfully using the tray, a recording apparatus is provided with a lever, which can be moved to cancel the pressure from the members for conveying the tray. More specifically, when recording using the tray, first a user is to move the lever in the direction to cancel the pressure from the members for conveying the tray, insert the tray to a predetermined point in the recording apparatus, and properly position the tray. Then, the user is to move the lever in reverse to put the pressure from the tray conveying members back onto the tray. Then, in order to secure a proper amount of gap between the recording head and the recording medium, the user is to raise the carriage, on which the recording head is present, by operating the lever. As for the detection of the position of the recording medium such as a compact disc or the like, recording is made without detecting the recording medium position, or by directly detecting the position of the white area of the image recording range of a compact disc with the use of the sensor on the carriage, before the printing.

Generally, an ink jet recording apparatus records images by ejecting ink onto recording media from the ejection orifices of its recording means. The recording head, that is, an ink jet recording head, of an ink jet recording apparatus is easy to reduce in size, and is capable of recording a highly precise image at a high speed. It is also low in operational cost. Further, it does not contact recording medium as it prints images, being therefore less noisy. Moreover, two or more recording heads can be used in combination with a number of inks different in color to record color images. In other words, an ink jet recording apparatus boasts a substantial number of advantages over recording apparatuses of other types. Therefore, its usage is rapidly spreading. On the other hand, there has been a substantial amount of development in the field of the materials for recording ink and recording medium. In particular, in the field of recording medium, demand has been increasing for means for recording on glossy paper, glossy film, medium in the form of a disc, for example, a compact disc, in addition to ordinary recording paper. As a means for writing (recording or printing) a title or memo on a compact disc in order to disclose its contents, a method for pasting a label onto the non-recording surface of the disc is generally used.

In recent years, there have become available compact discs, which are provided with a recordable area (printable area) so that a title, memo, etc., can be directly recorded thereon with the use of a sign pen, felt pen, etc. As for a means for recording on a compact disc, a recording apparatus capable of recording pertinent information on the recordable area of a compact disc in coordination with a personal computer has been known. Also in recent years, a few ink jet recording apparatuses capable of printing on a compact disc have become available in the field of a personal ink jet recording apparatus. In the case of these ink jet recording apparatuses, a unit which makes an ordinary ink jet recording apparatus capable of recording on a compact disc, and which is removably attachable to the main assembly of an ink jet recording apparatus, is provided as an accessory.

These recording apparatuses are structured so that a compact disc as a printing medium is mounted in a tray as a printing medium supporting means; the tray containing the compact disc is inserted into the guiding portion of the compact disc conveying portion (supporting unit) in the main assembly of the recording apparatus, to be set in the predetermined position; and the tray is conveyed into the recording apparatus; and intended letters and/or pictures are printed on the compact disc in the tray by the recording head of the recording apparatus.

Further, in recent years, compact discs printable by an ink jet recording apparatus have become diverse in shapes; not only are they available in the ordinary form, or a disc with a diameter of 120 mm, but also in the form of the so-called 8 cm CD, that is, a disc with a diameter of 80 mm, a rectangular recordable card with the size of a calling card, etc. The shape of a compact disc is expected to further diversify.

However, the above described examples of a compact disc or the like suffer from the following technical problems.

(1) If the position of a CD as a recording medium is not detected, recording is sometimes made on the wrong area of the compact disc due to the tolerance in component manufacture. Further, even if a compensating measure, such as accurately positioning the tray, is taken, recording (printing) is sometimes still made on the wrong area of the compact disc, due to the anomaly in the condition of the tray.

(2) In order to print on the white recordable (printable) area of a CD by directly detecting the position of the white recordable area with the use of a sensor mounted on the carriage, the sensor needs to be of a high performance type, adding substantially to cost. Further, a compensatory process or the like is necessary, which complicates the electrical circuit in terms of structure and control, resulting in increase in product cost, as well as recording time.

(3) In the case of the recording apparatuses which print on the white recordable (printable) area of a CD by directly detecting the position of the white recordable area with the use of a sensor mounted on the carriage, the position of the printable area sometimes cannot be accurately detected when printing on a colored CD, or re-printing on a CD on which printing has been already made.

Moreover, if a user forgets to set a CD in the tray when printing on the CD with the use of tray as described above, printing is directly made on the tray, sometimes, soiling the tray. Thus, it is necessary to detect whether or not a CD is in the tray. As the means for detecting whether or not a CD is in the tray, the following means may be considered:

(1) Placing a detecting means capable of directly detecting the white portion of the printable area of a CD, on the carriage; if the white portion cannot be detected by the detecting means, it is determined that a CD is not in the tray.

(2) Placing in a recording apparatus, a detecting means for detecting whether or not a recording medium is in the tray, in order to detect whether or not a CD is in the tray.

Both (1) and (2), however, suffer from the following technical problems to be solved:

(1) In order to directly read the white portion of the printable area of a CD, a sensor as a detecting means to be mounted on the carriage must be of a high performance type, adding to cost. Further, in order to accurately read the white portion, a complicated control means is necessary, increasing thereby the cost of the electrical circuit, as well as recording time related to processing speed.

(2) Generally, the means disposed in a recording apparatus to detect whether or not a recording medium is present is placed directly in contact with a recording medium in order to make it possible for the detecting means to detect even a transparent recording medium. Using this type of sensor, that is, a sensor of a direct contact type, has the possibility of damaging the surface of a CD. If the surface of a CD is damaged, not only does an image come out disarranged, but also it is possible that it will be impossible to read the information recorded on the CD.

For example, if a CD with a diameter of 8 cm is placed in a tray designed for a CD with a diameter of 12 cm, a recess in the form of a donut, having a width of 20 mm, is created. Therefore, one of the pair of rollers for sandwiching the tray must ride over the stepped portions of the recess, creating a problem. In this case, however, all that is necessary to solve the problem is to fit a donut-shaped adaptor, which is virtually identical in thickness to the CD, in the donut-shaped recess. In order to deal with various CD configurations, a tray adaptor is necessary for each of the various CD configurations. Further, if a user accidentally prints an image for a 12 cm CD on an 8 cm CD, it is possible that the image will extend beyond the peripheral edge of the 8 cm CD, soiling the components, etc., in the adjacencies thereof. Further, a CD is generally circular. Therefore, if an image is printed off-centered on a CD, the mistake is conspicuous, making it thereby necessary to discard the CD. In other words, printing on a circular printing medium is more likely to result in failure than printing on a non-circular recording medium.

SUMMARY OF THE INVENTION

The primary object of the present invention is to provide a recording apparatus which is capable of recording on a recording medium such as a CD in a tray as a means for supporting the recording medium, and yet, is simpler in structure and control, more inexpensive, and capable of recording on accurate spots on a recording medium, in a shorter time, than a recording apparatus in accordance with the prior art.

Another object of the present invention is to provide a recording apparatus, which is simpler in structure and control, and capable of detecting, more inexpensively, more accurately, and in a shorter time, than a recording apparatus in accordance with the prior arts, whether or not a recording medium such as a CD is in the means for supporting the recording medium, or the type of the recording medium in the tray, when recording on the recording medium.

Another object of the present invention is to provide a recording apparatus capable of recording excellent images not only on the accurate spots on a recording medium of an ordinary size, but also on the accurate spots on any of the recording mediums different in size and shape from the recording medium of the ordinary size, without the recording errors, for example, recording on the wrong spots, the cause of which is traceable to the difference in recording medium size.

The present invention is characterized in that a recording apparatus for recording on recording medium with the use of a recording means comprises: a tray in which recording medium is mounted, and which is mounted in the recording apparatus; a single or plurality of conveyance rollers for conveying the tray; a portion with which the tray is provided for the detection of tray position; a tray position detecting means for detecting the portion with which the tray is provided for tray position detection, and also, in that the position of the recording medium in the tray is detected by detecting the position of the portion of the tray for tray position detection.

Further, the present invention is characterized in that a recording apparatus for recording on recording medium with the use of a recording means comprises: a tray in which recording medium is mounted, and which is mounted in the recording apparatus; a single or plurality of conveyance rollers for conveying the tray; a portion to be detected, with which the tray is provided in order to detect the portion to be detected.

According to an aspect of the present invention, it is possible to provide a recording apparatus capable of recording on a recording medium such as a CD in a tray as a means for supporting the recording medium, and yet, is simpler in structure and control, more inexpensive, and capable of recording on accurate spots on a recording medium, in a shorter time, than a recording apparatus in accordance with the prior art.

Also according to another aspect of the present invention, it is possible to provide a recording apparatus, which is simpler in structure and control, and capable of detecting, more inexpensively, more accurately, and in a shorter time, than a recording apparatus in accordance with the prior arts, whether or not a recording medium such as a CD is in the means for supporting the recording medium, or the type of the recording medium in the recording medium supporting means, when recording on the recording medium such as a CD.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENT

Hereinafter, the preferred embodiments of the present invention will be concretely described with reference to the appended drawings. Incidentally, if a component in a given drawing has the same referential sign as that of a component in another drawing, the two components are identical, or similar, to each other.

(Embodiment 1)

Figure 1:
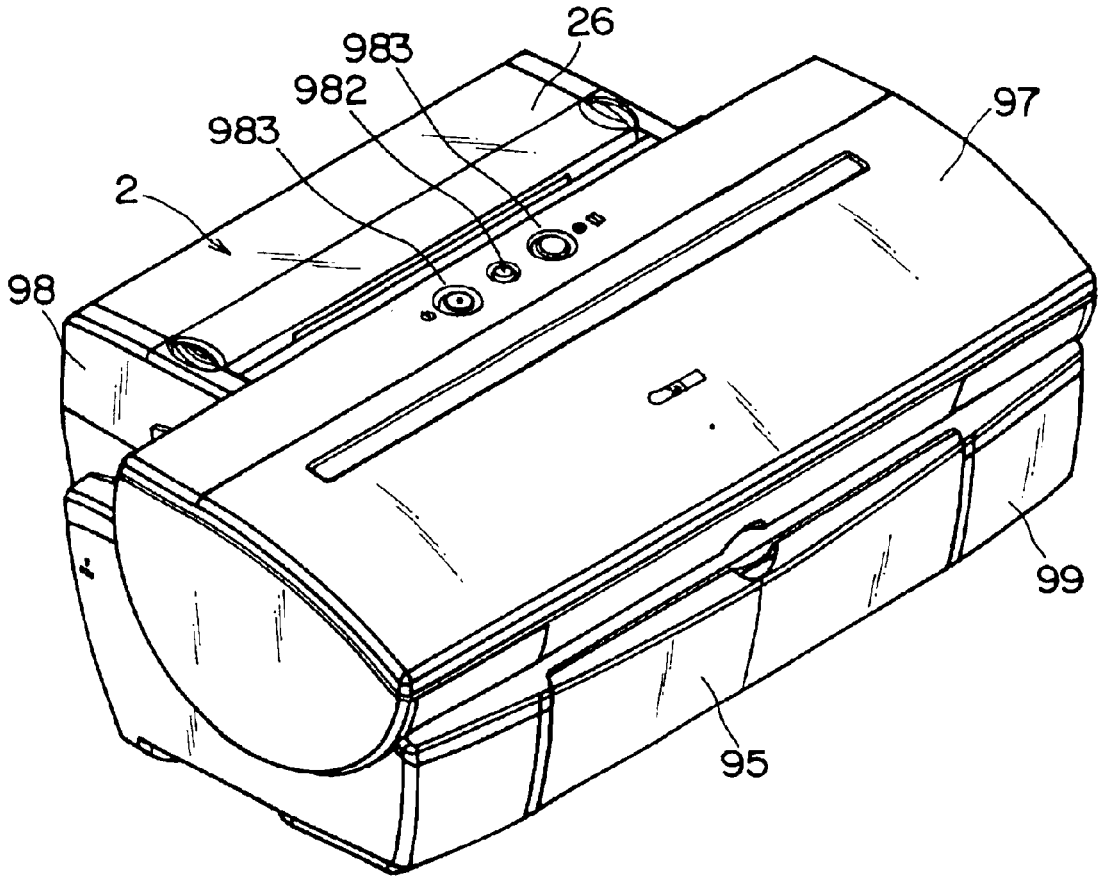
FIG. 1 is a perspective view of the recording apparatus in the first embodiment of the present invention.
Figure 2:
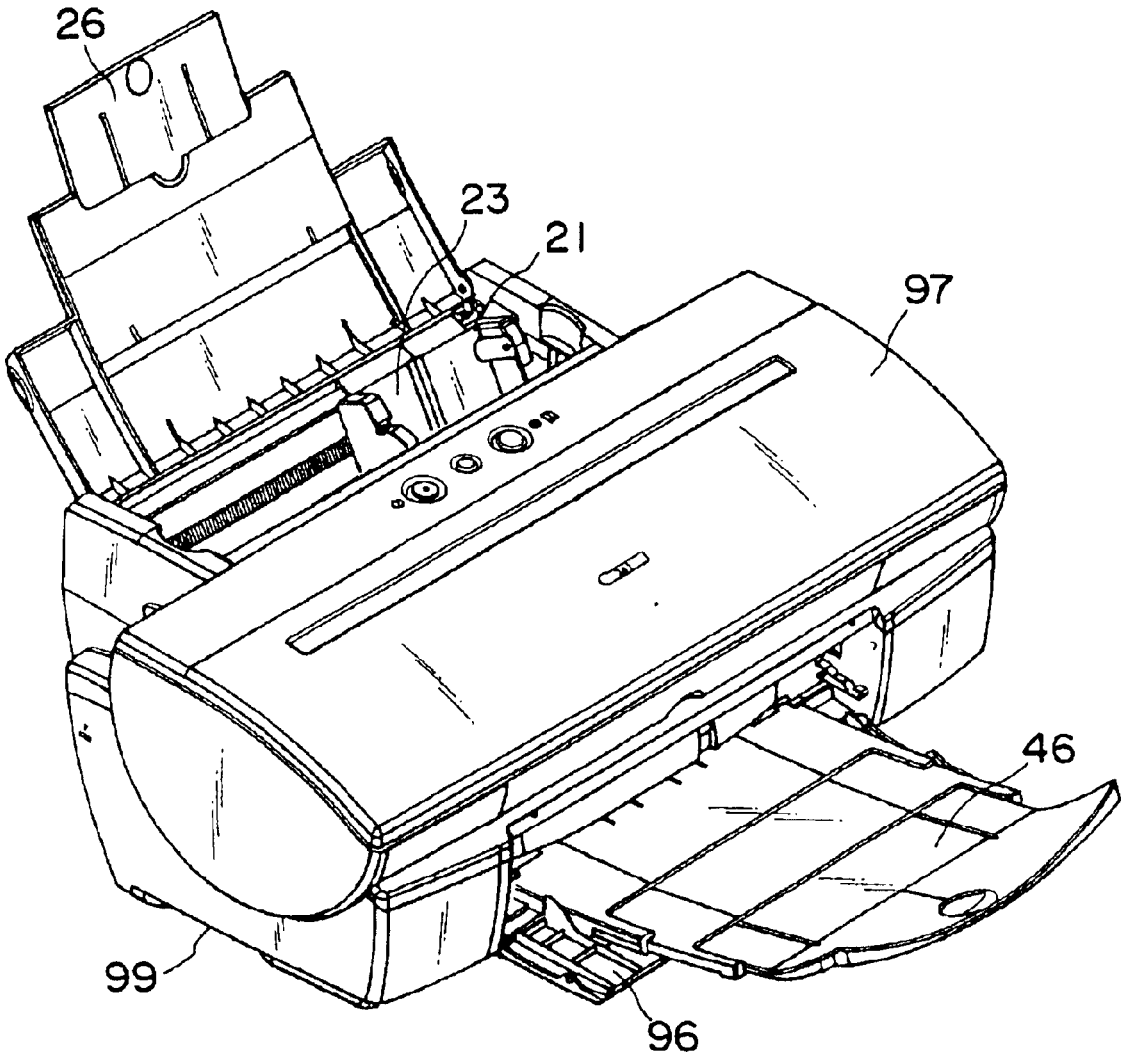
FIG. 2 is a perspective view of the recording apparatus shown in FIG. 1, with its sheet feeding tray and delivery tray being open.
Figure 3:
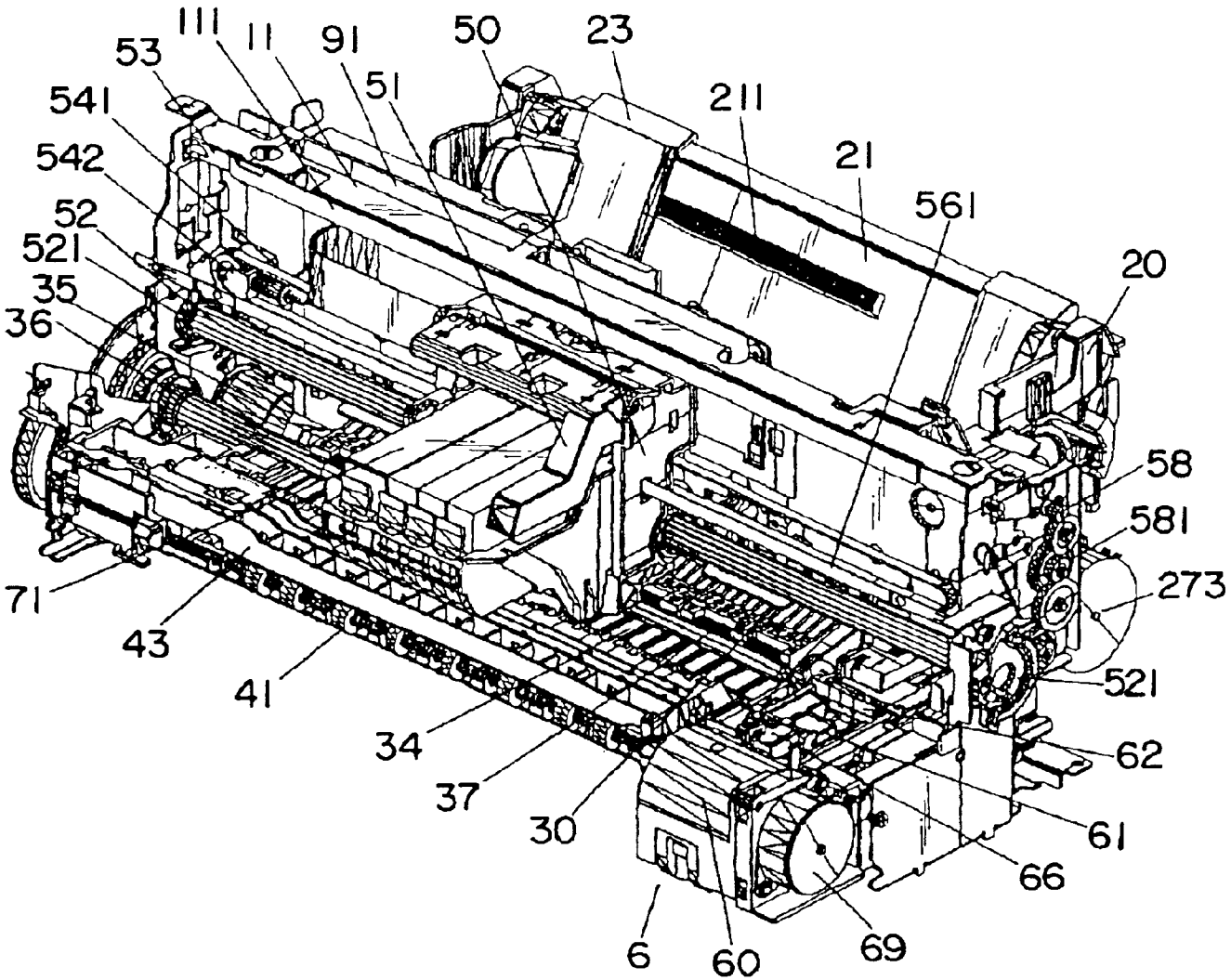
FIG. 3 is a perspective view of the internal mechanism of the recording apparatus shown in FIG. 1, as seen from the right front side thereof.
Figure 4:
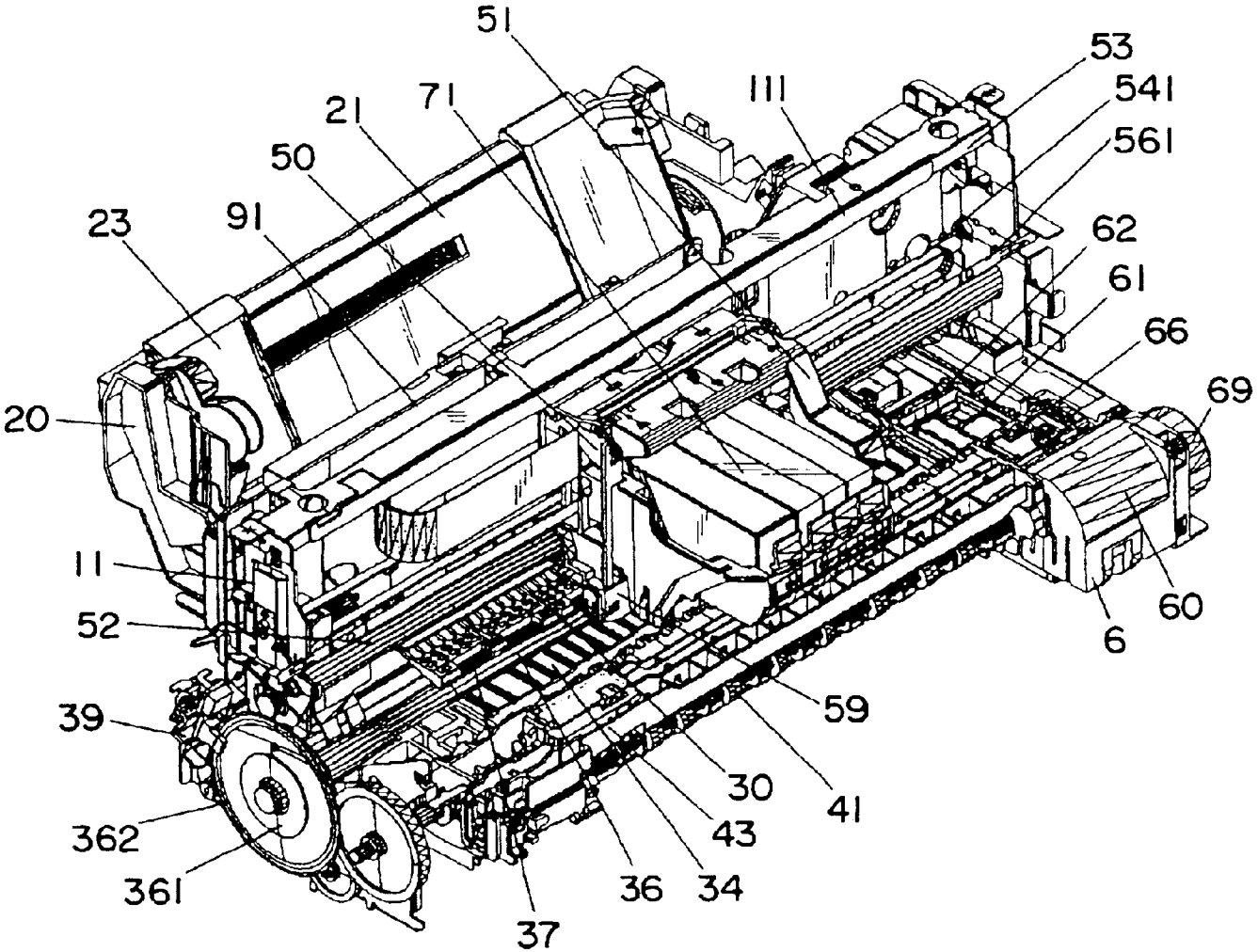
FIG. 4 is a perspective view of the internal mechanism of the recording apparatus shown in FIG. 3, as seen from the left front side thereof.
Figure 5:
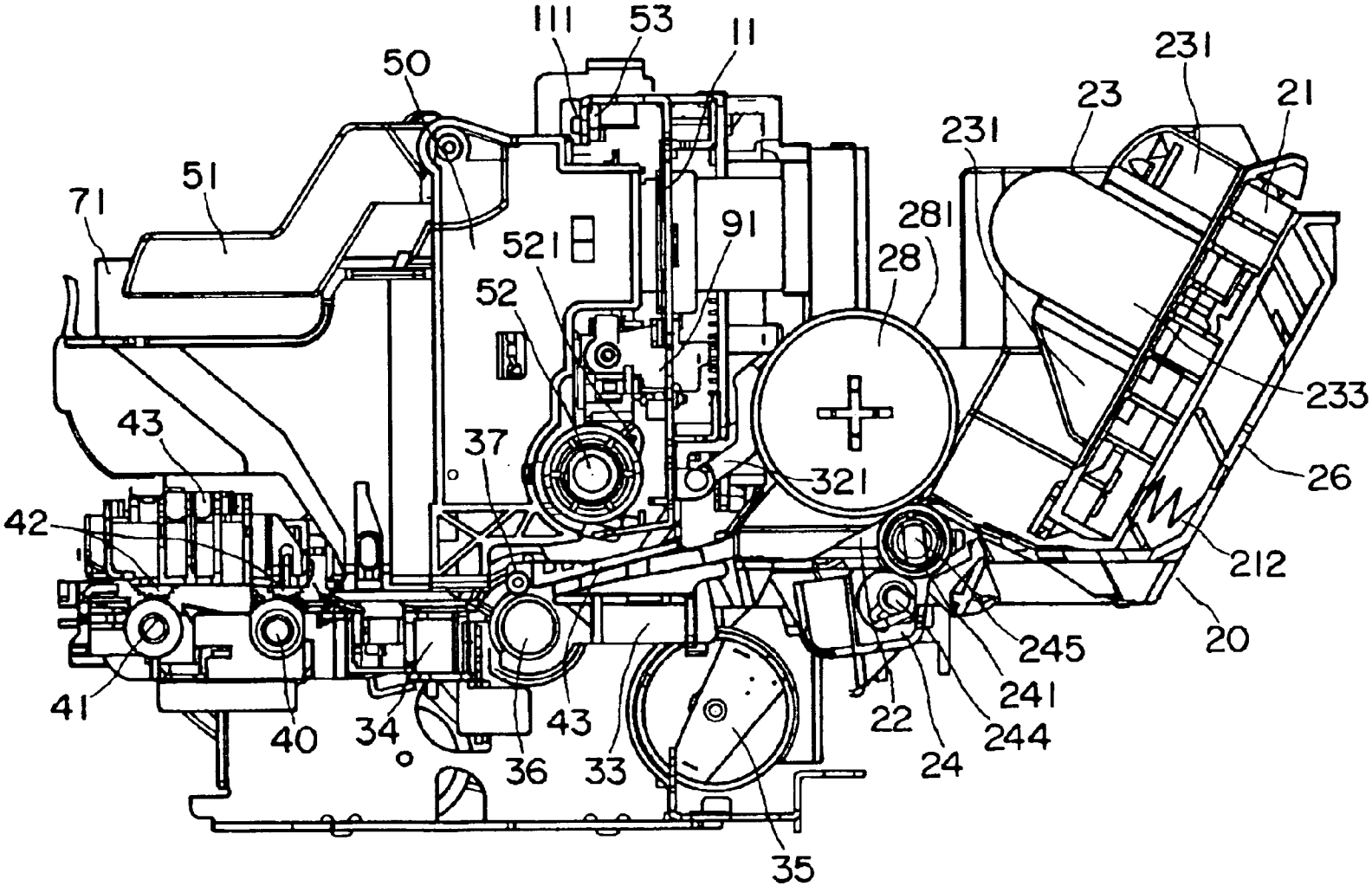
FIG. 5 is a vertical sectional view of the recording apparatus shown in FIG. 3.
Figure 6:
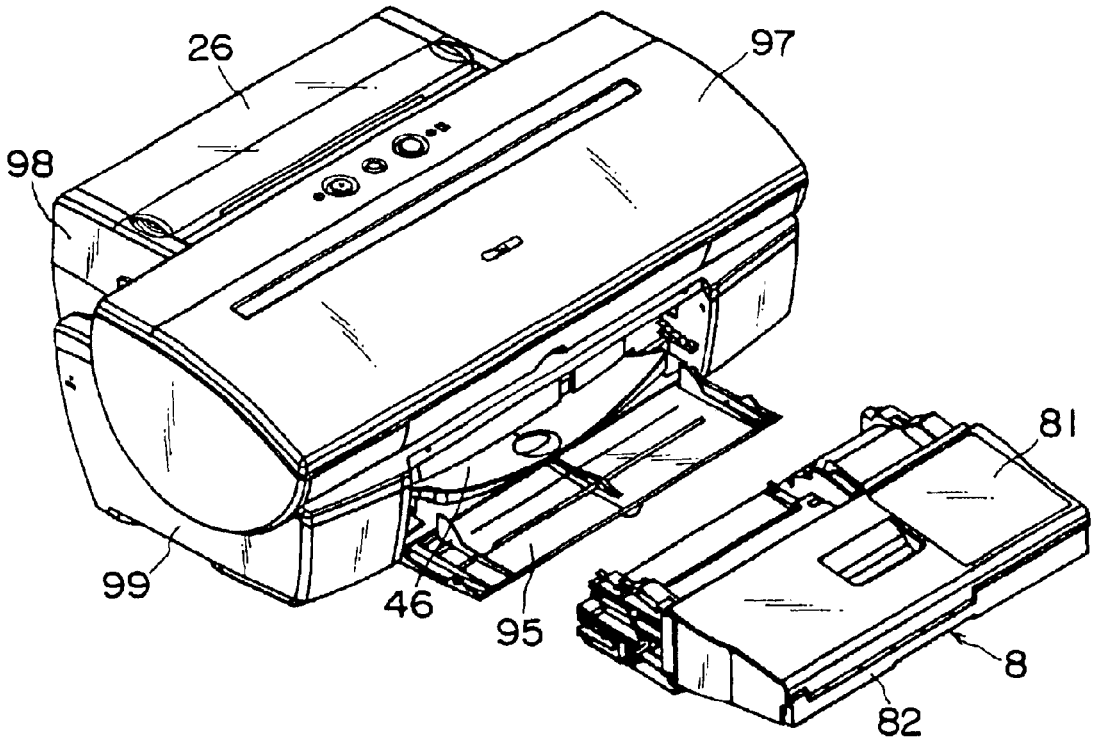
FIG. 6 is a perspective view of the recording apparatus shown in FIG. 1 and a CD conveying portion, prior to the mounting of the CD conveying portion into the recording apparatus.
Figure 6:
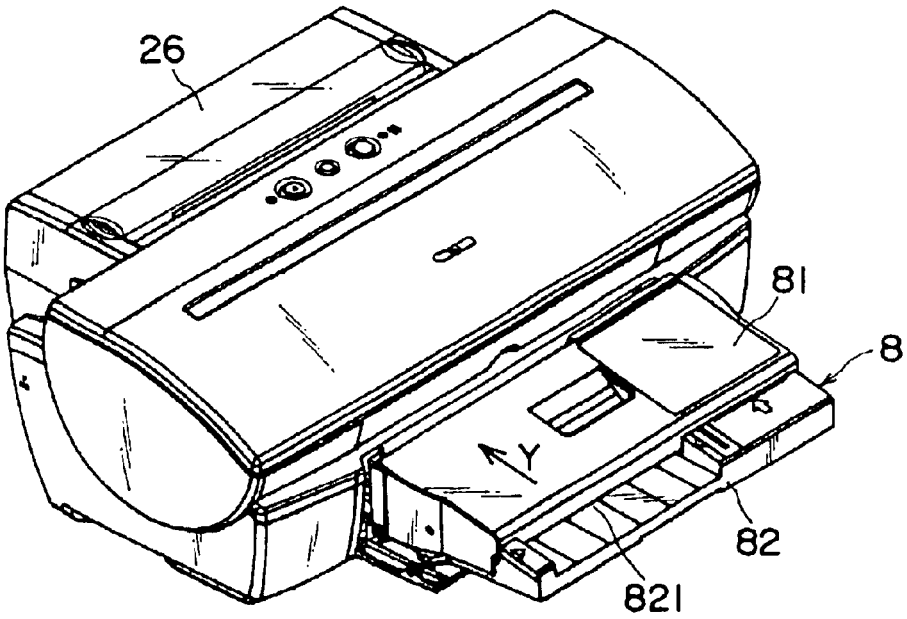
Figure 7:
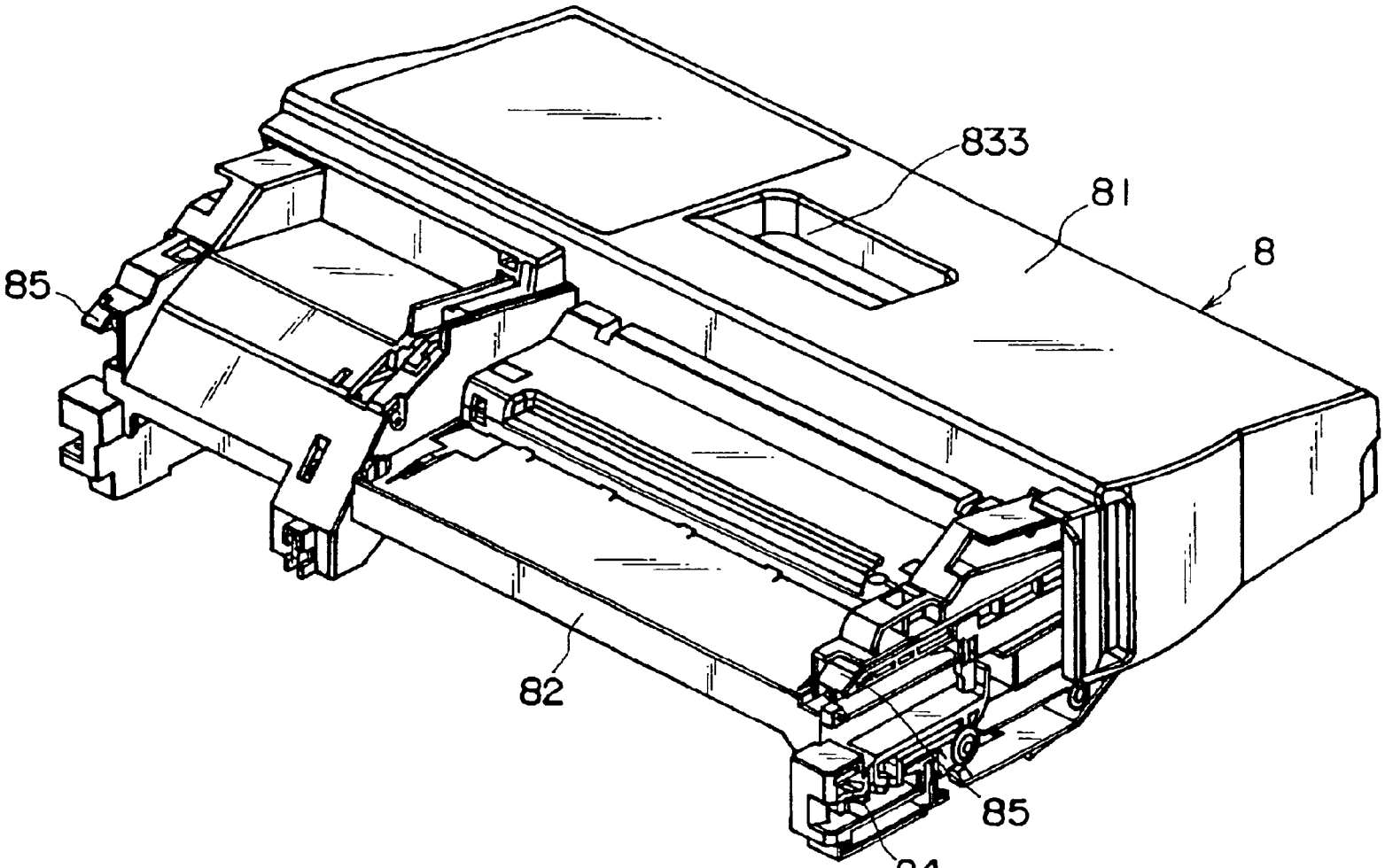
FIG. 7 is a perspective view of the CD conveying portion mountable in the recording apparatus shown in FIG. 1.

FIG. 1 is a perspective view of the recording apparatus in the first embodiment of the present invention, and FIG. 2 is a perspective view of the recording apparatus in FIG. 1, with its sheet feeding tray and delivery tray being open. FIG. 3 is a perspective view of the internal mechanism of the recording apparatus, shown in FIG. 1, in the first embodiment of the present invention, as seen from the right front side, and FIG. 4 is a perspective view of the internal mechanism of the recording apparatus, shown in FIG. 3, as seen from the left front side. FIG. 5 is a vertical sectional view of the recording apparatus shown in FIG. 3, and FIG. 6 is a perspective view of the combination of the recording apparatus and CD conveying portion 8 in the first embodiment of the present invention, prior to the mounting of the CD conveying portion into the recording apparatus, and FIG. 7 is a perspective view of the CD conveying portion 8 mountable in the recording apparatus in the first embodiment. FIGS. 8–19 are drawings for describing the structure and operation for printing on a CD, of the combination. In FIGS. 1–5, the recording apparatus 1 in this embodiment comprises a sheet feeding portion 2, a sheet conveying portion 3, a sheet delivery portion 4, a carriage portion, 5, a recovery mechanism portion (cleaning portion) 6, a recording means (recording head) 7, a CD conveying portion 8, and an electrical portion 9. Next, each of these portions will be roughly described in the above listed order.

(A) Sheet Feeding Portion

The sheet feeding portion 2 comprises: a pressure plate 21 on which a single or plurality of sheets P of recording medium are mounted; a sheet feeding roller (feed roller) 28 for feeding the sheets P into the main assembly of the recording apparatus; a separation roller 241 for separating the sheets P, a return lever 22 for returning the sheets P to where the sheets P were prior to the feeding, and a base 20 to which the preceding portions are attached. The sheet feeding tray 26 for holding the mounted sheets P is attached to the base 20 or the exterior of the recording apparatus. Referring to FIG. 2, the sheet feeding tray 26 is a collapsible type, and is to be extended for usage.

The feed roller 28 is in the form of a rod, which is circular in cross section. It is provided with a sheet feeding rubber roller 281, the width of which matches the standard size of a sheet used with the recording apparatus. The sheets P are fed (sent out) into the main assembly of the recording apparatus by the feed roller 28 structured as described above. The feed roller 28 is driven by the driving force transmitted thereto from the sheet feeding motor 273 of the sheet feeding portion 2, by way of a driving force transmission gear 271 and a planetary gear 272. The pressure plate 21 is provided with a pair of movable side guides 23, which controls the sheet position relative to the main assembly of the recording apparatus. The pressure plate 21 is rotatable about the shaft attached to the base 20, and is kept pressured toward the feed roller 28 by a spring 212. The portion of the pressure plate 21, which opposes the feed roller 28 is provided with a separation sheet 213 for preventing the top few of the plurality of sheets P in the sheet feeding tray from being conveyed together. The separation sheet 213 is formed of a material such as artificial leather which is relatively large in friction coefficient. The sheet feeding portion 2 is structured so that the pressure plate 21 can be placed in contact with, or moved away from, the feed roller 28 by a cam 214.

The separation roller 214 for separating the sheets P one by one is attached to a separation roller holder 24, which is attached to the base 20, more specifically, rotatably supported by the shaft attached to the base 20. Further, the separation roller holder 24 is kept pressured toward the feed roller 28 by a separation roller spring 242. The separation roller 241 is provided with a separation clutch (clutch spring) 243, so that if the separation roller 241 is subjected to a load greater than a predetermined value, the separation roller 241 rotates. The sheet feeding portion is structured so that the separation roller 241 can be placed in contact with, or moved away from, the feed roller 28 by the combination of a separation roller release shaft 244 and a control cam 25. The positions of the pressure plate 21, return lever 22, and separation roller 241 are detected by an ASF sensor 29. The return lever for returning a sheet P to where it was before the feeding is rotatably attached to the base 20, and is kept pressured by a return lever spring 221 in the direction to be released. The sheet feeding portion 2 is structured so that when returning a sheet P to where it was before feeding, the return lever 22 is rotated by the aforementioned control cam 25.

Next, how a sheet of recording medium is fed by the sheet feeding portion structured as described above will be described. When the sheet feeding portion is in the normal standby state, the pressure plate 21 is prevented by the cam 214 from pressuring the sheets P, and the separation roller 241 is prevented by the control cam 25 from separating the sheets P. Further, the return lever 22 for returning the sheets P to where they were before the feeding is in the position in which it prevents sheets P from entering the recording apparatus main assembly when mounting the sheets P. As the sheet feeding portion in the above described state is started, first, the separation roller 241 is placed in contact with the feed roller 28 by being driven by the motor. Next, the return lever 22 is released, allowing the pressure plate 21 to come into contact with the feed roller 28. In this state, the feeding of the sheets P begins. A pre-separating portion 201 attached to the base 20 regulates the forward movement of most of the sheets P, allowing only a few top sheets P to be sent to the nipping portion between the feed roller 28 and separating roller 241, in which the topmost sheet P is separated from the rest of the sheets P sent to the nipping portion. Then, only the topmost sheet P is conveyed further (fed).

As the sheet P reaches the pair of conveyance rollers, more specifically, a conveyance roller 36 and a pinch roller 37, which will be described later, the pressure plate 21 and separation roller 28 are moved away from their sheet feeding positions by the cam 214 and control cam 25, respectively. Also, the return lever 22 is returned to the sheet mounting position by the control cam 25. Further, the sheets P having reached the nipping portion between the feed roller 28 and separation roller 241 are returned to where they were before the feeding.

(B) Sheet Conveying Portion

The sheet conveying portion 3 is attached to a chassis 11 formed by bending upward certain portions of a piece of metallic plate. The sheet conveying portion 3 comprises a conveyance roller 36 for conveying sheets P, and a PE sensor 32. The conveyance roller 36 comprises a metallic roller, and minute particles of a ceramic coated on the peripheral surface of the metallic roller, and is attached to the chassis 11; lengthwise ends of the metallic roller, which are not coated with the ceramic particles, are supported by a pair of bearings 38. A sheet P is more reliably conveyed when the conveyance roller 36 is under a certain amount of pressure. Therefore, a conveyance roller tension spring 381 is disposed between the bearings 38 and the lengthwise ends of the conveyance roller 36, one for one, to keep the conveyance roller 36 under a certain amount of pressure in order to reliably convey a sheet P.

The conveyance roller 36 is in contact with a plurality of pinch rollers 37, which are rotated by the rotation of the conveyance roller 36. The pinch rollers 37 are held by a pinch roller holder 30, and are kept pressed upon the conveyance roller 36 by a pair of pinch roller springs 31. The rotational shaft of the pinch roller holder 30 is borne by the bearing of the chassis 11, allowing the pinch roller holder 30 to rotate about the rotational shaft. There are disposed a paper guide flapper 33 and platen 34 for guiding a sheet P, at the entrance of the sheet conveying portion 3 from which a sheet P is conveyed. The pinch roller holder 30 is provided with a PE sensor lever 321 for informing the PE sensor 32 of the detection of the leading and trailing ends of a sheet P. The platen 34 is attached to the chassis 11, being thereby accurately positioned. The paper guide flapper 33 is in contact with the conveyance roller 36, and is rotatable about the bearing portion 331. It is accurately positioned by coming in contact with the chassis 11.

The platen 34 is provided with a sheet presser 341 for covering the edge portion of a sheet P, which is on the sheet alignment reference side of the platen 34. With the provision of the sheet presser 34, even if a sheet P, the edge portion of which has deformed, a curled sheet P, or the like must be used, the deformed or curled edges are prevented from bending or curling toward the recording head 7, being therefore prevented from interfering with the recording head 7. The recording head 7 for forming images based on image formation information is disposed on the downstream side of the conveyance roller 36 in terms of the sheet conveyance direction.

After being sent to the sheet conveying portion 3 by the mechanism structured as described above, each sheet P is guided to the nipping portion between the conveyance roller 36 and pinch roller 37. As the sheet P is conveyed to the nipping portion, the leading end of the sheet P is detected by the PE sensor lever 321, in order to determine where on the sheet P an image is to be recorded (printing position, image formation position). As the pair of rollers 36 and 37 are rotated by the sheet conveyance motor 35, the sheet P is conveyed on the platen 34. The platen 34 is provided with a plurality of ribs which form a virtual surface as the sheet conveyance reference. Not only are these ribs used for controlling the gap between the platen 34 and recording head 7, but also they control the waving of a recording sheet P; it minimizes the waving of a sheet P, in coordination with the sheet delivery portion, which will be described later.

The conveyance roller 36 is driven by transmitting the rotational force of the sheet conveying DC motor 35 to a pulley 361 attached to the shaft of the conveyance roller 36 with the use of a timing belt. The shaft of the conveyance roller 36 is provided with code wheel 362 for detecting the distance by which a sheet P has been conveyed by the conveyance roller 36. The code wheel is provided with a plurality of markings, which are disposed at a pitch of 150 lpi–300 lpi. The chassis 11 is provided with an encoder sensor for reading the above mentioned markings, which is attached to a portion of the chassis in the adjacencies of the code wheel 362.

The recording means (recording head) 7 is an ink jet recording head, which is structured so that a plurality of ink containers different in the color of the ink therein can be removably attached to the ink jet recording head. Further, the recording head 7 is capable of applying heat to the ink therein with the use of heaters (heating elements) or the like, in accordance with recording data. As the heat is applied to the ink, the ink boils in the film boiling fashion, generating bubbles. As a result, the ink is ejected in the form of an ink droplet from the ejection orifices of the recording head 7 by the pressure changes caused by the growth or contraction of the bubbles. The ejected ink droplets form an image on a sheet P of recording medium.

(C) Carriage Portion

The carriage portion 5 has a carriage 50 to which the recording head 7 is attached. The carriage 50 is supported by the combination of a guide shaft 52 and guide rail 111 disposed perpendicular to the sheet conveyance direction so that the carriage 50 can be shuttled in the primary scanning direction. The guide rail 111 supports the rearward end of the carriage 50, doubling as a means for maintaining a proper amount of gap (recording gap) between the recording head 7 and a sheet P. The guide shaft 52 is attached to the chassis 11, whereas the guide rail 111 is an integral part of the chassis 11. The portion of the guide rail 111 on which the carriage 50 slides is covered with a thin sheet 53 of SUS or the like, in order to reduce the amount of the sounds which occur as the carriage 50 slides on the guide rail 111.

The carriage 50 is driven by the carriage motor 54 attached to the chassis 11 with the interposition of the timing belt 541, which is supported and tensioned by an idler pulley 542. The timing belt 541 and carriage 50 are connected to each other, with the interposition of a rubber damper 55 or the like, in order to reduce the amount of image anomalies by damping the vibrations from the carriage motor 54, etc. Further, in order to detect the position of the carriage 50, a code strip 561 having a plurality of markings, the pitch of which is in the range of 150 lpi–300 lpi, is disposed in parallel to the timing belt 541. Further, an encoder sensor 56 for reading the code strip 561 is attached to the circuit board 92 of the carriage 50. This carriage circuit board 92 is also provided with a contact 921 for establishing electrical contact with the recording head 7. Further, the carriage 50 is provided with a flexible circuit board 57 for transmitting head signals from an electrical portion (electrical circuit) 9 to the recording head 7.

In order to fix the recording head 7 as a recording means to the carriage 50, the carriage 50 is provided with a head catcher 501 for accurately positioning the recording head 7, and a pressing means (head pressing means) 511 for keeping the recording head 7 immovably attached to the carriage 50 by keeping the recording head 7 pressed on the carriage 50. This pressing means 511 is attached to a head setting lever 51 so that as the head setting lever 51 is rotated about its rotational axis, the recording head 7 is pressed on the head catcher 501 and circuit board 92 of the carriage 50 by the pressing means 511. The guide shaft 52 is provided with a pair of eccentric cams 521, which are attached to the lengthwise ends of the guide shaft 52. Thus, as a motor 58 for vertically moving the carriage 50 is driven, the driving force therefrom is transmitted to the eccentric cams 521 through a gear train 581, and vertically moves the guide shaft 52. The carriage 50 is vertically moved by the vertical movement of the guide shaft 52, so that an optimal gap is provided between the recording head 7 and a sheet P regardless of the thickness of the sheet P.

When recording on a label portion of a small and thick recording medium, for example, a CD-R or the like, a CD print tray 83 is employed. Thus, the carriage 50 is provided with a tray position detection sensor 59 for detecting the marking 834 provided on the CD print tray 83. The tray position sensor 59 is a reflection type sensor. It emits a beam of light from its light emitting element, and detects the position of the tray 83 by receiving the beam of light reflected by the tray 83. The sequence for forming an image on a sheet P of recording medium with the use of the recording apparatus structured as described above is as follows. First, a sheet P is conveyed by the pair of rollers (conveyance roller and pinch roller) 36 and 37, respectively, to the recording area (in terms of sheet conveyance direction). Then, the carriage 50 is moved to the recording (image forming) position (in the direction perpendicular to the sheet conveyance direction), positioning the recording head 7 in a manner to oppose the recording position (image formation position) on the sheet P. Then, the recording head 7 ejects ink toward the sheet P in response to the signals from the electrical portion (electrical circuit) 9, recording (forming) the image on the sheet P.

(Sheet Delivery Portion)

The sheet delivery portion 4 comprises: two discharge rollers 40 and 41; spur wheels which are kept pressured upon the discharge rollers 40 and 41 in a manner to generate a predetermined amount of contact pressure, and which are rotated by the rotation of the discharge rollers 40 and 41; and a gear train for transmitting driving force from the conveyance roller 36 to the discharge rollers 40 and 41 (FIG. 5). The discharge rollers 40 and 41 are attached to the platen 34. The discharge roller 40, that is, the one on the upstream side in terms of the sheet conveyance direction, comprises a metallic shaft, and a plurality of rubber portions (rubber rollers) 401 fitted around the metallic shaft. The discharge roller 40 is driven by the driving force transmitted from the sheet conveyance roller 36 through a set of idler gears. The discharge roller 41 comprises a shaft made of resin, and a plurality of elastic members 411, which are made of elastomer or the like, and which are attached to the shaft made of resin. The discharge roller 41 is driven by the driving force transmitted thereto from the discharge roller 40 through a set of idler gears.

Each spur wheel 42 comprises: a spur wheel proper, that is, a wheel which is formed of thin plate of SUS, and the peripheral portion of which is provided with a plurality of radial projections; and a resinous portion covering the surface of the spur wheel proper. The spur wheels 42 structured as described above are attached to a spur wheel holder 43. In this embodiment, the spur wheels 42 are kept pressured upon the discharge rollers 40 and 41 by spur wheel springs 44, which are coil springs, in the form of a rod, attached to the spur wheel holder 43. There are two types of spur wheels: those for mainly forwarding a sheet P, and those for mainly preventing a sheet P from floating during an image forming operation. The spur wheels for forwarding a sheet P are positioned so that they oppose the rubber portions (rubber rollers of discharge roller 40 and elastic portions of discharge roller 41) of the discharge rollers 40 and 41. The spur wheels for preventing a sheet P from floating are positioned so that they oppose the portions of the discharge rollers 40 and 41, where the rubber portions 401 are missing (intervals of rubber portions 401).

Between the discharge rollers 40 and 41, a pair of sheet edge supports 45 are provided. The sheet edge supports 45 are for keeping raised the edge portions of a sheet P held by the tips of the rubber portions of the discharge rollers 40 and 41, in order to prevent the problem that the image on the preceding sheet P is damaged or reduced in quality as the recorded portions of the preceding sheet P are rubbed by the following sheet P. Each sheet edge support 34 comprises: a portion which is made of resin, and to the edge of which a roller 451 is attached; and a sheet edge support spring 452 for applying a predetermined amount of pressure upon the portion made of resin. Thus, the roller 451 is pressed upon a sheet P by the predetermined amount of pressure, supporting the edge of the sheet P while stiffening the sheet P by raising the edge.

With the provision of the above described structural arrangement, after the recording (formation) of an image on a sheet P on the carriage portion 5, the sheet P is nipped by the combination of the discharge rollers 41 and spur wheels 42, and is conveyed further to be discharged into the delivery tray 46. The delivery tray 46 comprises a plurality of members, and is collapsible so that it can be stored in the bottom case 99 of the recording apparatus. The delivery tray 46 is to be pulled out when necessary. The delivery tray 46 shown in FIG. 2 is shaped so that the greater the distance of a given point of the delivery tray 46 from the main assembly of the recording apparatus, the higher the given point, and also so that its lateral edges protrude slightly upward. With the provision of this structural arrangement, not only are the sheets P efficiently accumulated in the delivery tray 46 after their discharge, but also their recorded surfaces are prevented from being rubbed (FIG. 2).

(E) Recovery Mechanism Portion (Cleaning Portion)

The recovery mechanism portion (cleaning portion) 6 comprises: a pump (vacuum pump or the like as a negative pressure generating source) 60 for carrying out the process (cleaning operation) of maintaining or restoring the liquid ejection performance of the recording head 7; a cap 61 for protecting the surface of the recording head 7 having the ejection orifices, and preventing the ink from drying at the surface; and a wiping means (blades) 62 for wiping away (removing) the deposits, such as the ink, dust, etc., adhering to the adjacencies of the ejection orifices of the recording head 7. Further, the recovery mechanism portion 6 is provided with a recovery motor 69 dedicated thereto, and a one-way clutch 691 so that as the recovery motor 69 is rotated in one direction, the pump 60 is operated, whereas as the recovery motor 69 is rotated in the other direction (in reverse), the cap 61 is moved in the direction perpendicular to the surface of the recording head 7 having the ejection orifices, and the blades 62 are made to wipe.

The pump 60 in this embodiment comprises two tubes 67 and a pump roller 68, and the negative pressure is generated as the pump roller 68 is moved in a manner to flatten the two tubes 67. The vacuum passage (tube or the like) from the cap 61 to the pump 60 is provided with a valve 65, etc., which are located somewhere between the cap 61 and pump 60. This vacuum-based recovery means is operated with the cap 61 placed airtightly in contact with the surface of the recording head 7 having the ejection orifices (with the surface capped). As the recovery means is operated, negative pressure is generated in the cap 61. As a result, foreign substances, for example, the portion of the ink in the recording head 7, the viscosity of which has increased, bubbles, and dust having settled in the ejection orifices, are suctioned out of the ejection orifices, along with normal ink, by the vacuum. The interior of the cap 61 is provided with an absorbent member 611 for reducing the amount of the ink (residual ink) remaining on the surface of the recording head 7 having the ejection orifices, after the suctioning. Placing the absorbent member 611 in the cap 61, however, creates the possibility that the ink remaining in the absorbent member 611 will dry up and solidify. Thus, in order to prevent this problem, the vacuum-based recovery means is structured so that the vacuum pump 60 can be idled, that is, it can be operated with the cap 61 open, to suction away the ink remaining in the cap 61. After being suctioned away by the pump 60, the waste ink is absorbed by an absorbent member 991 in the bottom case 99 and retained therein. The bottom case 99 will be described later.

The series of the various recovery steps carried out by the recovery mechanism portion 6, that is, the wiping by the blade 62, placing the cap 61 in contact with the recording head 7 or moving it away from the recording head 7 (step to move cap 61 in the direction perpendicular to the surface of the recording head 7 having the ejection orifices), opening or closing of the valve 65 between the cap 61 and pump 60, and the like steps, are controlled by the main cam 63, which comprises a shaft, and a plurality of subsidiary cams; each recovery step is carried out by activating the subsidiary cam or lever corresponding thereto, by the main cam 63. The attitude of the main cam 63 in terms of its rotational direction (angle of a given point of main cam 63 relative to referential point) can be detected by a position detection sensor 64 such as a photo-interrupter. While the cap 61 is not in contact with the recording head 7 (in the bottom position, in this embodiment), the blades 62 are moved in the direction perpendicular to the primary scanning direction of the carriage 5 to wipe (clean) the surface of the recording head 7 having the ejection orifices. The recovery mechanism portion 6 in this embodiment is provided with a plurality of blades 62 different in function: blades for wiping the adjacencies of the ejection orifices of the recording head 7, and blades for wiping the entirety of the surface of the recording head 7 having the ejection orifices. Further, the recovery mechanism portion 6 is structured so that as the blades 62 reach the deepest end of their paths, they are placed in contact with a blade cleaner 66, so that the ink (transfer ink) adhering to the blades 62, or the like contaminants, are removed to restore the blades 62 in wiping performance.

(F) Peripheral Portions

The above described functional portions (functional units) inclusive of mechanical portions are integrally disposed in the chassis 11 of the recording apparatus 1, constituting the main portions of the recording apparatus, whereas the peripheral portions of the recording apparatus 1 are attached to the chassis 11 in a manner to surround these main portions. The essential peripheral portions are the top and bottom cases 98 and 99, an access cover 97, a connector cover 96, and a front cover 95. There are disposed a pair of delivery tray rails 992 below the bottom case 99, making it possible for the delivery tray 46 to be collapsed into the bottom case 99. The front cover 95 is structured so that the sheet discharge opening is kept covered by the front cover 95 when the recording apparatus is not in use. To the top case 98, the access cover 97 is rotatably attached. The top wall of the top case 98 is provided with an opening, through which an ink container 71, recording head 7, etc., can be replaced. Further, the top case 98 is provided with a door switch lever 981 for detecting the opening or closing of the access cover 97, an LED guide 982 for transmitting the beam of light from an LED or showing the beam of light from the LED, a key switch 983 for activating or deactivating the SW of the electrical portion 6, which is in a part of the top wall of the top case 98, etc.

Further, the extendable (collapsible) sheet feeding tray 26 comprising a plurality of members is rotatably attached to the top case 98. Thus, when the sheet feeding portion is not in use, the sheet feeding tray 26 can be collapsed (retracted) so that it can function as the cover for the sheet feeding portion. The top and bottom cases 98 and 99 are attached to the chassis 11, with the use of elastic fasteners in the form of a claw. The connector portions between the top and bottom cases 98 and 99 are covered with the connector cover 96.

Figure 8:
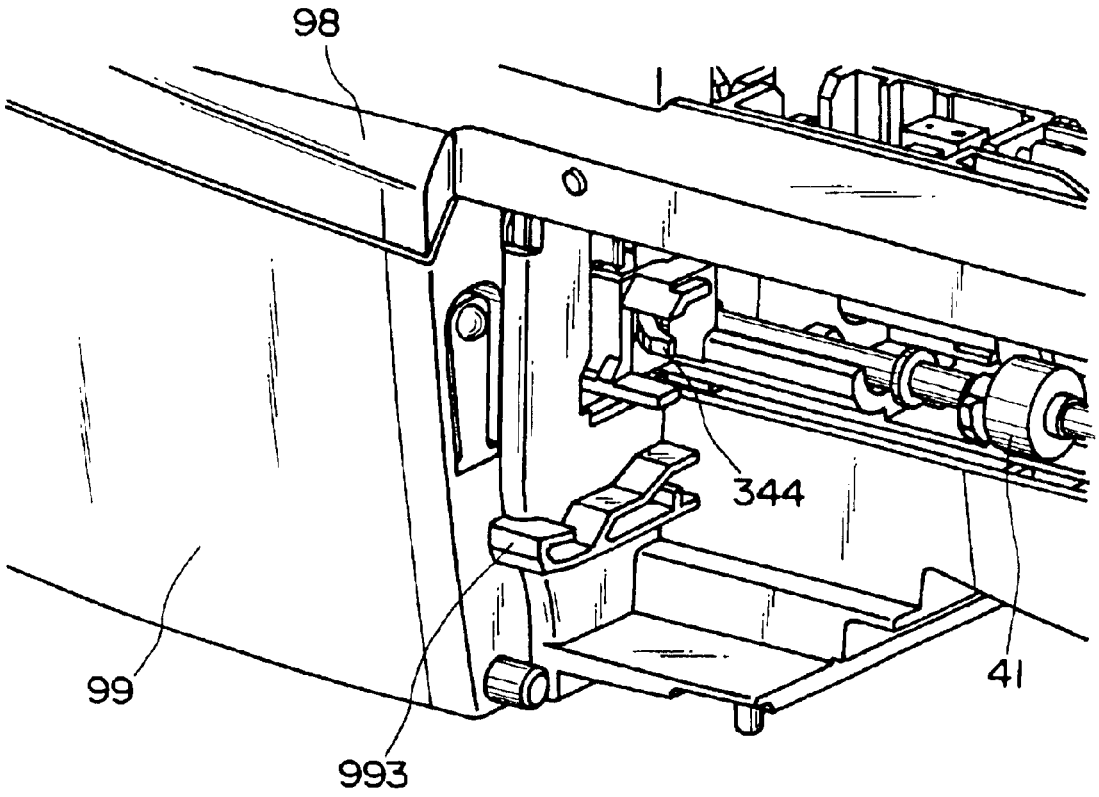
FIG. 8 is a perspective view of the portion of the bottom case of the recording apparatus in the first embodiment of the present invention, to which the CD conveying portion is attached, and the detecting portion of the bottom case for detecting whether or not the CD conveying portion has been attached thereto.
Figure 9:
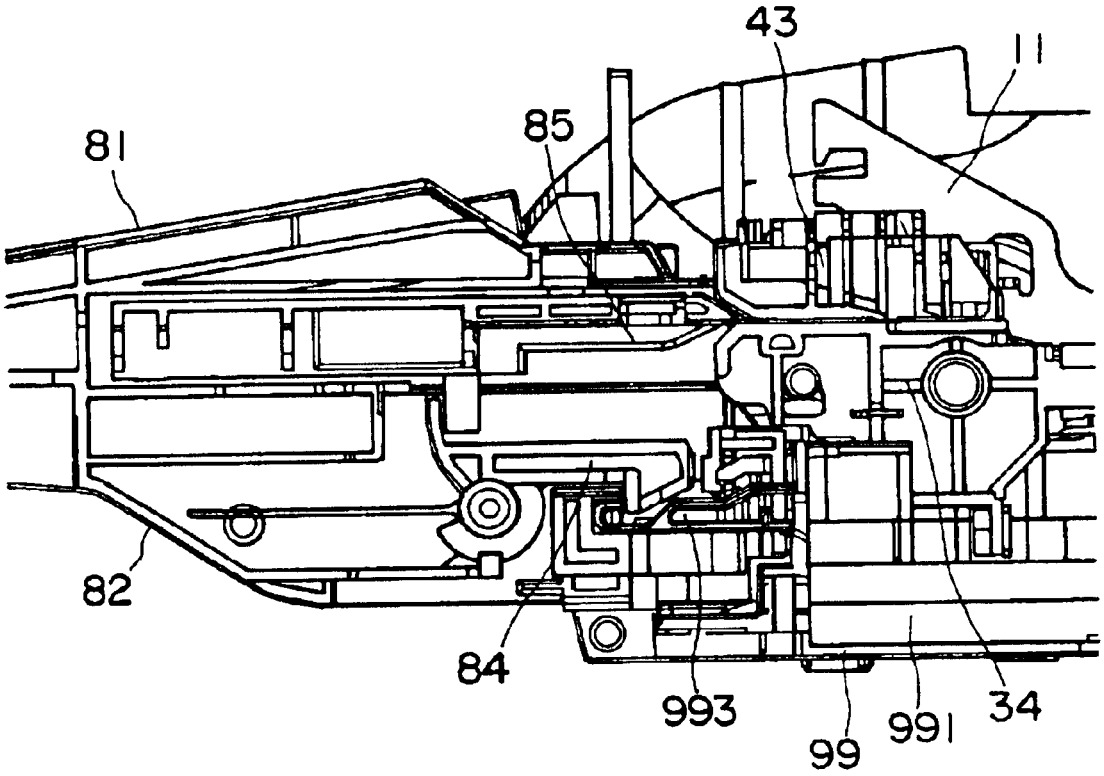
FIG. 9 is a vertical sectional view of the connective portion of the bottom case of the recording apparatus and the connective portion of the CD conveying portion, in the first embodiment of the present invention, showing how the latter is connected to the former by its hooks.
Figure 10:
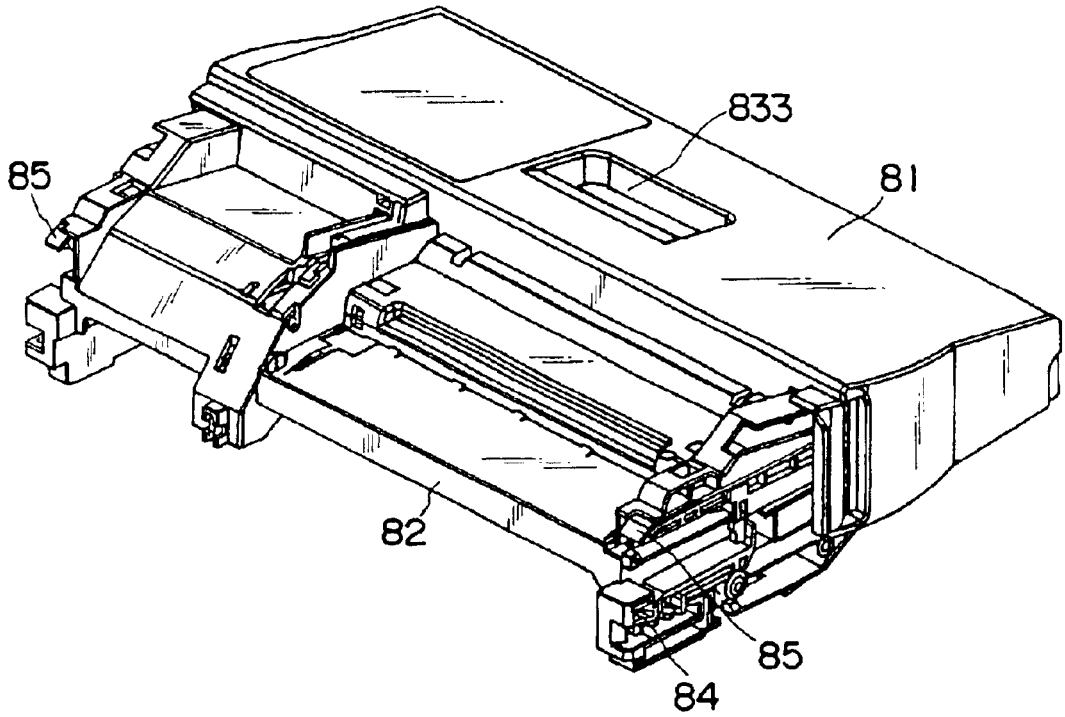
FIG. 10 is a perspective view of the CD conveying portion attachable to the recording apparatus, in the first embodiment of the present invention, showing the state of the CD conveying portion prior to its attachment to the recording apparatus, and the state of the CD conveying portion, the sliding cover of which has been moved after its attachment to the recording apparatus.
Figure 10:
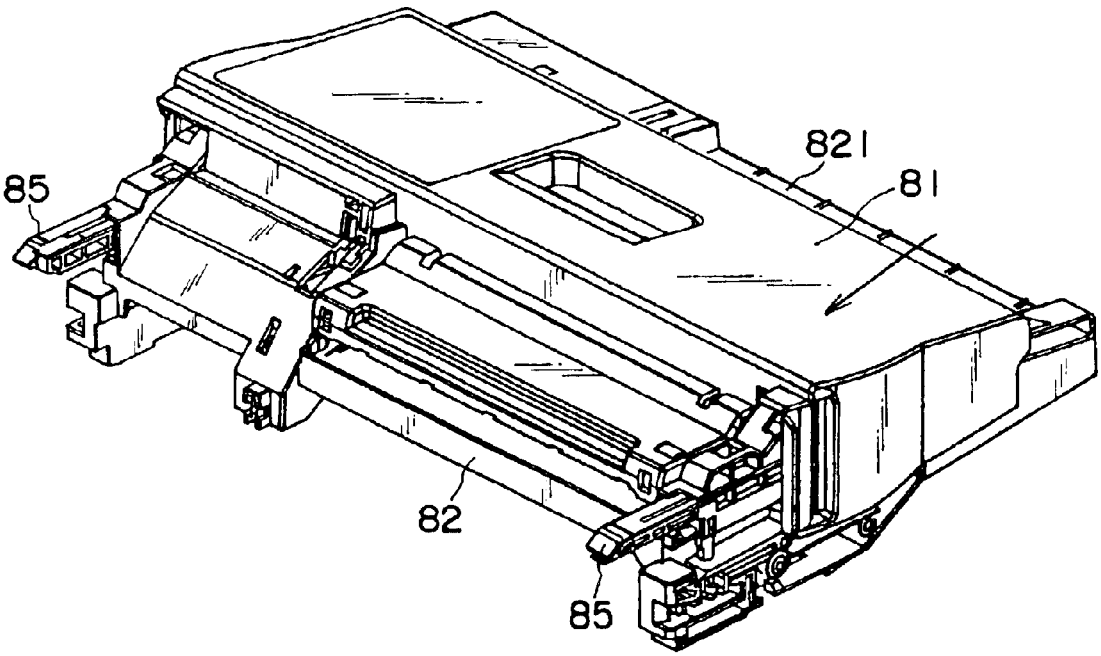
Figure 11:
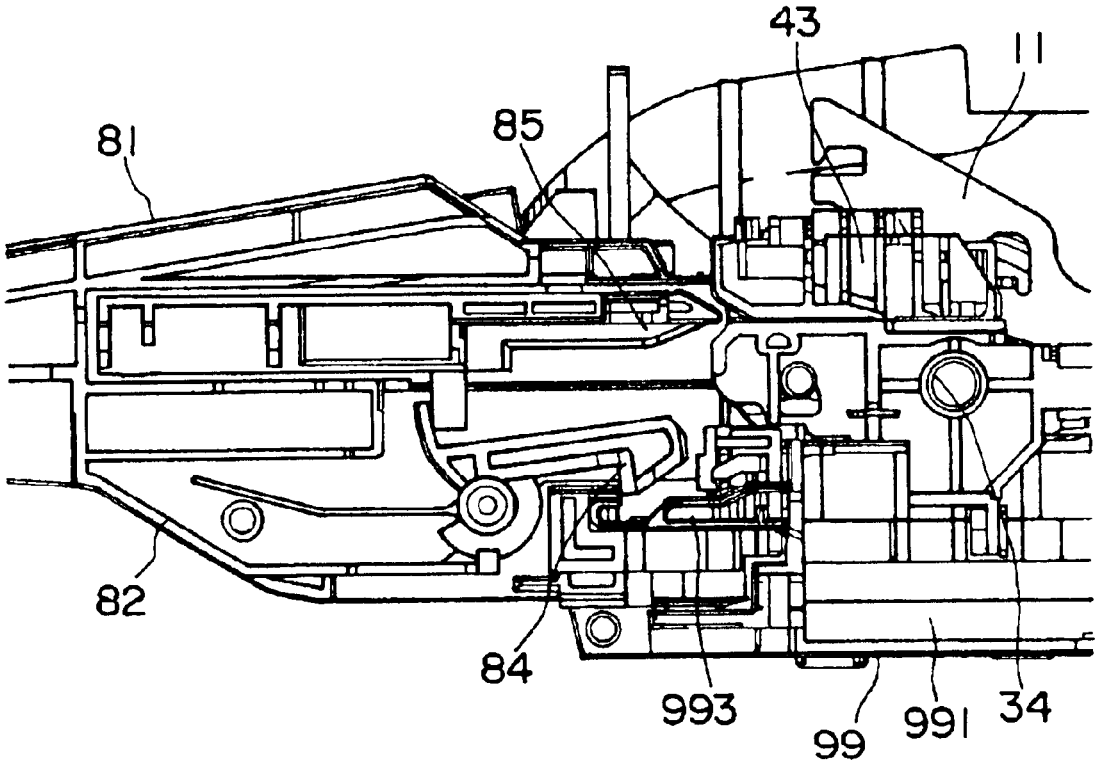
FIG. 11 is a vertical sectional view of the connective portion of the bottom case of the recording apparatus and the connective portion of the CD conveying portion, in the first embodiment of the present invention, immediately after the disengagement of the hooks of the latter from the former.

Next, referring to FIGS. 6–19, the structure of the portion of the recording apparatus in this embodiment of the present invention, which is for accommodating the CD conveying portion 8, and the operation for printing (recording) on a CD, will be described in detail. FIG. 6 is a perspective view of the combination of the recording apparatus, shown in FIG. 1, and CD conveyance portion 8, before and after the attachment of the CD conveyance portion 8 to the recording apparatus, and FIG. 7 is a perspective view of the CD conveyance portion 8 attachable to the recording apparatus shown in FIG. 1. FIG. 8 is a perspective view of the portion of the bottom case 99, to which the CD conveyance portion 8 is attached, and which detects the CD conveyance portion 8. FIG. 9 is a vertical sectional partial view of the combination of the bottom case 99 and CD conveyance portion 8, showing how the hook 84 of the CD conveyance portion 8 engages with its counterpart of the bottom case 99, and FIG. 10 is a perspective view of the CD conveyance portion 8, before the attachment of the CD conveyance portion 8, and after the CD conveyance portion was attached and the sliding cover 81 thereof was moved. FIG. 11 is a vertical sectional partial view of the combination of the bottom case 99 and CD conveyance portion 8, after the disengagement of the hook 84 of the CD conveyance portion 8 from its counterpart of the bottom case 99, and FIG. 12 is a perspective view of the hook, the adjacencies thereof, the CD conveyance portion 8, and their counterparts of the recording apparatus, showing the state of the arm 85 before and after the sliding cover 81 of the CD conveyance portion was moved.

Figure 13:
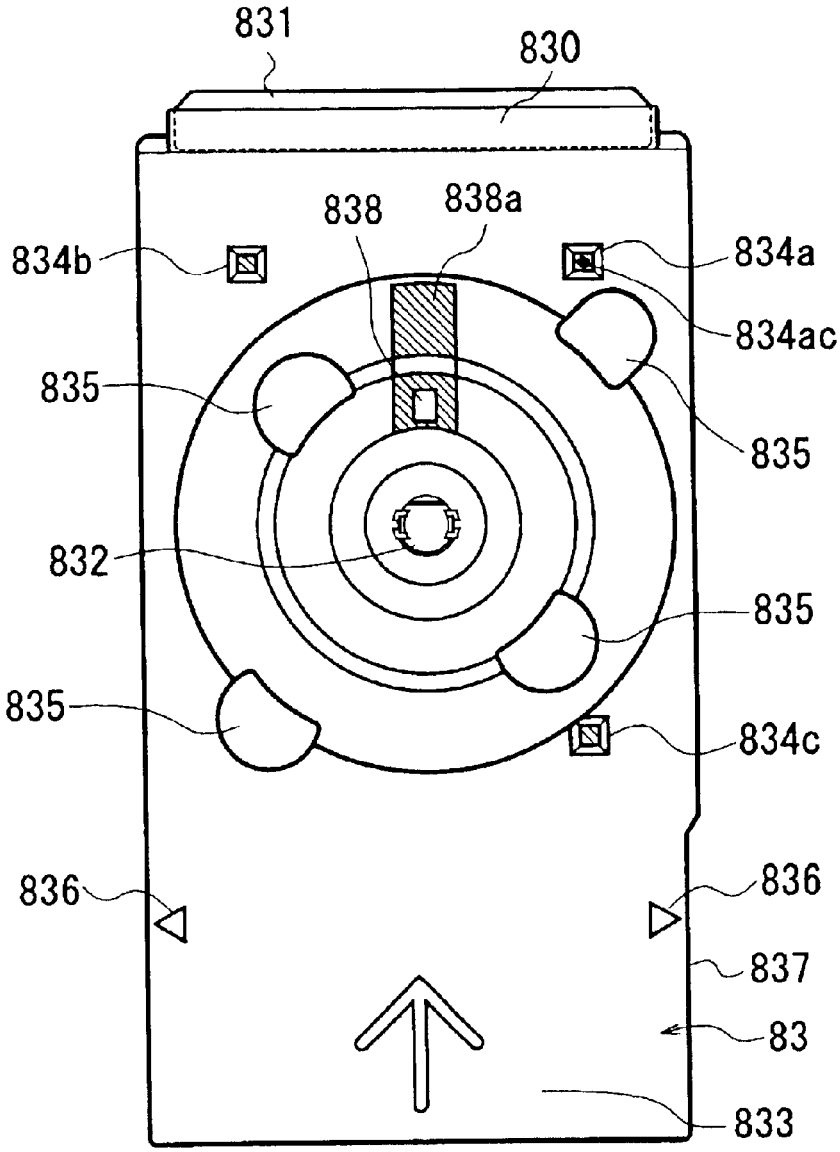
FIG. 13 is a schematic top plan view of the tray for the CD conveying portion usable with the recording apparatus, in the first embodiment of the present invention, showing the means for calculating the recording position on a CD in the tray.
Figure 14:
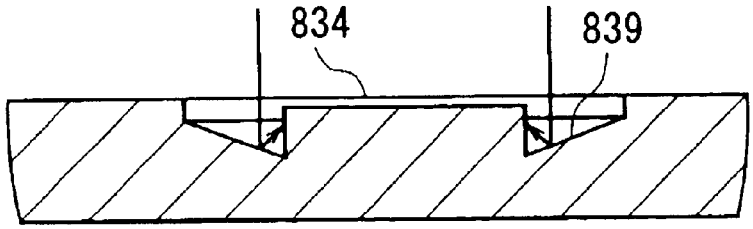
FIG. 14 is a schematic sectional view of the tray shown in FIG. 13, showing the grooves of the position detection portion.
Figure 15:
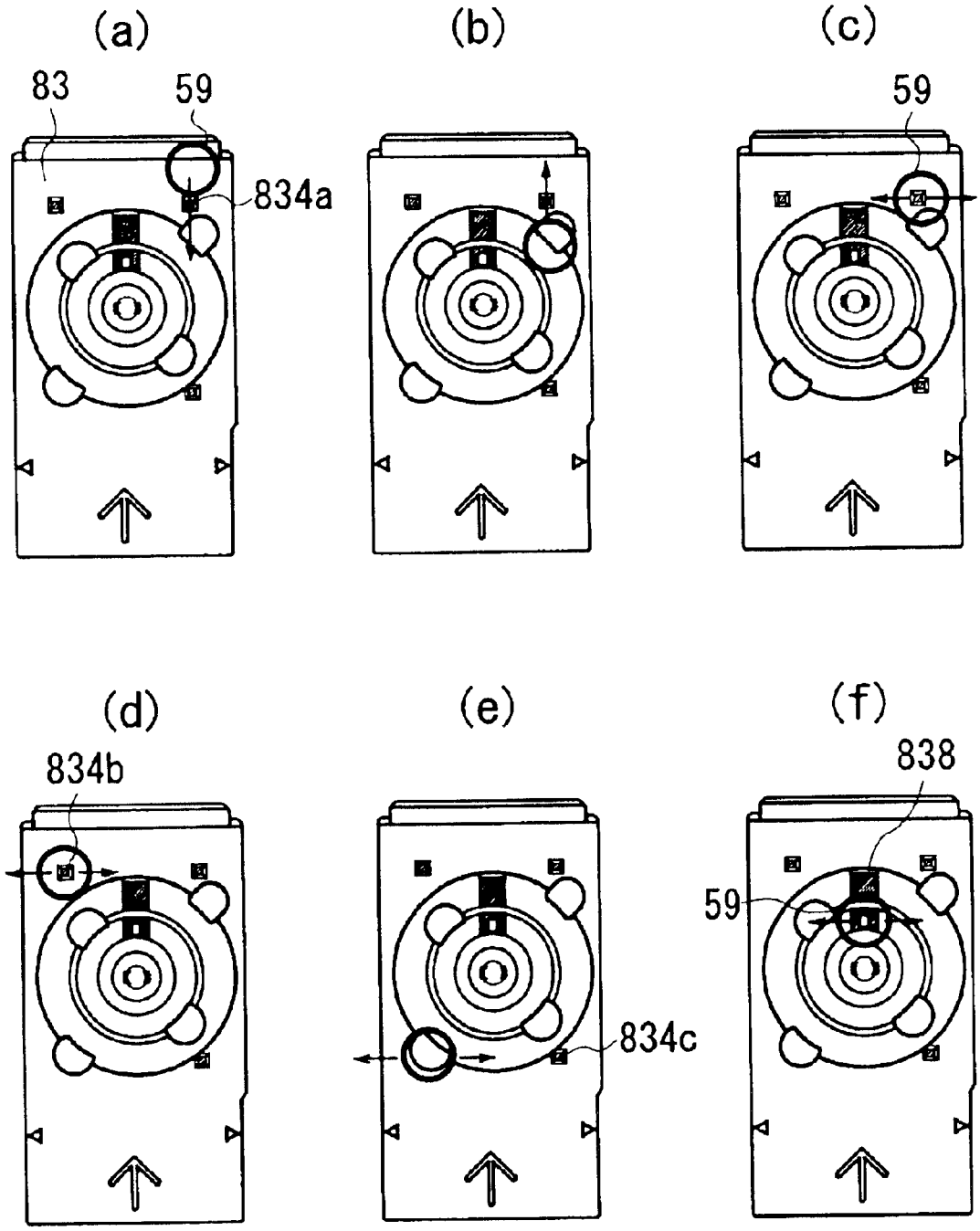
FIG. 15 is a schematic top plan view of the tray shown in FIG. 13, showing the positional relationship between the tray and tray position detecting sensor, in various steps in the tray position detection sequence.
Figure 16:
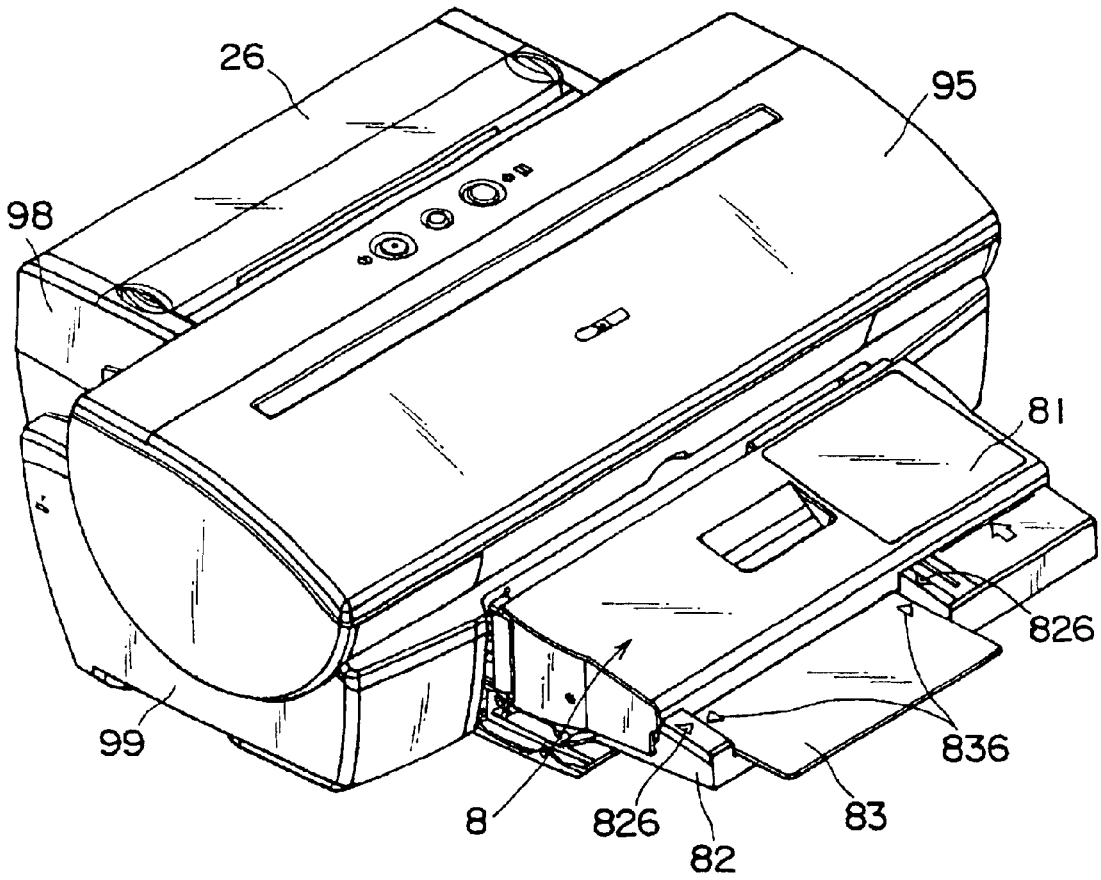
FIG. 16 is a perspective view of the recording apparatus and DC conveying portion, in the first embodiment, after the insertion of the latter into the former.
Figure 17:
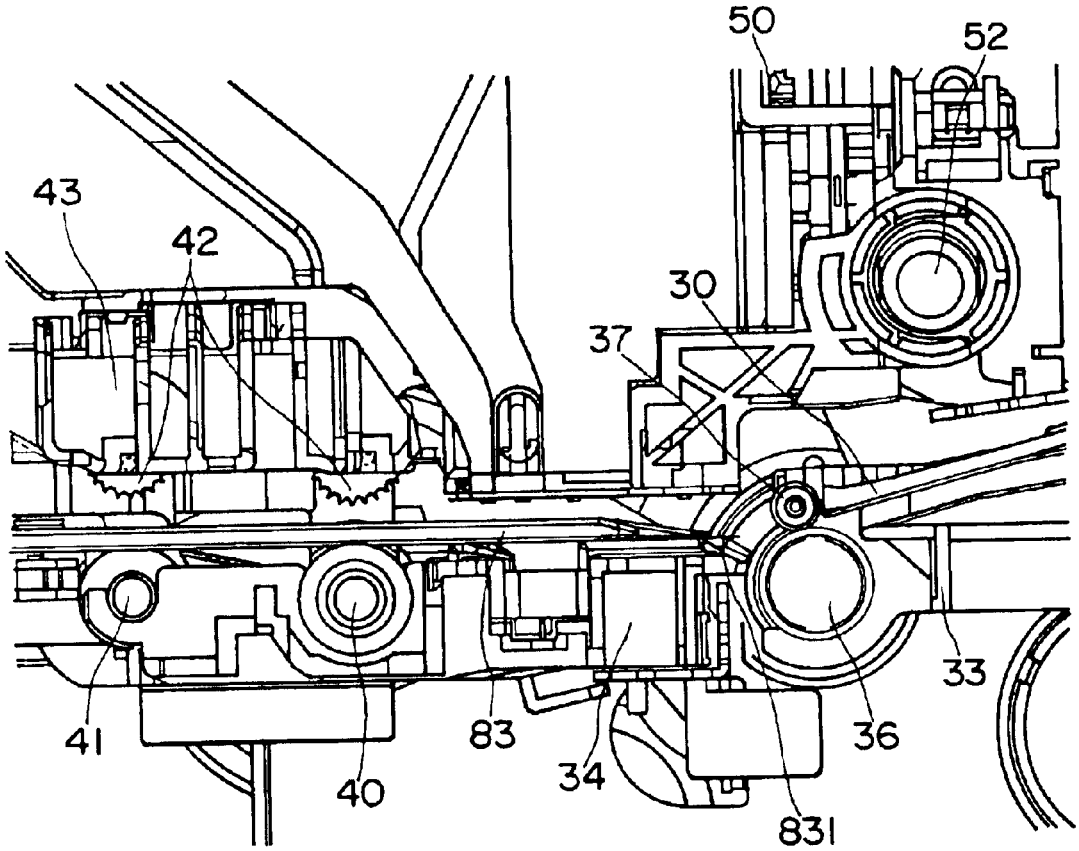
FIG. 17 is a vertical sectional view of the connective portion of the bottom case of the recording apparatus and the connective portion of the CD conveying portion, in the first embodiment of the present invention, showing how the tray is conveyed through them.
Figure 18:
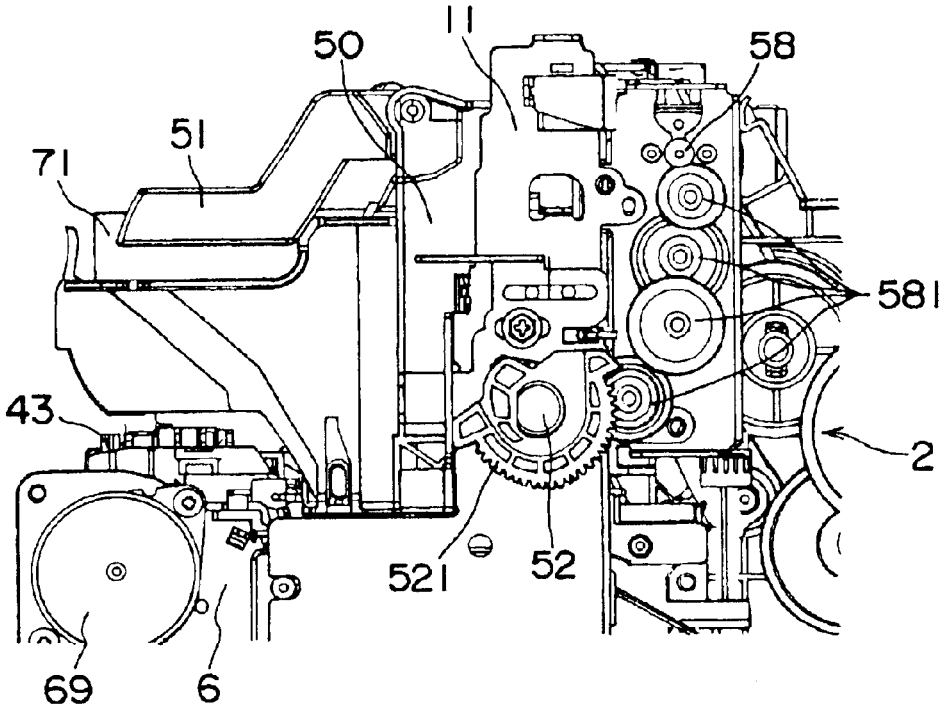
FIG. 18 is a vertical sectional view of the shaft moving mechanism of the recording apparatus, in the first embodiment of the present invention, for vertically moving the guide shaft of the carriage, when the carriage is at the lowest position and when the carriage is at the highest position.
Figure 18:
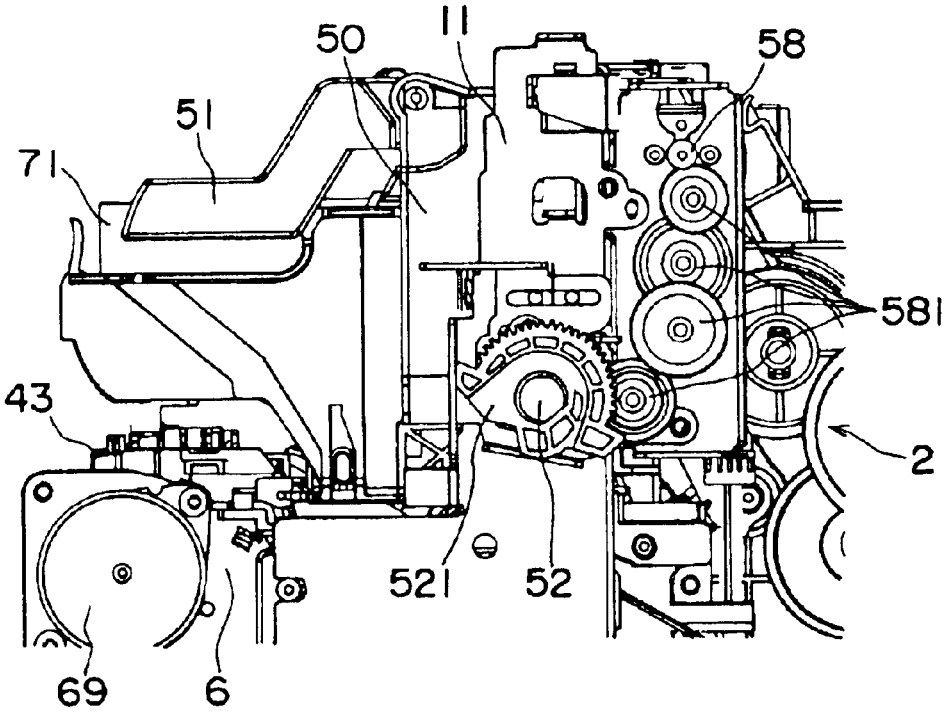
Figure 19:
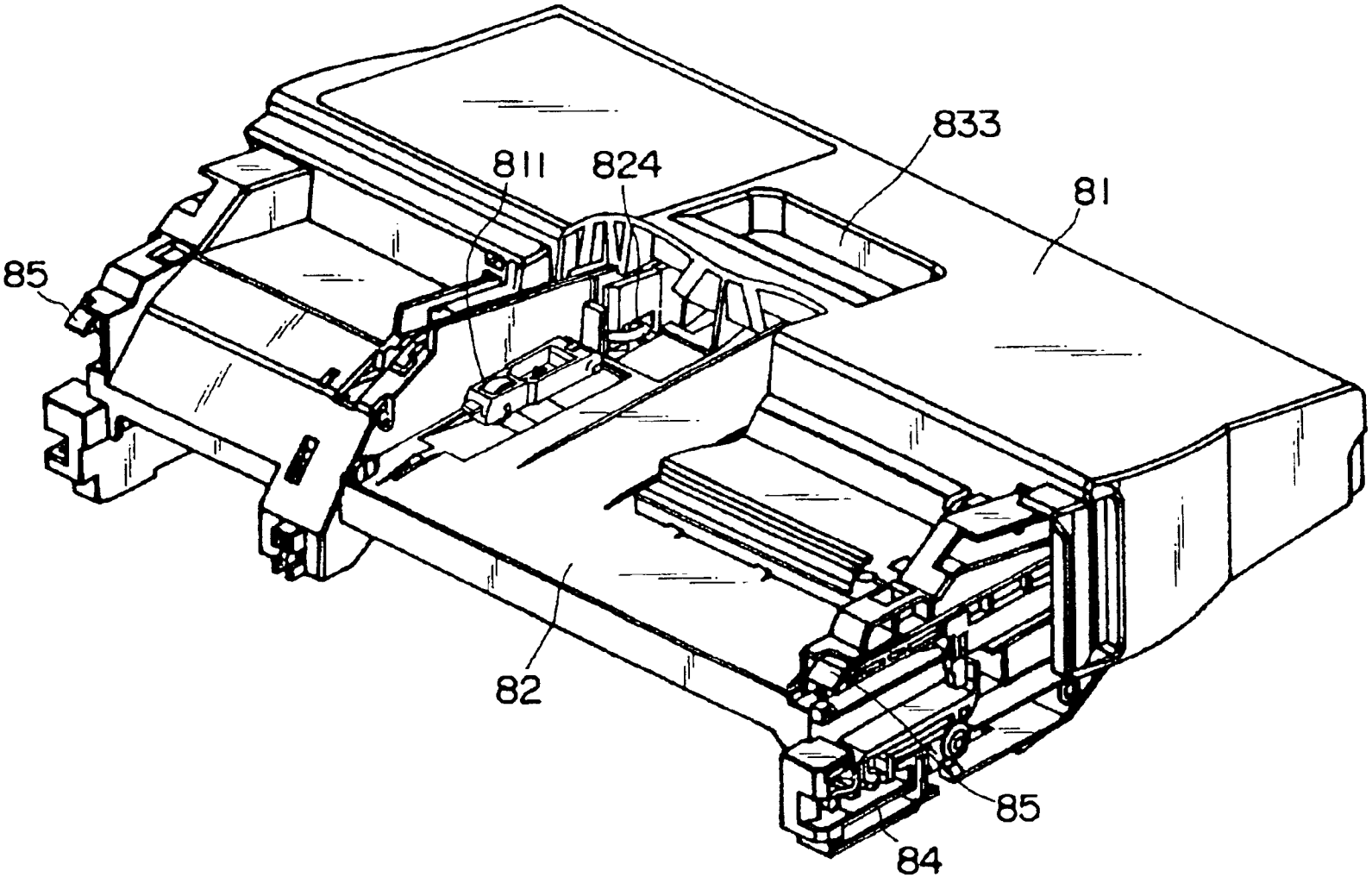
FIG. 19 is a partially broken perspective view of the CD conveying portion attachable to the recording apparatus, in the first embodiment of the present invention, showing one of the rollers for keeping the CD conveying portion pressed downward, and the roller for keeping the CD conveying portion laterally pressed.

FIG. 13 is a schematic top plan view of the CD conveyance portion 8 for the recording apparatus in the first embodiment of the present invention, showing the means for mathematically determining the area of a CD, across which recording is to be made, and FIG. 14 is a schematic sectional view of the tray shown in FIG. 13, showing the sectional shape of the recording position detecting portion of the tray 83. FIG. 15 is a schematic top plan view of the tray 83 shown in FIG. 13 and the tray position detection sensor 59, showing their various positional relationships, and FIG. 16 is a perspective view of the combination of the main assembly of the recording apparatus, CD conveyance portion 8, and tray 83, after the CD conveyance portion 8 was attached to the main assembly and the tray 83 was inserted into the CD conveyance portion 8 in the main assembly. FIG. 17 is a vertical sectional view of the connective portion of the bottom case of the recording apparatus and the connective portion of the CD conveying portion, showing how the tray 84 is conveyed through them. FIG. 18 is a vertical sectional view of the shaft moving mechanism of the recording apparatus, for vertically moving the guide shaft 53 of the carriage 50, when the carriage 50 is at the lowest position and when the carriage is at the highest position. FIG. 19 is a partially broken perspective view of the CD conveying portion 8, showing one of the rollers 811 for keeping the CD conveying portion 8 pressed downward, and the roller 824 for keeping the CD conveying portion laterally pressed.

Referring to FIG. 6, in order to attach the CD conveyance portion 8 to the bottom case 99 of the recording apparatus, the CD conveyance portion 8 is to be slid straight into the recording apparatus in the direction indicated by an arrow mark Y. As the CD conveyance portion 8 is inserted, a pair of lateral tongues of the tray guide 82 are inserted into a pair of lateral guide rails of the bottom case 99 shown in FIGS. 8 and 9, one for one. As a result, the CD conveyance portion 8 becomes accurately positioned relative to the recording apparatus. The tray guide 82 is provided with a pair of rotatable hooks 84, which are located at the left and right front corners of the tray guide 82 in terms of the direction in which the CD conveyance portion 8 is inserted, and which are kept pressured in one direction. As the CD conveyance portion 8 is slid into the recording apparatus, to a predetermined point, it bumps against a certain part of the recording apparatus, being thereby prevented from being inserted further, and each hook 84 interlocks with the stopper of the corresponding guide rail 993, preventing the CD conveyance portion 8 from sliding backward. The platen 34 is provided with a tray guide detection sensor 344 for mechanically detecting whether or not the tray guide 82 (CD conveyance portion 8) is in a predetermined position in the recording apparatus. Thus, as the tray guide 82 is inserted into the recording apparatus main assembly, a part of the tray guide 82 pushes the tray guide detection sensor 344, causing the sensor 344 to detect that the CD conveyance portion 8 (tray guide 82) has been inserted to the predetermined point in the recording apparatus.

Figure 12:
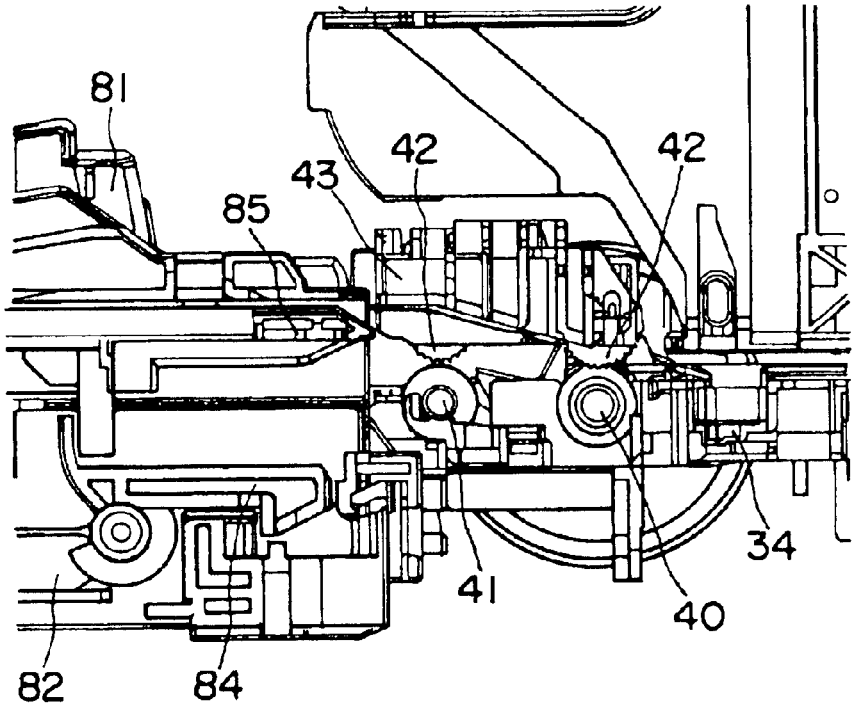
FIG. 12 is a vertical sectional view of the connective portion of the bottom case of the recording apparatus and the connective portion of the CD conveying portion, in the first embodiment of the present invention, showing the state of the arms before and after the movement of the sliding cover of the CD conveying portion.
Figure 12:
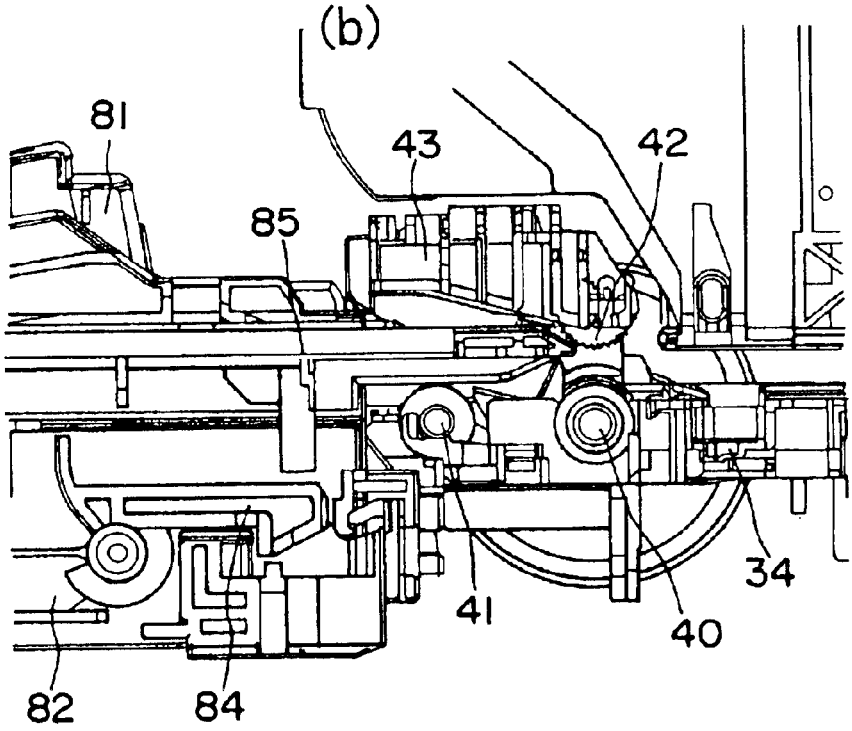

Next, referring to FIGS. 10 and 12, the sliding cover 81 is to be moved toward the main assembly of the recording apparatus. As the sliding cover 81 is moved, the arms 85 are made to protrude toward the main assembly of the recording apparatus, being thereby inserted between the spur wheel holder 43 and platen 34, by the movement of the sliding cover 81. The spur wheel holder 43, which is holding the spur wheels 42 is attached to the platen 34, being enabled to vertically move. Further, the spur wheel holder 43 is kept pressured downward by a predetermined amount of force generated by springs. Thus, as the arms 85 are inserted between the spur wheel holder 43 and platen 34, the spur wheel holder 43 is rotated upward by a predetermined amount. As the spur wheel holder 43 is rotated upward, a space, through which the tray 83, in which a CD (CD-R or the like) as recording medium is placed, is conveyed, is created between the platen 34 and spur wheel holder 43.

Incidentally, the front end portion of each arm 83 is tapered, forming a slanted portion 851. Therefore, the arm 85 can be easily inserted between the platen 34 and spur wheel holder 43.

Each arm 85 is structured so that as it is inserted between the platen 34 and spur wheel holder 43, it becomes locked in the position between the platen 34 and spur wheel holder 43. Before the arm 85 is made to protrude (advance), it remains loosely fitted in the tray guide 82. Further, before the sliding of the sliding cover 81 toward the main assembly of the recording apparatus, the opening 821 of the CD conveyance portion 8 remains covered, preventing the tray 83 from being inserted into the CD conveyance portion 8. The CD conveyance portion 8 is structured so that as the sliding cover 81 is slid toward the main assembly of the recording apparatus, it moves diagonally upward. Therefore, as the sliding cover 81 is slid toward the main assembly, the tray insertion opening 821 is created between the sliding cover 81 and tray guide 82. In this state, the tray 83 containing a CD can be inserted into the CD conveyance portion 8 through the opening 821 to be accurately positioned relative to the main assembly of the recording apparatus, as shown in FIG. 16. The above described structural arrangement is for preventing a tray sheet 831 attached to the leading end of the tray 83, or the spur wheels 42, from becoming damaged due to the collision between the tray 83 and spur wheels 42 which occurs if the tray 83 is inserted without moving the spur holder 43 upward.

Referring to FIG. 11, as the sliding cover 81 is pulled out of the main assembly of the recording apparatus while the tray guide 82 is in the proper position in the main assembly, each arm 85 is disengaged from the spur holder 43 by the movement of the sliding cover 81, and the spur wheel holder 43 and spur wheels 44 descend to their predetermined bottom positions. If an attempt is made to pull out the sliding cover 81 from the main assembly while the tray 83 is in the tray guide 82, the tray 83 becomes stuck in the opening 821 between the sliding cover 81 and tray guide 82, preventing thereby the sliding cover 81 from being pulled out further. Therefore, the problem that a recording medium such as a CD-R is damaged by the spur wheels 44 as the spur wheel 44*s* descend while the recording medium is in the main assembly of the image forming apparatus does not occur.

Also referring to FIG. 11, as the sliding cover 81 is pulled, it causes each hook 84 to disengage from the guide rail 993 of the bottom case 99, allowing the CD conveyance portion 8 to be removed from the main assembly of the recording apparatus.

Referring to FIG. 13, the tray 83 in this embodiment of the present invention is made of a piece of resin plate with a thickness of 2 mm–3 mm. The piece of resin plate (tray) 83 is provided with: a CD locking portion 832; a tray grip portion 833, which is to be grasped by an operator when inserting or removing the tray 83; a plurality of position detection marks (FIG. 13 shows three marks: 834*a*, 834*b*, and 834*c*) 834; four CD removal recesses 835 which are to be used by an operator to remove a CD; a tray alignment mark 836; a recessed edge portion 837 toward which the lateral pressure roller moves to be freed from the pressure; a media presence (absence) detection mark 838; and a tray adaptor type detection mark 838*a* for detecting tray adaptor type. Further, the tray 83 is provided with a tray sheet 81, which is attached to the leading end of the tray 83, in terms of the tray insertion direction, in order to assure that the tray 83 is nipped by the combination of the conveyance roller 36 and pinch roller 37.

As for the positions of the position detection marks 834, two (834*a* and 834*b*) are on the leading end side, with respect to the CD locking portion 832, and one (834*c*) is on the opposite side, or the trailing side. Each of the position detection marks 834 is provided with a highly reflective square member, each edge of which is 3 mm–10 mm long. The reflective member is attached by hot stamping. Referring to FIGS. 13 and 14, each of the portions of the surface of the piece of resin plate (tray 83), to which the reflective member is attached, is surrounded by a groove 839 so that a thin layer of reflective substance can be attached to the piece of resin plate, exactly in the shape of the position detection mark 834. Referring to FIG. 14, the bottom surface of the groove 839 is slanted at a predetermined angle so that if the beam of light emitted from the tray position detection sensor 59 on the carriage 50 is reflected by the areas other than the position detection marks 834, it does not return to the light receiving portion of the tray position detection sensor 59. Therefore, the problem that the position of the tray is erroneously detected can be prevented.

The reflectance of the position detection marks 834 on the tray 83 in this embodiment is very high as described above, making it unnecessary for the sensors mounted on the carriage 50 to be of a high performance type, and also, eliminating the need for the compensatory process or the like. Thus, not only do the position detection marks 834 reduce cost, but also recording time (printing time). Further, the position detecting method in this embodiment, which employs the detection marks 834, can detect the CD position more precisely than any of the conventional CD position detecting methods which directly read the edges of the printable area (recordable area) of a CD, even when printing on a colored CD, or a CD, the printable area of which has been already printed. The CD locking portion 832 is provided with a plurality of molded claws, which keep a CD locked in the proper position. When placing a CD in the tray 83, an operator is to align the center hole of the CD with the CD locking portion 832. When removing a CD, an operator is to use the opposing two of the CD removal recesses 835 so that the operator can remove the CD by holding the CD by the peripheral edge. Further, the area surrounding the CD locking portion 832 is one step lower than the other areas of the tray 83, and the media presence (absence) detection mark 838 is on the surface of this lower area. The media presence (absence) detection mark 838 has a hole with a predetermined dimension, made in a piece of hot stamping foil with a predetermined width, and when this hole is detected, it is determined that a recording medium is not present.

Referring to FIG. 13, as described before, in order to assure that the tray 83 is nipped by the combination of the conveyance roller 36 and pinch roller 37, the tray 83 is provided with the tray sheet 831, which is attached to the leading end of the tray 83, in terms of the tray insertion direction. The tray sheet 831 is a sheet of PET or the like with a thickness of 0.1 mm–0.3 mm. It has a friction coefficient of a predetermined value and a hardness of a predetermined value. Further, the leading end portion of the tray 83 is tapered, forming the tapered portion 830. Thus, as the tray sheet 831 is nipped by the combination of the conveyance roller 36 and pinch roller 37, such force that pulls the tray 831 further into the main assembly of the recording apparatus is generated, and the tapered portion 83, that is, the leading end portion 830, of the tray 83 lifts the pinch roller 37, allowing the thick tray 83 to be nipped by the conveyance roller 36 and pinch roller 37 so that the tray 83 is accurately conveyed. The position detection marks 834 are located so that their positions correspond to the intervals of the pinch rollers 37. Therefore, the position detection marks 834 do not come into contact with the pinch rollers 37. Therefore, the position detection marks 834 are not damaged across their surfaces.

Referring to FIG. 19, the tray guide 82, that is, the CD conveyance portion 8, is provided with a side pressure roller 824 for keeping the tray 83, shown in FIG. 13, pressed against a positional reference portion 823. More specifically, the roller 824 is kept pressured by the predetermined amount of pressure generated by a spring 825, keeping thereby the tray 83 pressed against the positional reference portion 823 by the predetermined amount of pressure. As a result, the tray 83 is kept accurately positioned in the tray guide 82. The side pressure roller 824 keeps pressing on the lateral surface of the tray 83 until the tray 83 is inserted by an operator to a predetermined point, beyond which the side pressure roller 824 does not press on the lateral surface of the tray 83, because, beyond this point, the side pressure roller 824 faces the recessed edge portion of the lateral surface of the tray 83 (FIG. 13). This structural arrangement is for preventing the tray 83 from being subjected to an excessive amount of back tension or the like, in order to prevent the accuracy with which the tray 83 is conveyed, from being reduced.

Also referring to FIG. 19, the sliding cover 81 is provided with a pair of pressure rollers 811, that is, the left and right pressure rollers 811, which keep the tray 83 pressed upon the discharge roller 41, by being kept pressured by the predetermined amount of pressure generated by roller springs 812. As a result, the force for conveying the tray 83 is generated. The tray 83 can be conveyed by this tray conveying force from the position in which the tray 83 is set at the beginning of a recording (printing) operation, to the nipping portion formed by the conveyance roller 36 and pinch roller 37. Further, the tray 83 can be conveyed by this tray conveying force to a predetermined point, at which the operator can take out the tray 83. The tray guide 82 and tray 83 are structured so that the position detection marks 834 and pressure rollers 811 do not coincide in position, preventing thereby the position detection marks 834 from coming into contact with the pressure roller 811 and being damaged across their surfaces by the pressure roller 811. After the tray 83 is conveyed outward to the above mentioned point, the tray 83 can be pulled out of the tray guide 82. Then, the operator can utilize the CD removal recesses to remove the CD in the tray 83 by holding the CD by its peripheral edge.

Next, the process of recording on a CD with the use of the recording apparatus structured as described will be described. First, the CD conveyance portion 8 is to be slid straight into the bottom case 99 of the main assembly of the recording apparatus 1. As the CD conveyance portion 8 is inserted, it is detected by the tray guide detection sensor 344 (FIG. 8) that the tray guide 82 has just been inserted into the main assembly of the recording apparatus. Next, the sliding cover 81 is to be moved toward the recording apparatus main assembly. As the sliding cover 81 is moved, each of the two arms 85 is made to protrude toward the recording apparatus main assembly by the movement of the sliding cover 81, as shown in FIG. 10, and moves into the interface between the spur wheel holder 43 and platen 34, moving the spur wheel holder 43 upward by the predetermined amount.

Since the sliding cover 81 is structured so that as it is pushed toward the recording apparatus main assembly, it moves diagonally upward toward the recording apparatus main assembly, the opening 821 (FIG. 6) is created between the sliding cover 81 and tray guide 82. Therefore, the operator can insert the tray 83, which contains a CD, into the tray guide 82, to the predetermined point, as shown in FIG. 16. More specifically, a CD is to be locked to the tray 83 with the use of the CD locking portion 832 (FIG. 32) after being placed in the tray 83. The operator is to hold the tray 83 by the grip portion 833, and insert the tray 83 into the tray guide 82 until the tray alignment marks 836 on the tray (FIGS. 13 and 16) align with the tray alignment marks 826 on the tray guide (FIG. 16).

As recording signals (print signals, image formation signals) are sent from a host while the tray 83, in which the CD is present, is in the above described position, an actual recording operation (printing operation) begins. That is, first, the conveyance roller 36, discharge roller 40 and discharge roller 41 are rotated in reverse, as shown in FIG. 17. As described before, the force for conveying the tray 83 is generated by pressing the tray 83 upon the discharge rollers 40 and 41 by the predetermined pressure generated by the pressure roller 811 (FIG. 19) and pressure roller 812. Therefore, as the discharge rollers 40 and 41 are rotated in reverse, the tray 83 is conveyed inward of the recording apparatus. Then, as the tray sheet 831 (FIG. 13) located at the leading end of the tray 83 is nipped between the conveyance roller 36 and pinch roller 37, pulling the tray 83 further inward of the recording apparatus; the successive conveyance force of the predetermined value is generated. As a result, the tapered portion 830, that is, the leading end portion, of the tray 83 is made to enter between the conveyance roller 36 and pinch roller 37 while lifting the pinch roller 37. Consequently, the tray 83 becomes sandwiched by the conveyance roller 36 and pinch roller 37.

Next, the carriage 50 on which the recording head 7 is riding moves from its home position to its recording range (printing range) to detect the tray 83. Prior to this movement of the carriage 50, the carriage motor 58 (FIG. 3) for vertically moving the carriage 50 moves the guide shaft 52 upward, creating the optimal gap between the recording head 7 and tray 83 (between head and sheet), as shown in FIG. 18. Then, the recording (printing) position on the CD is calculated using the means for calculating the recording position on the CD on the tray 83, shown in FIG. 13, in the first embodiment of the present invention, and following the steps shown in FIG. 15. More specifically, first, referring to FIGS. 15(*a*) and 15(*b*), the carriage 50 is stopped as the tray position detection sensor 59 on the carriage 50 aligns with the position detection mark 834*a* (FIG. 13) of the tray 83. Then, the position of the top edge (leading edge) of the position detection mark 834*a* by conveying the tray 83. Then, the position of the bottom edge (trailing edge) of the position detection mark 834*a* is detected by further conveying the tray 83.

Next, referring to FIG. 15(*c*), the tray 83 is moved backward so that the tray position detection sensor 59, as a tray position detecting means, on the carriage 50 is roughly aligned with the center of the position detection mark 834*a* of the tray 83. Then, the carriage 50 is moved left- and rightward to detect the positions of the right and left edges of the position detection mark 834*a*, as means to be detected for position detection. These steps make it possible to calculate the center position 834*ac* (FIG. 13) of the position detection mark 834*a*, and with reference to this center position 834*ac*, the recording position (printing position) of the CD in the tray 83 can be accurately calculated. In this embodiment, the position of the tray 83 itself is detected as described above, compared to any of the conventional systems which rely on only mechanical accuracy, that is, without actually detecting the recording position. Therefore, it is possible to eliminate the problem that, because of the effects of component tolerance, tray condition, etc., recording is made (image is printed) on a CD, across the area offset from the intended recording area.

After the detection of the position (center position 834*ac*) of the position detection mark 834*a* as the means, on the tray 83, to be detected for position detection, the carriage 50 is moved, as shown in FIG. 15(*d*), to detect the position detection mark 834*b* as the means, on the tray 83, to be detected for position detection. The left and right edges of this position detection mark 384*b* are detected to confirm that the position detection mark 834*a* detected in the prior detection step is not the wrong one. The reason for carrying out this operation is as follows. That is, if the tray 83 is inserted beyond the normal position, as shown in FIG. 15(*e*), the position detection mark 834*c* is detected instead of the position detection mark 834*a*. In such a case, the attempt to detect the position detection mark 834*b* will fail, proving that the detected position detection mark is not the position detection mark 834*a*.

After the detection of the position of the tray 83, the tray 83 is conveyed in the normal tray conveyance direction so that the tray position sensor 59 as the tray position detecting means of the carriage 50 aligns with the recording medium presence (absence) detection mark 838 (FIG. 13) as the means, on the tray 83, to be detected, as shown in FIG. 15(*f*). Then, the edges of the hole of the recording medium presence (absence) detection mark 838 are detected, and if the distance between the two edges matches the predetermined hole width, it is determined that no CD is in the tray 38. Then, the recording operation (printing operation) is interrupted, and the tray 83 is moved outward to a predetermined point. Then, an error message is displayed. On the other hand, if the recording medium presence (absence) detection mark 838 could not be detected, it is determined that a CD is in the proper position in the tray 83, and the recording operation is allowed to proceed. After the completion of the above described initial operation sequence, the tray 83 is conveyed deeper into the recording apparatus (printer or the like), to the predetermined position in which recording can be made (images can be printed) across the entirety of the recordable (printable) area of the Cd. Then, the recording (printing) begins in accordance with the recording data sent from the host. Incidentally, the usage of one of the so-called multi-pass recording methods which form images by scanning multiple times a given area of a recording medium reduces the extent of inconsistency, in terms of the recording medium conveyance direction, by which images are recorded, and which is related to the accuracy with which a CD is conveyed and the accuracy with which the ink droplets from the recording head 7 land on the recordable area of the CD.

After the completion of the recording (printing) operation, the tray 83 is conveyed to the position in the tray guide 82, into which the operator placed the tray 83 before the beginning of the actual printing operation. From this position, the operator can pull out the tray 83, which now contains the CD, across the recordable area of which recording has been made. After the removal of the CD, the sliding cover 81 is to be pulled toward the front (in the direction to move the sliding cover away from the recording apparatus main assembly). As the sliding cover 81 is pulled, each arm 85 is released from the spur wheel holder 43, and each hook 84 is released from the bottom case 99, allowing the CD conveyance portion 8 to be removed (freed) from the recording apparatus main assembly. As is evident from the above description of the recording apparatus in the first embodiment of the present invention, the recording apparatus in this embodiment is capable of precisely recording (printing) on a CD, and yet, is simple in structure and operation, and easy to operate.

(Embodiment 2)

Figure 20:
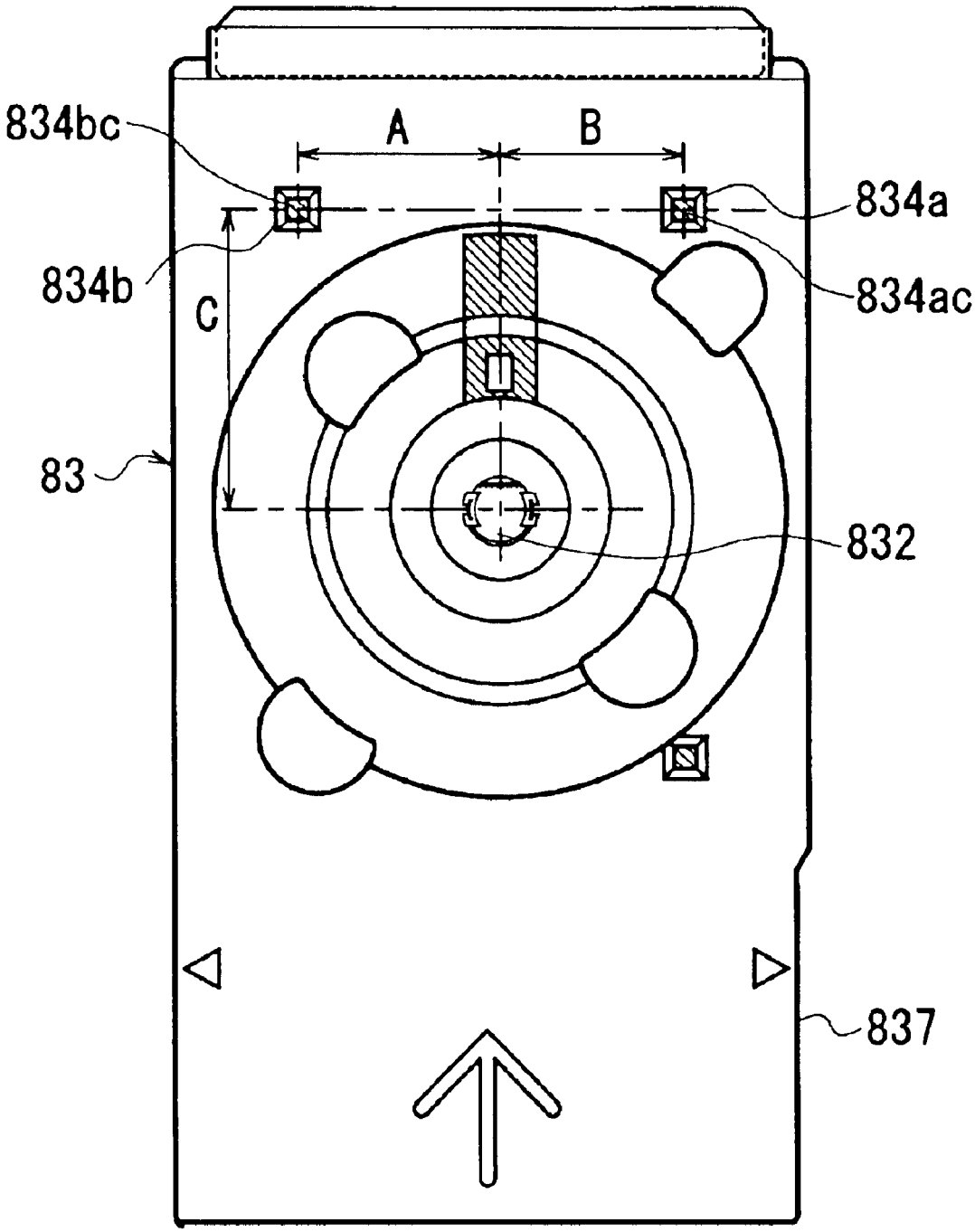
FIG. 20 is a schematic top plan view of the tray for the CD conveying portion usable with the recording apparatus, in the second embodiment of the present invention, showing the means for calculating the recording position on a CD in the tray.

FIG. 20 is a schematic top plan view of the tray usable with the CD conveyance portion 8 for the recording apparatus, in the second embodiment of the present invention, showing the means for calculating the recording position on a CD. In the first embodiment described above, the recording position (printing position) on a CD in the proper position in the tray 83 is obtained by calculating the center position 834*ac* of the position detection mark 834*a*, and the other position detection marks 834*b* and 834*c* were used as confirmation marks. However, the recording position on a CD may be calculated by detecting a plurality of position detection marks as is in this embodiment.

To describe in more detail, in the case of the tray 83 in the second embodiment shown in FIG. 20, both the position detection marks 834*a* and 384*b* are provided with center positions 834*ac* and 834*bc*, respectively, similar to the center position 834*ac* in the first embodiment. Chosen, in this embodiment, as the referential point for calculating the recording position on a CD in the tray 83 is such a point of the tray 83 that is a predetermined distance C toward the upstream direction, in terms of the tray insertion direction, from the point, on the line connecting the center positions 834*ac* and 834*bc* of the position detection marks 834*a* and 834*b*, which is a distance A from the center positions 834*ac* and a distance B from the center position 834*bc*. Otherwise, the second embodiment, the tray 83 in which is shown in FIG. 20, is practically the same in structure as the first embodiment. The structural arrangement in this embodiment makes it possible to compensate even if the tray 83 moves askew. Therefore, it makes it possible to more accurately record (print) on a CD in terms of position.

(Embodiment 3)

Figure 21:
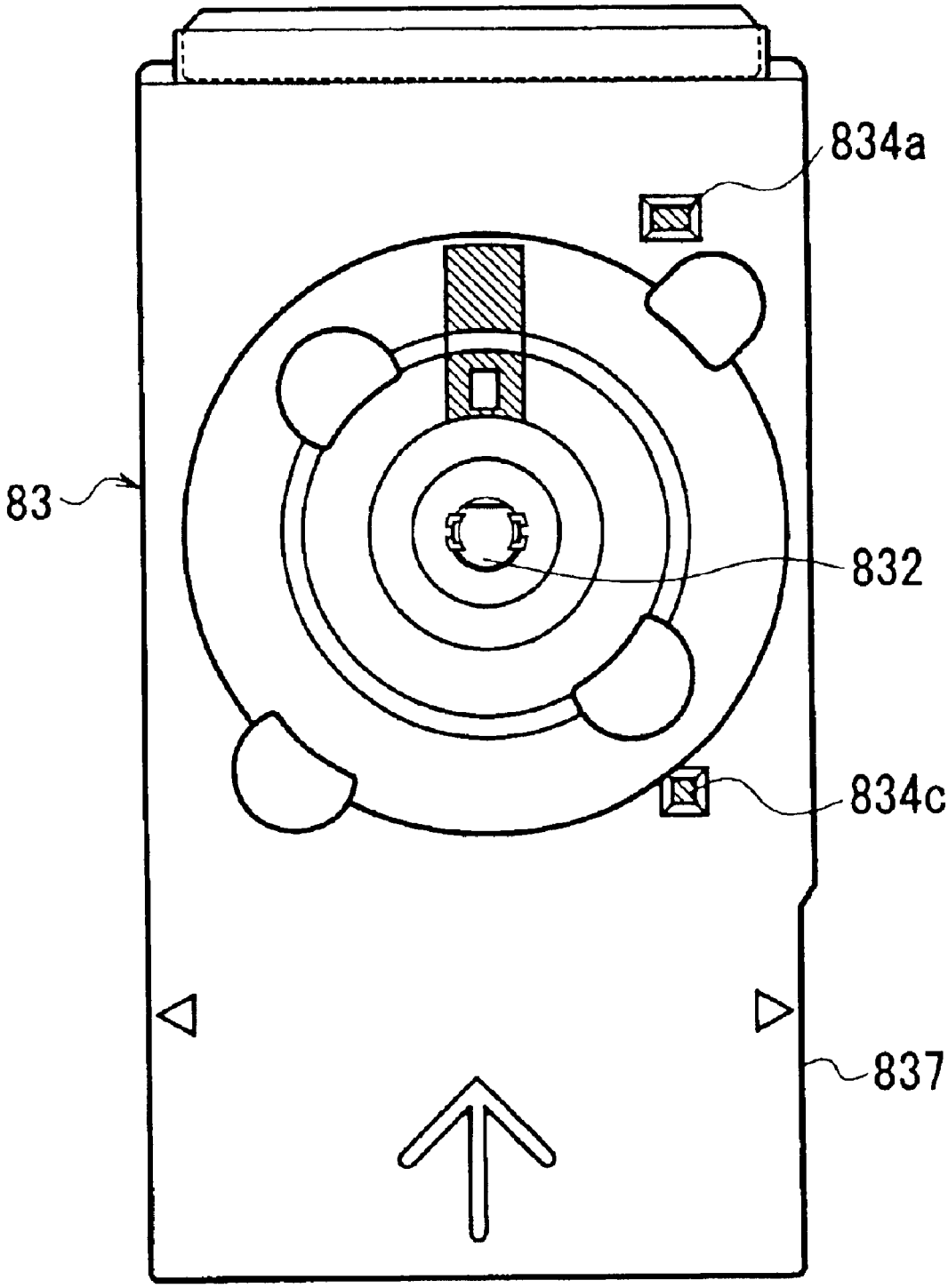
FIG. 21 is a schematic top plan view of the tray for the CD conveying portion usable with the recording apparatus, in the third embodiment of the present invention, showing the means for calculating the recording position on a CD in the tray.

FIG. 21 is a schematic top plan view of the tray 83 usable with the CD conveyance portion 8 for the recording apparatus, in the third embodiment of the present invention, showing the means for calculating the recording position on a CD. In the preceding embodiments (first and second embodiments) described above, three position detection marks 834 were provided as the means for detecting the tray 83. The number of the position detection marks 834, however, may be two as shown in FIG. 21. One of the position detection marks 834, which in this embodiment is the position detection mark 834*a*, is rectangular, whereas the other mark, or the position detection mark 834*c*, is square as those in the preceding embodiments. Therefore, whether the position detection mark 834*a* is detected or the position detection mark 834*c*, its identity is clear, making unnecessary the operation carried out in the preceding embodiments to detect the position detection mark 834*b*. Therefore, the throughput of this embodiment is greater than those of the preceding embodiments. Otherwise, the third embodiment, the tray 83 in which is shown in FIG. 21, is practically the same in structure and function as the preceding embodiments.

(Embodiment 4)

Figure 22:
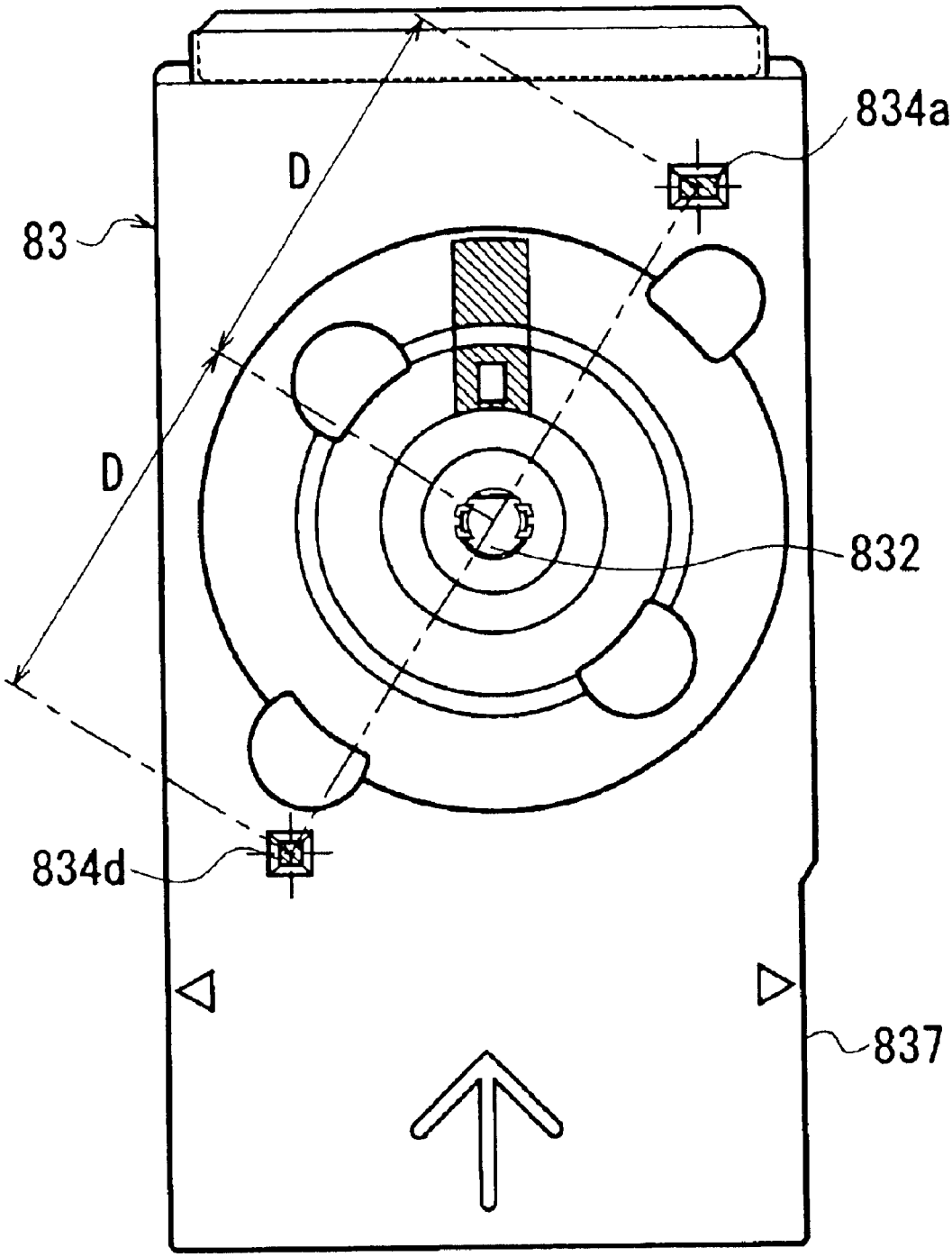
FIG. 22 is a schematic top plan view of the tray for the CD conveying portion usable with the recording apparatus, in the fourth embodiment of the present invention, showing the means for calculating the recording position on a CD in the tray.

FIG. 22 is a schematic top plan view of the tray 83 usable with the CD conveyance portion 8 for the recording apparatus, in the fourth embodiment of the present invention, showing the means for calculating the recording position on a CD. In the second embodiment described above, such a point of the tray 83 that is a predetermined distance C perpendicularly in the upstream direction, in terms of the tray insertion direction, from the central point of the line connecting the center positions 834*ac* and 834*bc* of the position detection marks 834*a* and 834*b* was chosen as the referential point for calculating the recording position on a CD in the tray 83. Instead, however, the position detection marks 834*a* and 834*b*, as the means to be used for calculating the recording position on a CD may be disposed as shown in FIG. 22, in which the position detection marks 834*a* and 834*b* are at the right front corner and left rear corner, respectively, in terms of the tray insertion direction, so that the line connecting the two marks 834*a* and 834*b* becomes diagonal relative to the tray insertion direction.

Also referring to FIG. 22, one of the position detection marks, which in this embodiment is the position detection mark 834*a*, is rectangular, the intersection of the diagonals of which constitutes the center position 834*ac*, whereas the other position detection mark, which in this embodiment is the position detection mark 834*b*, is square, and the intersection of the diagonals of which constitutes the center position 834*bc*. Further, the center of the CD locking portion 832 coincides with the center of the line connecting the center position 834*ac* and 834*bc*; in other words, the center of the CD locking portion 832 coincides with the center of the recordable area of a CD. Otherwise, the fourth embodiment, the tray in which is shown in FIG. 22, is practically the same in structure and function as the second embodiment. The structural arrangement in the fourth embodiment also can align the center of the recordable area of a CD with the center of the DC locking portion. In addition, the structural arrangement in this embodiment makes it possible to compensate even if the tray 83 moves askew. Therefore, it is possible to more accurately record (print) on a CD in terms of position. Otherwise, the fourth embodiment, the tray in which is shown in FIG. 22, is practically the same in structure and function as the preceding embodiments.

(Embodiment 5)

Figure 23:
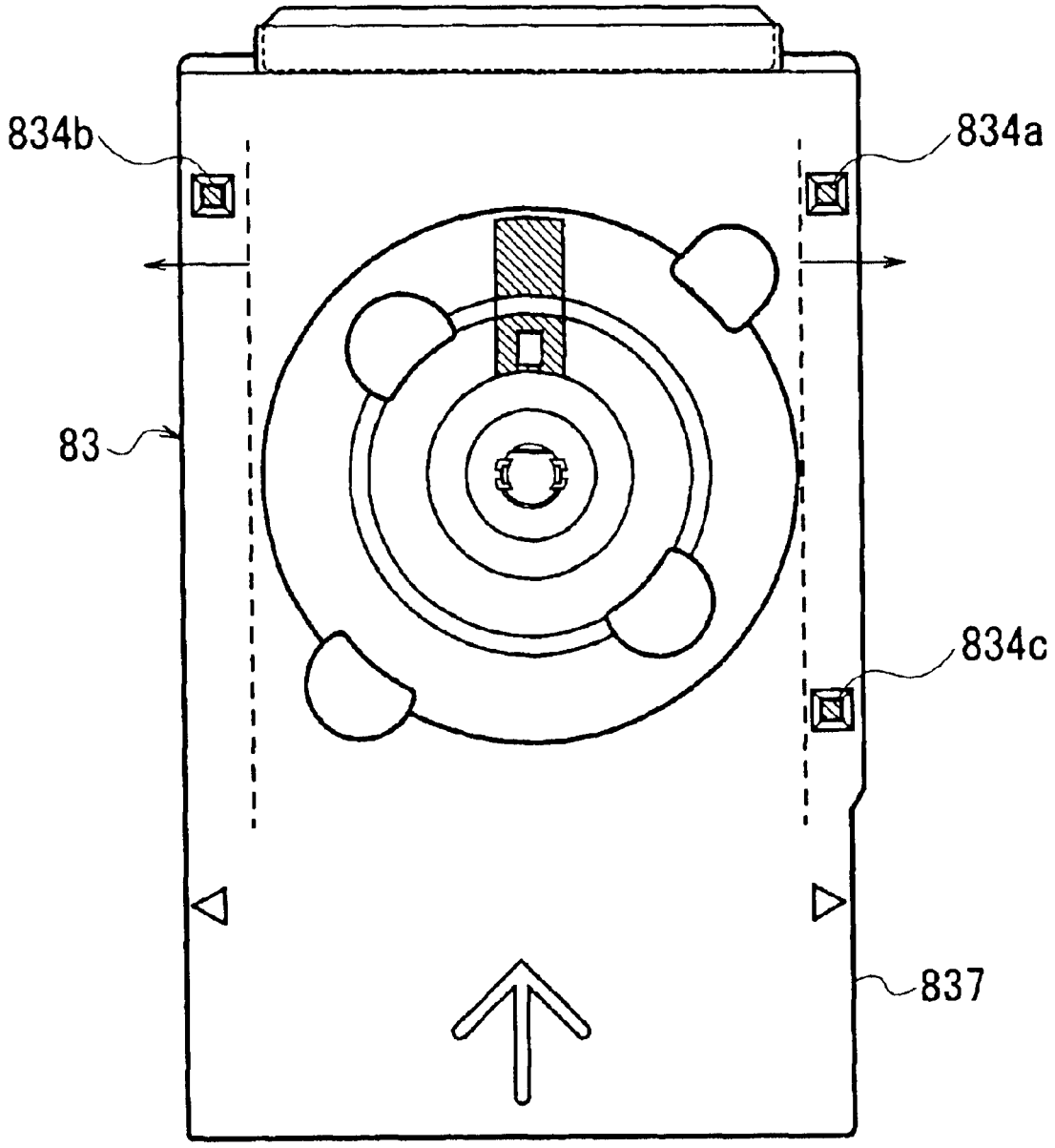
FIG. 23 is a schematic top plan view of the tray for the CD conveying portion usable with the recording apparatus, in the fifth embodiment of the present invention, showing the means for calculating the recording position on a CD in the tray.

FIG. 23 is a schematic top plan view of the tray 83 usable with the CD conveyance portion 8 for the recording apparatus, in the fifth embodiment of the present invention, showing the means for calculating the recording position on a CD. In the preceding embodiments described above, the means (position detection mark) 834 to be detected for position detection, are disposed so that they will be within the recordable range of a CD in the tray 83, in terms of the direction perpendicular to the tray conveyance direction. In this embodiment, however, they are disposed outside the recordable range of a CD, as shown in FIG. 23. More specifically, the three position detection marks 834*a*, 834*b*, and 834*c* are disposed outside the thick dotted lines, in FIG. 23, which border the recordable (printable) range of a CD in the tray 83, in terms of the direction perpendicular to the tray conveyance direction, and which extend in the tray conveyance direction. This positional arrangement prevents the path of the tray position detecting means (tray position detection sensor) 59 on the carriage 50 from overlapping with a CD in the tray 83. In other words, the tray position detecting means 59 reads only the surface of the tray 83. Therefore, the possibility that erroneous detections will occur because the recordable area of a CD already has a recorded (printed) image, is eliminated. Otherwise, the fifth embodiment, the tray in which is shown in FIG. 23, is practically the same in structure and function as the preceding embodiments, and therefore, is capable of precisely calculating the recording position on a CD to accurately record (print) on a CD in terms of position.

The preceding embodiments (Embodiments 1–5) described above offer the following functions and effects:

The position of a CD is directly detected. Therefore, the component tolerance, tray condition, or the like does not cause an image to be printed on a wrong area of a CD. Further, even if the tray moves askew or in the like fashion, compensation can be made to record on the normal position.

The means, on the tray, to be detected are high in reflectance. Therefore, it is unnecessary to employ high performance sensors, and the need for compensatory processes is smaller. Therefore, it is possible to provide recording apparatuses which are inexpensive and are shorter in printing time, compared to the recording apparatuses in accordance with the prior arts. Further, the printing position of a CD can be accurately detected even if the CD is colored or even if the CD already has a printed image.

(Embodiment 6)

Figure 24:
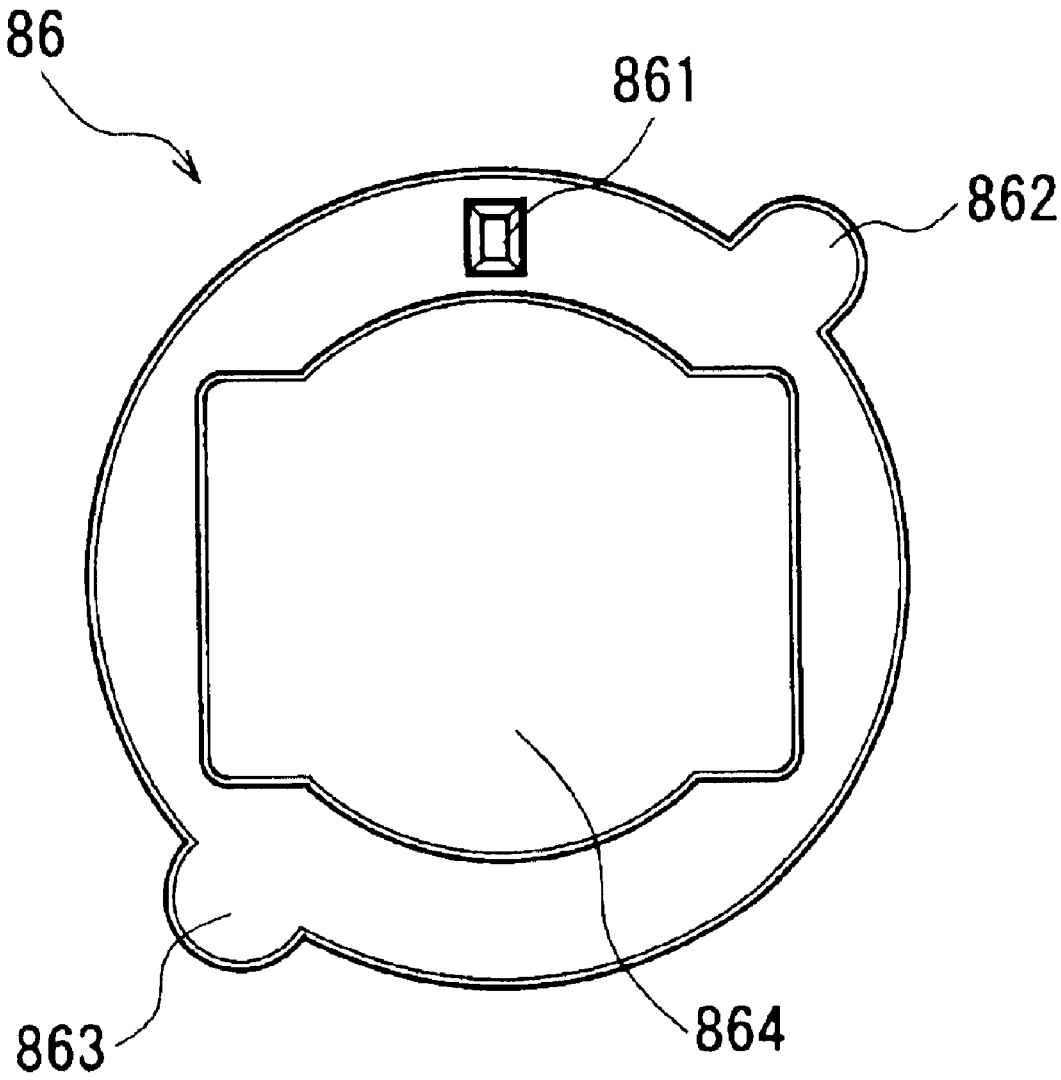
FIG. 24 is a schematic top plan view of the tray adaptor fitted in the tray used with the recording apparatus, in the sixth embodiment of the present invention.

In the first embodiment described above, both of the lateral edges of the hole of the recording medium presence (absence) detection mark 838 were read by the tray position detection sensor 59 attached to the carriage 50. Then, if the edges were detected, it was determined that no CD was present, and if the edges were not detected, it was determined that a CD was present. This arrangement in the first embodiment may be modified so that not only can the presence (absence) of a CD be detected, but also the type of a CD in the tray 83 can be detected, as in this sixth embodiment. FIG. 24 is a schematic plan view of the tray adaptor 86 to be attached to tray 83 usable with the recording apparatus, in the sixth embodiment of the present invention. The tray adaptor 86 is used when using the tray 83 shown in FIG. 13 to record on, for example, a CD with a diameter of 8 cm, or a card type CD, in other words, a recordable medium (CD) other than an ordinary CD, that is, a CD with a diameter of 12 cm. In FIG. 13, which shows the tray 83 in the first embodiment, the tray 83 has a recess in which a 12 cm CD is set, and the bottom surface of which is one step lower than the surrounding area, more specifically, lower by such a step that as a 12 cm CD is placed in the recess, the top surface of the CD becomes level with the surrounding area. However, if an 8 cm CD is set in this recess, a donut-like recess, the bottom surface of which is lower by the above described amount, is created, with the peripheral edge of the 8 cm CD constituting the top edge of the recess, because the 8 cm CD is smaller by 2 cm in radius. Thus, if the tray 83 containing an 8 cm CD is conveyed through the recording apparatus, the pinch roller 37 has to climb to the peripheral edge of the 8 cm CD after descending to the bottom of the recess around the 8 cm CD. Therefore, the tray 83 is less precisely conveyed.

Thus, in this embodiment, when printing on an 8 cm CD, a tray adaptor 86 shown in FIG. 24 is placed in the tray 83 shown in FIG. 13, and the 8 cm CD is placed in the tray adaptor 86, in order to prevent the periphery of the 8 cm CD from creating a step. There are various tray adaptors 86 different in the type of a CD they accommodate. They have a tray adaptor type detection hole 861, the size of which varies depending on the tray type. Further, the tray adaptor 86 is provided with projections 862 and 863 for accurately positioning the tray adaptor 86, in terms of its orientation relative to the tray 83. The tray adaptor 86 is also provided with an opening 864, in which an 8 cm CD or card-shaped CD is placed, and which is centrally located relative to the tray adaptor 86.

Figure 25:
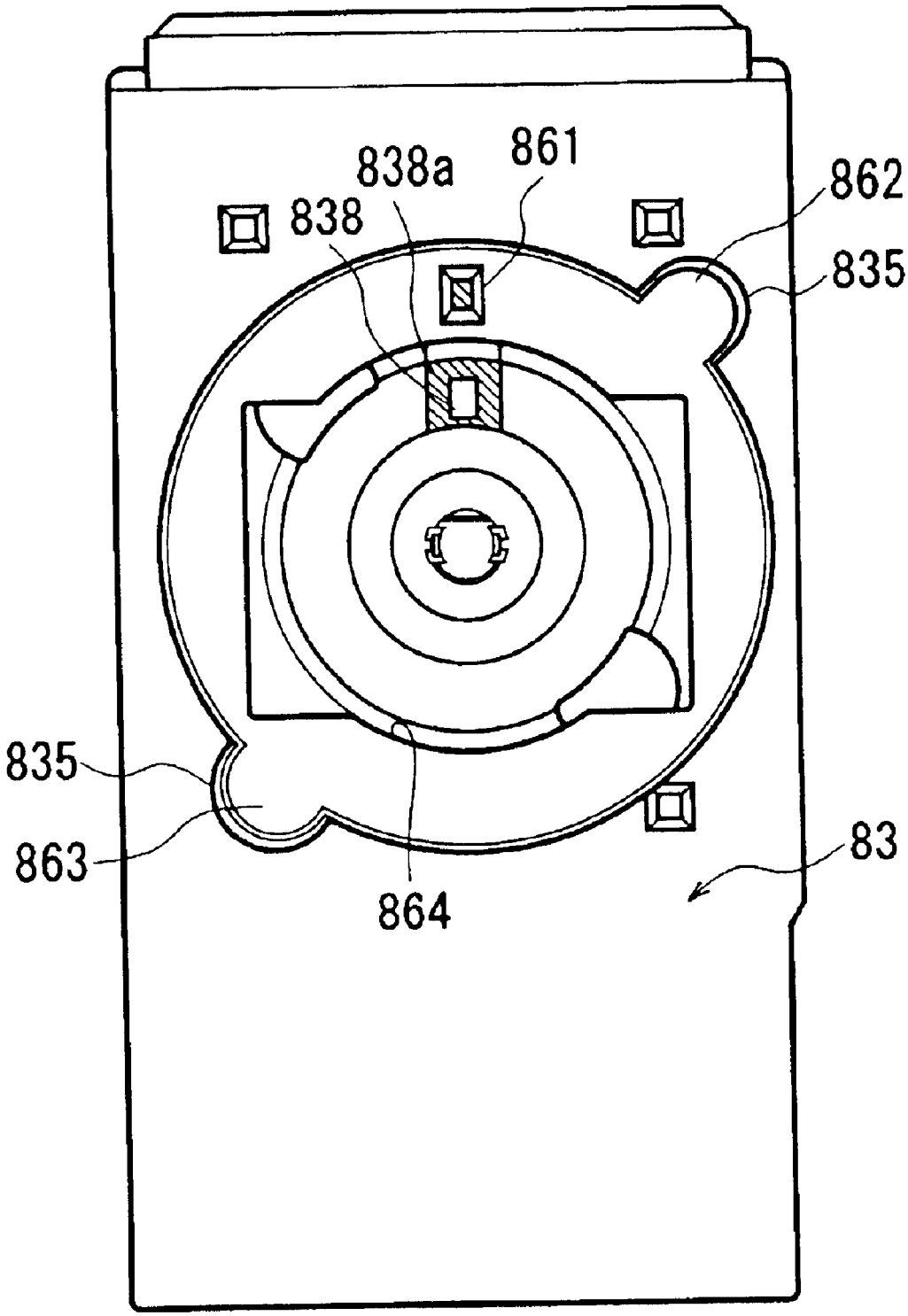
FIG. 25 is a schematic top plan view of the tray adaptor, shown in FIG. 24, fitted in the tray used with the recording apparatus, in the sixth embodiment of the present invention.
Figure 26:
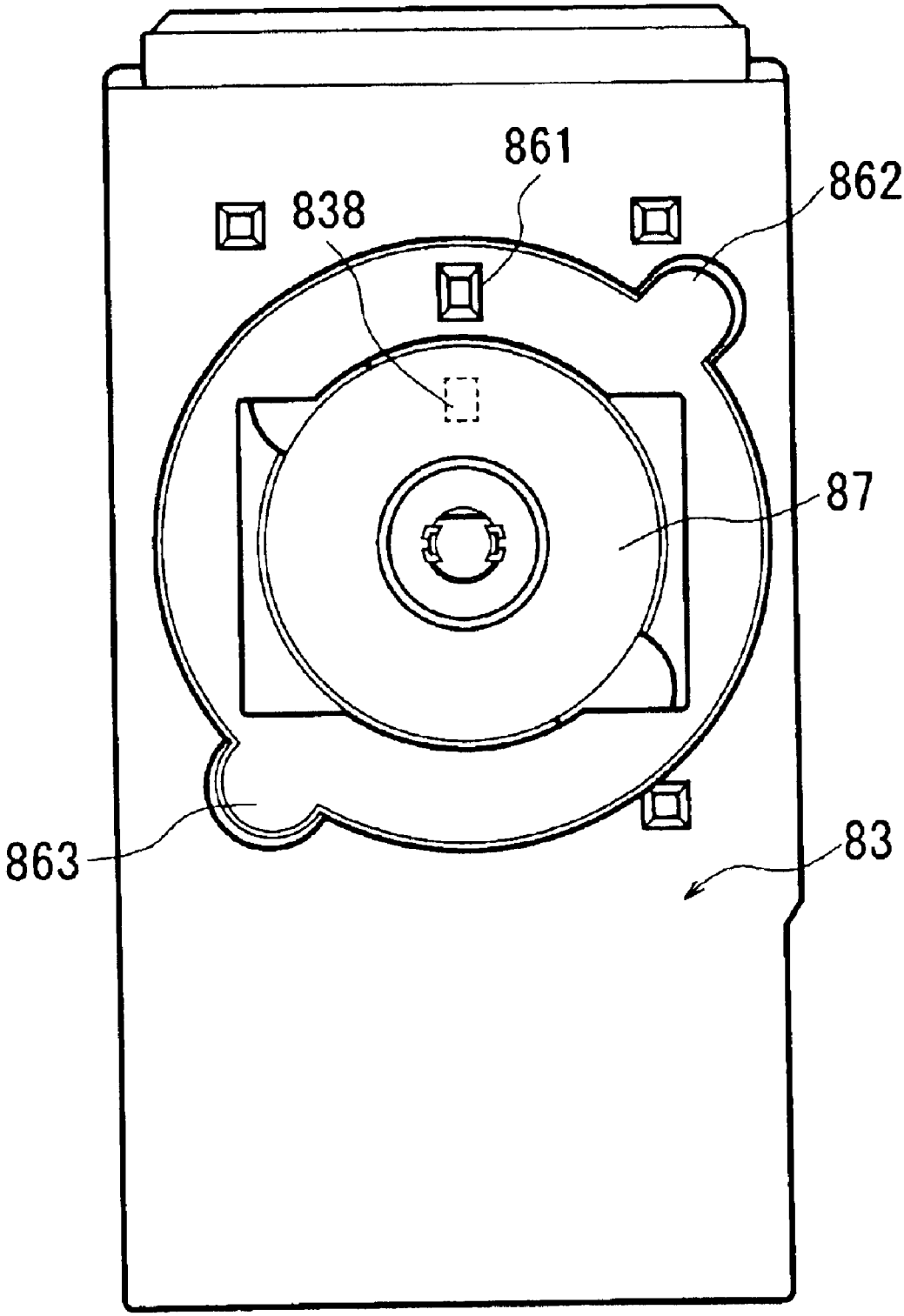
FIG. 26 is a schematic top plan view of the tray adaptor, shown in FIG. 24, fitted in the tray, in the sixth embodiment of the present invention, showing the state of the adaptor when it is holding an 8 cm CD.
Figure 27:
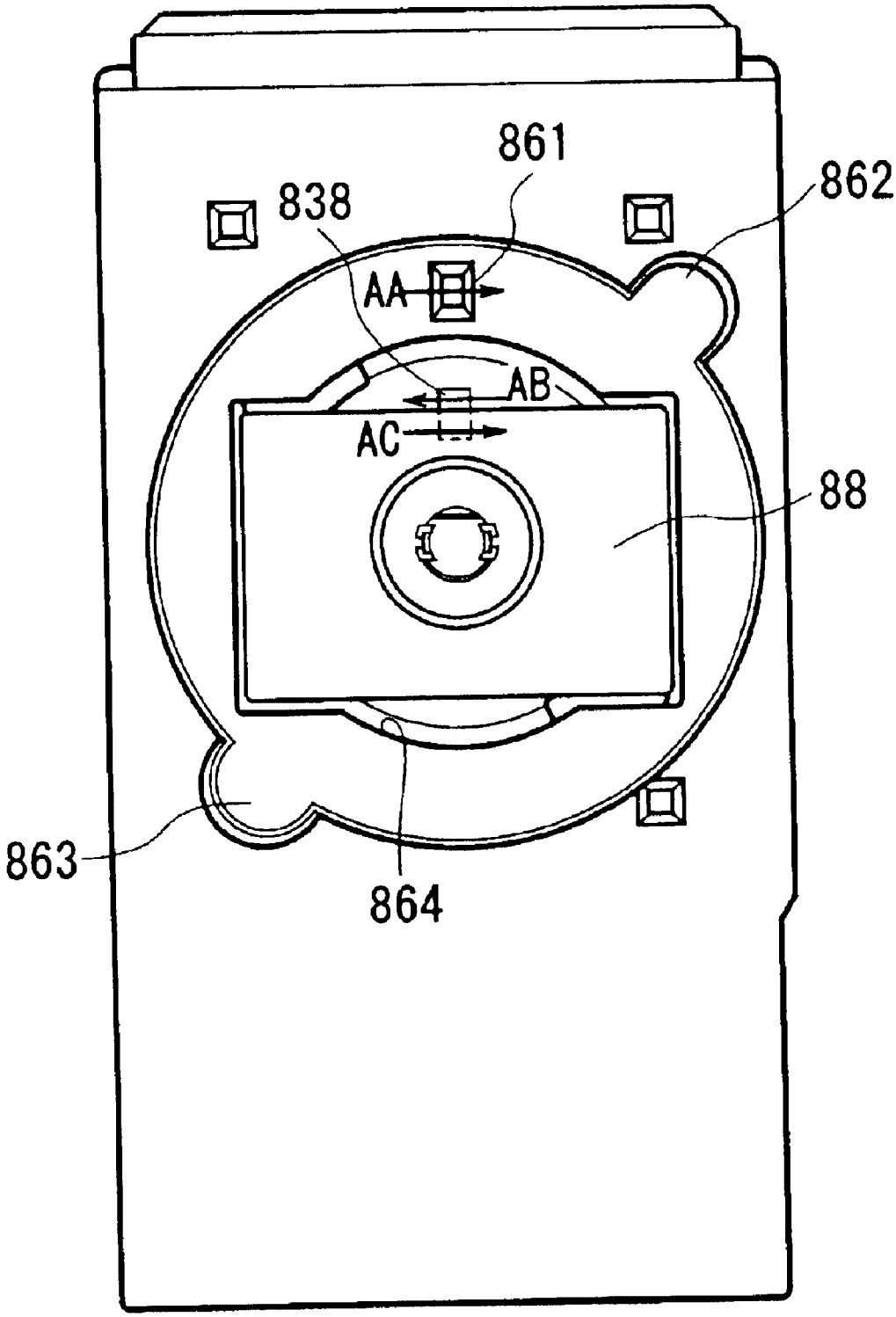
FIG. 27 is a schematic top plan view of the tray adaptor, shown in FIG. 24, fitted in the tray, in the sixth embodiment of the present invention, showing the state of the adaptor when it is holding a card-type CD.

FIG. 25 is a schematic top plan view of the combination of the tray 83 usable with the recording apparatus, in the sixth embodiment of the present invention, and the tray adaptor 86, shown in FIG. 24, in the tray 83. FIG. 26 is a schematic top plan view of the combination of the tray 83 usable with the recording apparatus, in the sixth embodiment of the present invention, the tray adaptor 86, shown in FIG. 24, fitted in the tray 83, and the 8 cm CD in the tray 83 fitted with the adaptor 86. FIG. 27 is a schematic plan view of the combination of the tray 83 usable with the recording apparatus, in the sixth embodiment of the present invention, the tray adaptor 86, shown in FIG. 24, fitted in the tray 83, and the card-type CD 8 cm in the tray 83 fitted with the adaptor 86. Referring to FIG. 25, the projections 862 and 863 for accurately positioning the tray adaptor 86 in terms of its orientation relative to the tray 83 are fitted in the pair of CD removal recesses 835 of the tray 83. As for the tray adaptor type detection hole 861, it is located so that when the tray adaptor 86 is in the tray 83, it aligns with the tray adaptor type detection mark 838*a* (FIG. 13) on the tray 83. Thus, in FIG. 25, the tray adaptor type detection mark 838*a* is visible through the tray adaptor type detection hole 861. Further, the recording medium presence (absence) detection mark 838 of the tray 83 is visible through the opening 864 in which a CD fits.

Referring to FIG. 26, as an 8 cm CD 87 is fitted into the opening 864 of the tray adaptor 86 fitted in the tray 83, the recording medium presence (absence) detection mark 838 is hidden by the 8 cm CD 87. Therefore, even if the above described recording medium presence (absence) detection operation is carried out, the edges of the recording medium presence (absence) detection mark 838 cannot be detected; it is determined that a medium is present. Next referring to FIG. 27, after the fitting of a card-type CD 88 into the opening 864 of the tray adaptor 86 fitted in the tray 83, one half of the recording medium presence (absence) detection mark 838 is hidden by the CD medium (card-type CD 88), and the other half is visible through a part of the opening 864 in which a CD (recording medium) fits. At this time, the operation for detecting the medium type and the operation for detecting the presence or absence of a recording medium will be described. As in the description of the first embodiment, various position detection marks 834 on the tray 83 are detected by the tray position detection sensor 59 on the carriage 50. In this case, before the recording medium presence (absence) detection operation is carried out, the carriage 50 is moved in the direction of an arrow mark AA in FIG. 27 to read the width of the tray adaptor type detection hole 861. Then, the tray adaptor type is identified based on the detected width. For example, if the detected width of the tray adaptor type detection hole 861 of a given tray adaptor is X, the tray adaptor is the one capable of accommodating both an 8 cm CD and a card-type CD.

Next, the carriage 50 is moved in the direction of an arrow mark AB in FIG. 27 to detect the recording medium presence (absence) detection mark 838. If the edges of the recording medium presence (absence) detection mark 838 are detected, it is determined that a card-type CD is in the tray adaptor 86 in the tray 83, or no recording medium is in the tray adaptor 86 in the tray 83. Then, the carriage 50 is moved in the direction of an arrow mark AC in FIG. 27 to detect the recording medium presence (absence) detection mark 838. If the edges of the recording medium presence (absence) detection mark 838 are not detected, it is determined that a card-type CD is in the tray adaptor 86 in the tray 83, whereas if the edges of the recording medium presence (absence) detection mark 838 are detected, it is determined that no recording medium is in the tray adaptor 86 in the tray 83. In other words, in this embodiment, the type of the tray adaptor 86 is first detected, and then, two areas of the recording medium presence (absence) detection mark 838 are read, as described above. Therefore, it is possible to determine the type of the recording medium in the tray adaptor capable of accommodating two types of recording media. Otherwise, the sixth embodiment, the tray 83 and tray adaptor 86 of which are shown in FIGS. 24–27, is the same in structure and function as the preceding embodiments. In other words, the sixth embodiment of the present invention can provide a recording apparatus which is simple in structure, low in cost, and yet, reliably detect the presence (absence) of a recording medium, such as a CD, or the type of a recording medium, when recording on the recording medium with the use of a tray.

In the above described first to sixth embodiments, only one recording medium presence (absence) detection mark 838 is provided. These embodiments, however, are not intended to limit the scope of the present invention. For example, a plurality of recording medium presence (absence) detection marks may be provided as in the seventh embodiment, which will be described next.

(Embodiment 7)

Figure 28:
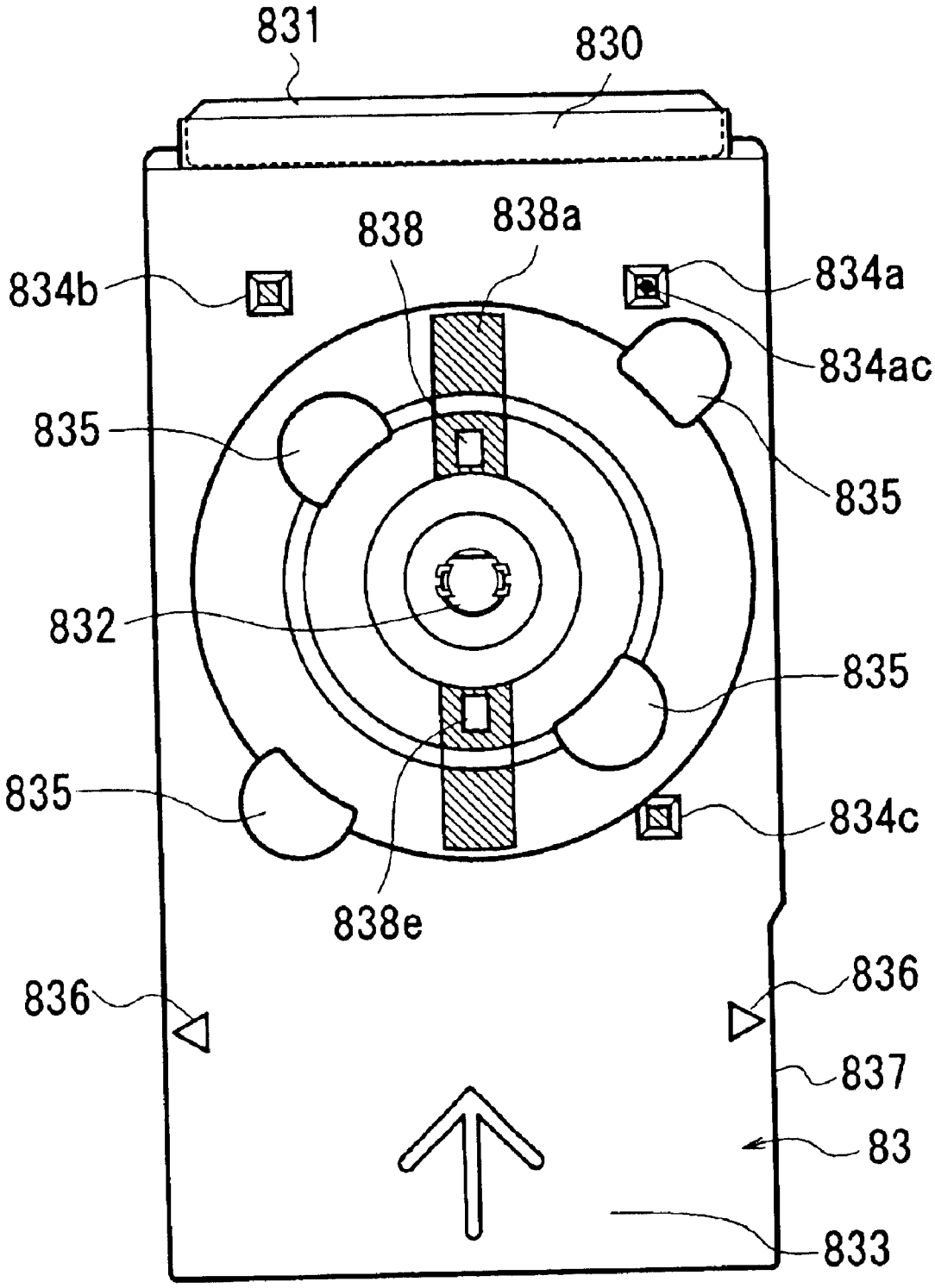
FIG. 28 is a schematic top plan view of the tray for the CD conveying portion usable with the recording apparatus, in the seventh embodiment of the present invention, showing the means for calculating the recording position on a CD in the tray.

FIG. 28 is a schematic top plan view of the tray 83 usable with the CD conveyance portion 8 for the recording apparatus, in the seventh embodiment of the present invention, showing the means for calculating the recording position on a CD. The tray 83 in FIG. 28 is provided with a total of two recording medium presence (absence) detection marks, that is, recording medium presence (absence) detection mark 838 and recording medium presence (absence) detection mark 838*e* which are different in position. This arrangement is made to deal with CD media (recording medium) having a recorded image (printed image) prior to the recording thereon. If a CD, the recordable surface of which has a pre-recorded image virtually similar in shape to the recording medium presence (absence) detection mark 838 of the tray 83, is placed in the tray 83, it is possible, in spite of the presence of the CD in the tray 83, that it will be determined that no CD is in the tray 83. Thus, the plurality of recording medium presence (absence) detection marks 838 are provided to prevent this type of erroneous detection. Although the tray 83 in FIG. 28 is provided with two recording medium presence (absence) detection marks 838 different in position, the number of recording medium presence (absence) detection marks 838 may be three or more. Further, although the two recording medium presence (absence) detection marks 838 of the tray 83 in FIG. 28 are the same in shape, they may be different in shape. Moreover, when providing the tray 83 with three or more recording medium presence (absence) detection marks 838 different in position, all, or some, of them may be different or identical in shape.

The seventh embodiment, the tray 83 of which is shown in FIG. 28, is different from the preceding embodiments in the above described feature. Otherwise, it is practically the same in structure and function as the preceding embodiments. In other words, this embodiment also can provide a recording apparatus which is simple in structure, low in cost, and yet, reliably detect the presence (absence) of a recording medium, such as a CD, or the type of a recording medium, when recording on the recording medium with the use of a tray, as can the preceding embodiments.

(Embodiment 8)

Figure 29:
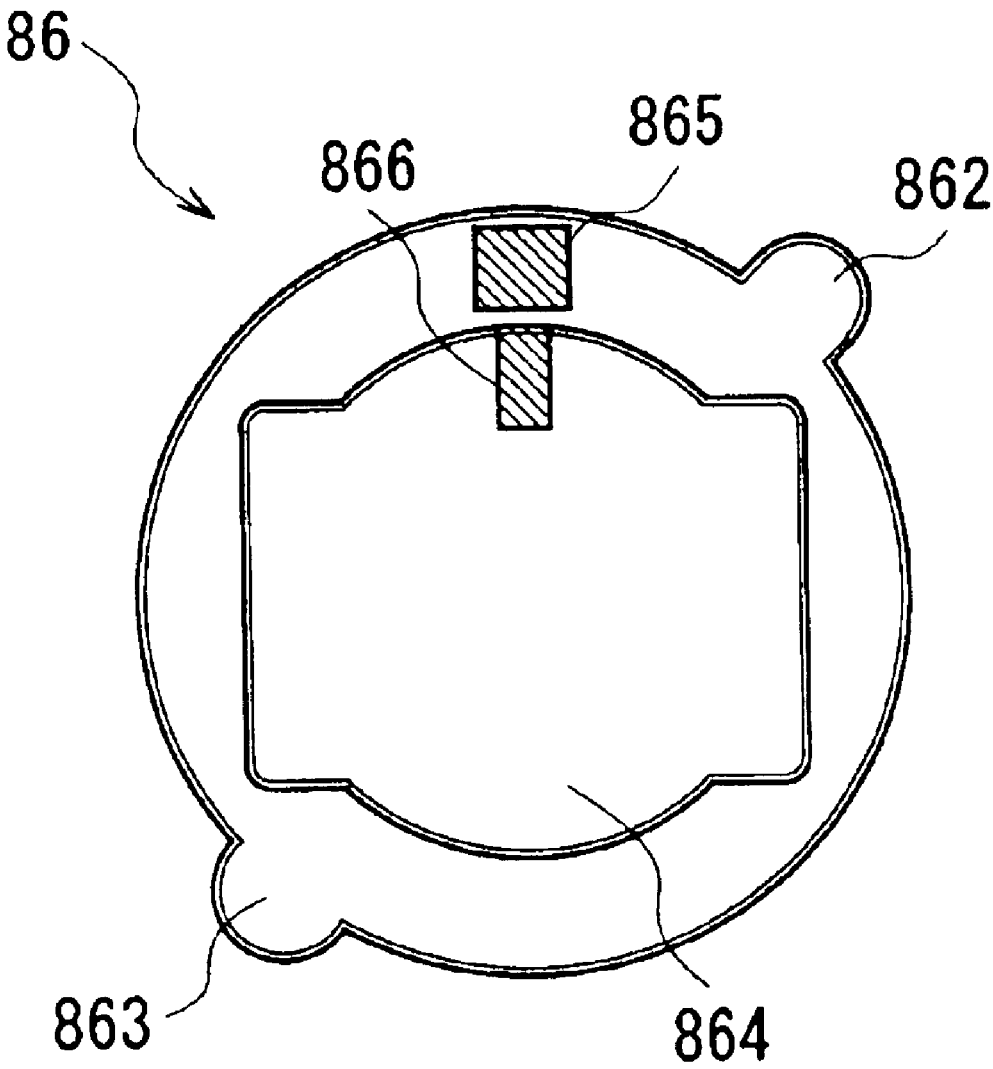
FIG. 29 is a schematic top plan view of the tray adaptor to be fitted in the tray used with the recording apparatus, in the eighth embodiment of the present invention.

In the first, sixth, and seventh embodiments of the present invention, the recording medium presence (absence) detection mark 838 and tray adaptor type detection mark 838*a* were on the tray 83. This arrangement, however, was not intended to limit the scope of the present invention. For example, these marks may be placed on the tray adaptor 86 as in the eighth embodiment, which will be described next. FIG. 29 is a schematic top plan view of the tray adaptor 86 to be fitted in the tray 83 for the recording apparatus, in the eighth embodiment of the present invention. In the eighth embodiment, the tray adaptor 86 of which is shown in FIG. 29, a tray adaptor type detection mark 865 for detecting the tray adaptor type, and a recording medium presence (absence) detection mark 866, are on the tray adaptor 86.

The recording medium presence (absence) detection mark 866 is a piece of highly reflective tape, for example, thin film of PET or the like, and is pasted to the tray adaptor 86 so that it does not interfere with the placement of a recording medium. The number of the locations to which the recording medium presence (absence) detection mark 866 is attached does not need to be limited to one; two or more of these marks may be attached to two or more locations, one for one. The eighth embodiment, the tray 83 of which is shown in FIG. 29, is different from the preceding embodiments in the above described feature. Otherwise, it is practically the same in structure and function as the preceding embodiments. In other words, this embodiment also can provide a recording apparatus which is simple in structure, low in cost, and yet, reliably detect the presence (absence) of a recording medium, such as a CD, or the type of a recording medium, when recording on the recording medium with the use of a tray, as can the preceding embodiments.

(Embodiment 9)

Figure 30:
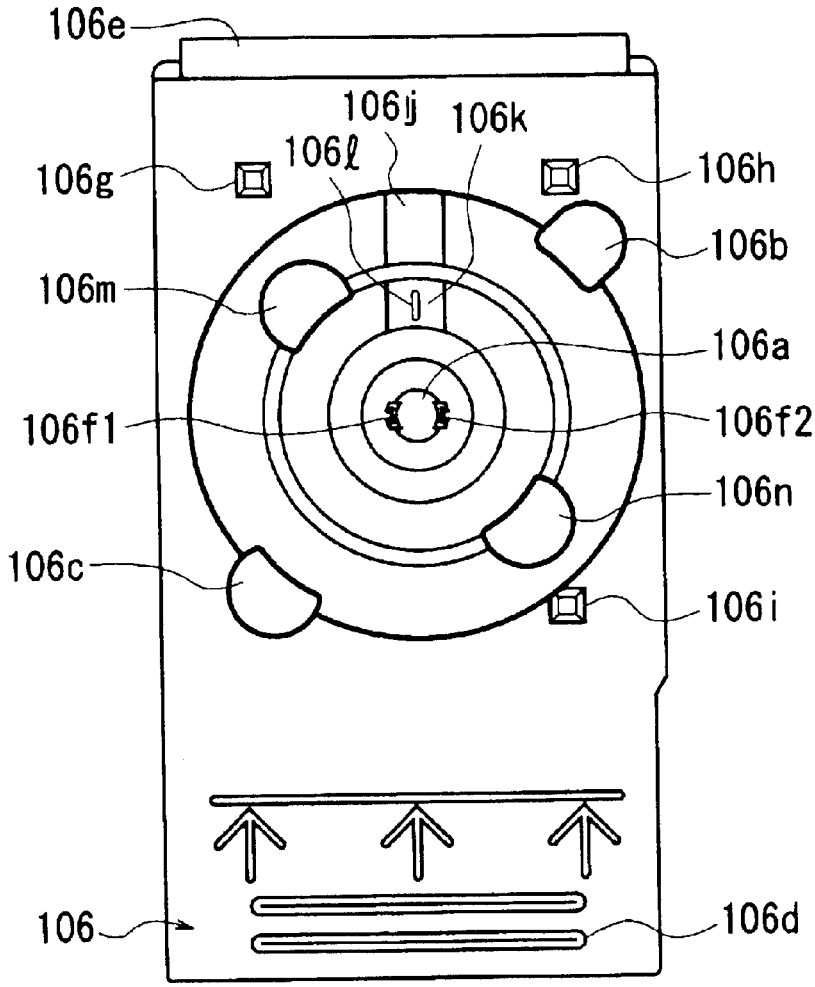
FIG. 30 is a schematic top plan view of the tray, as a recording medium supporting means, used with the recording apparatus, in the ninth embodiment of the present invention.
Figure 31:
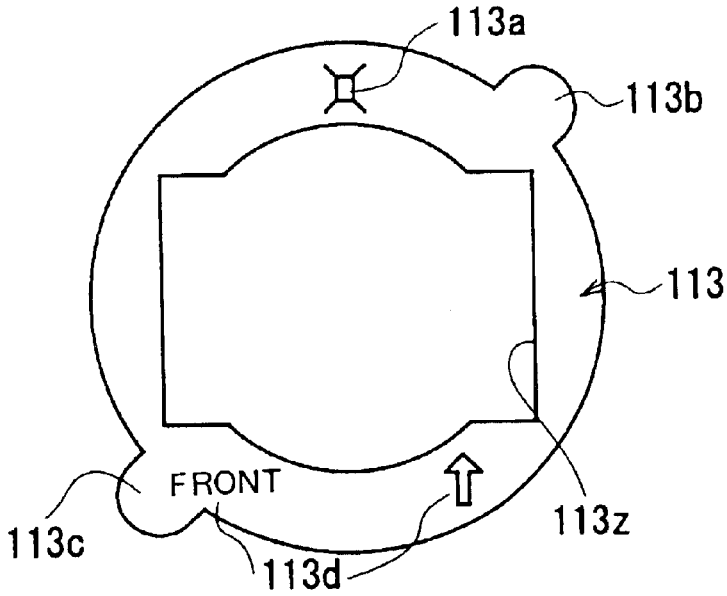
FIG. 31 is a schematic top plan view of the tray adaptor mountable in the tray shown in FIG. 30.
Figure 32:
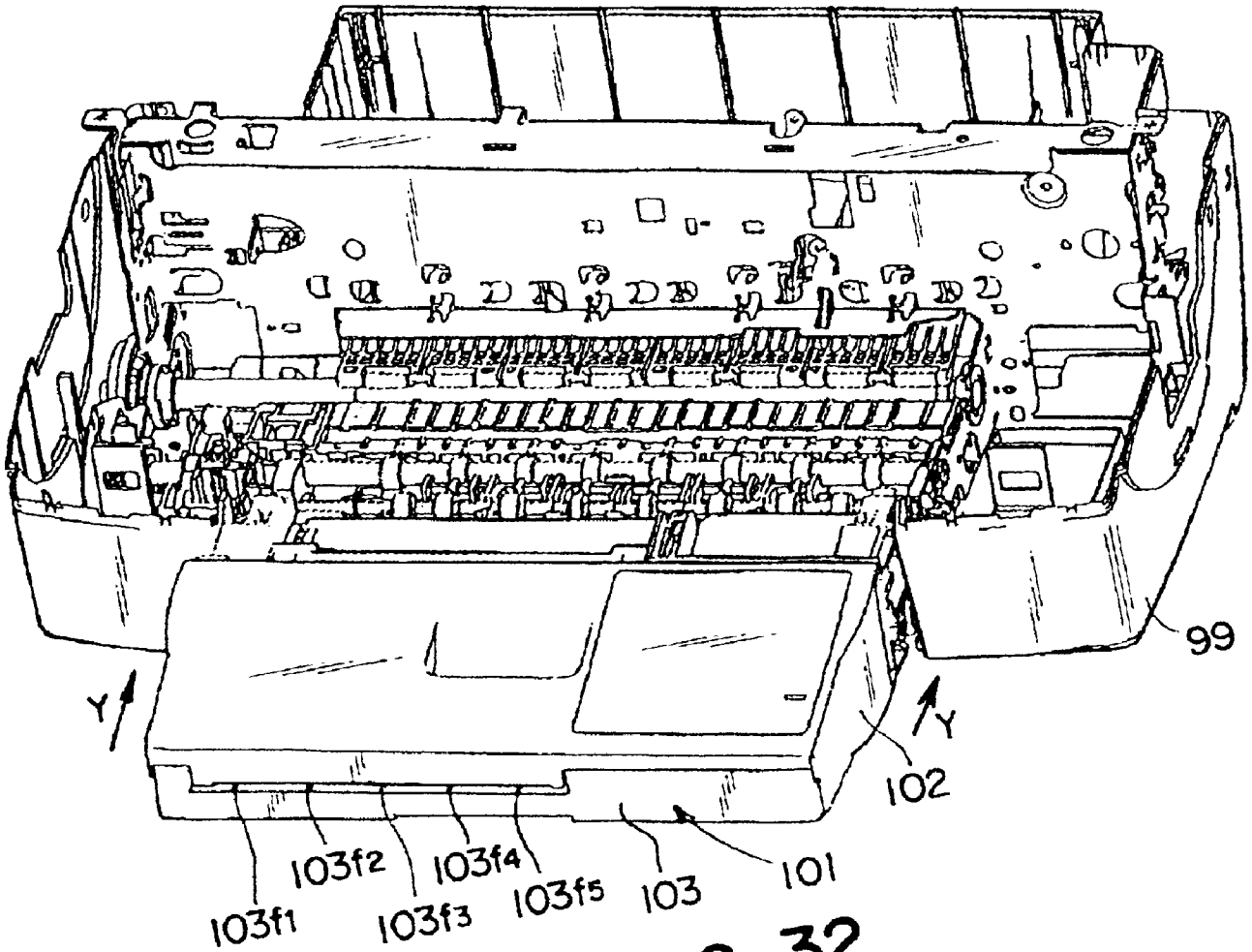
FIG. 32 is a frontal perspective view of the recording apparatus, and the CD conveying portion attached to the main assembly of the recording apparatus, in the ninth embodiment of the present invention.
Figure 33:
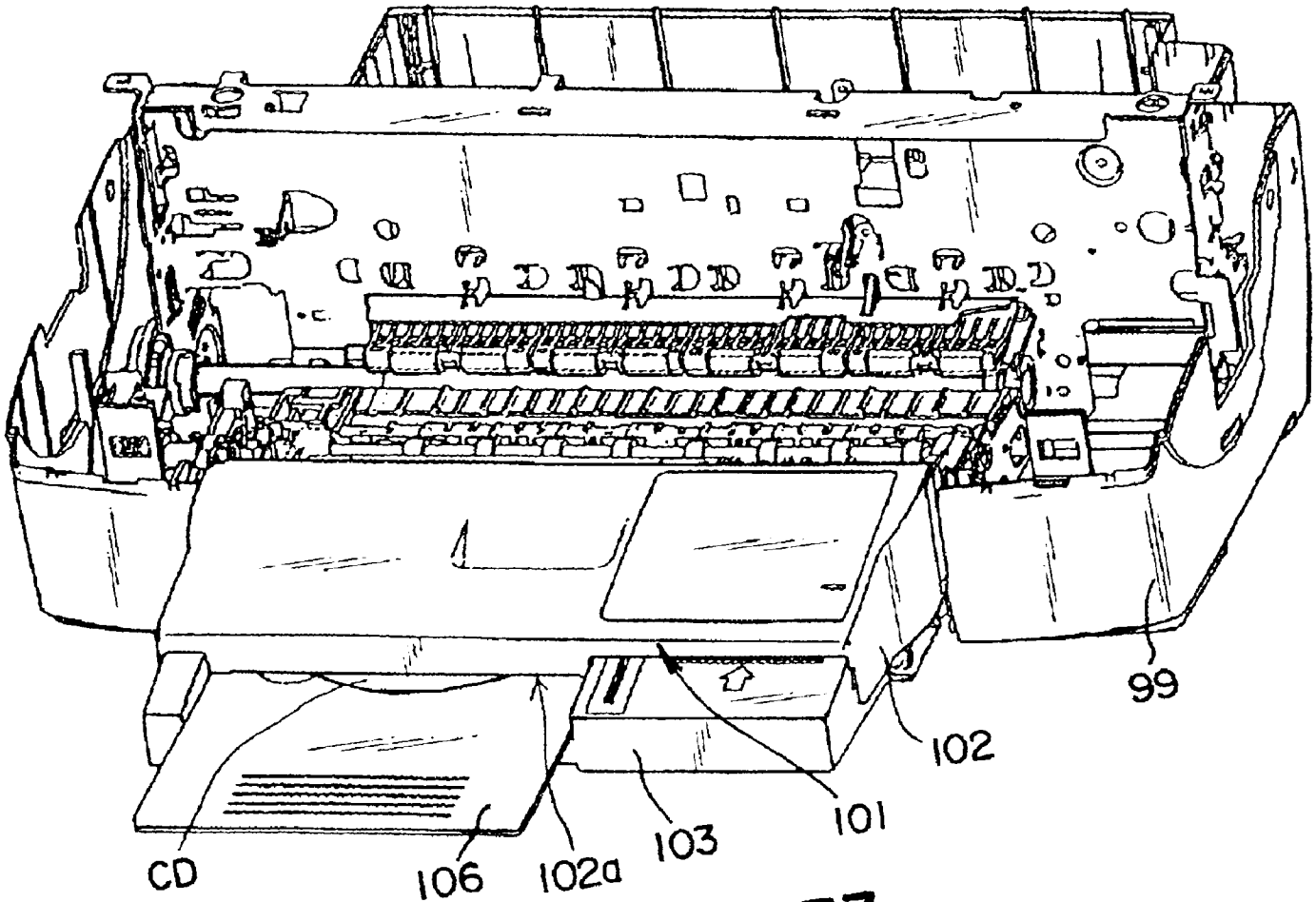
FIG. 33 is a frontal perspective view of the recording apparatus and CD conveying portion, shown in FIG. 32, a tray, and a CD, showing where and how the tray, which is holding the CD, is inserted.
Figure 34:
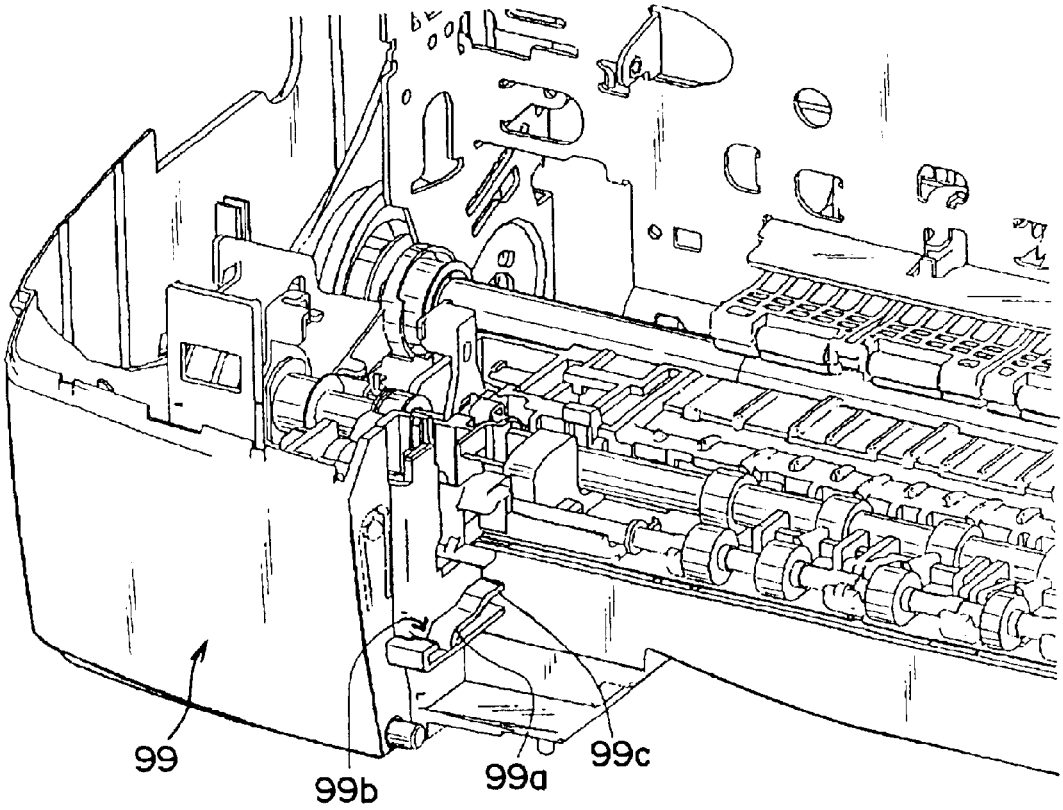
FIG. 34 is a perspective view of the portion of the main assembly of the recording apparatus, shown in FIG. 32, for anchoring the CD conveying portion.

FIG. 30 is a schematic top plan view of the tray as a recording medium supporting means for the recording apparatus, in the ninth embodiment of the present invention, and FIG. 31 is a schematic top plan view of the tray adaptor mountable in the tray shown in FIG. 30. FIG. 32 is a perspective view, as seen from the top front side, of the combination of the main assembly of the recording apparatus, and the CD conveyance portion in the main assembly, in the ninth embodiment of the present invention, and FIG. 33 is a perspective view, as seen from the top front side, of the combination of the main assembly of the recording apparatus, CD conveyance portion in the main assembly, and tray, in the ninth embodiment of the present invention, showing how the tray, which is holding a CD as a recordable medium, is inserted into the CD conveyance portion in the state shown in FIG. 32. FIG. 34 is a perspective view of the connective portion on the main assembly side of the recording apparatus shown in FIG. 32, which interlocks with the CD conveyance portion, and FIG. 35 is a vertical sectional view of the CD conveyance portion shown in FIG. 35.

Figure 36:
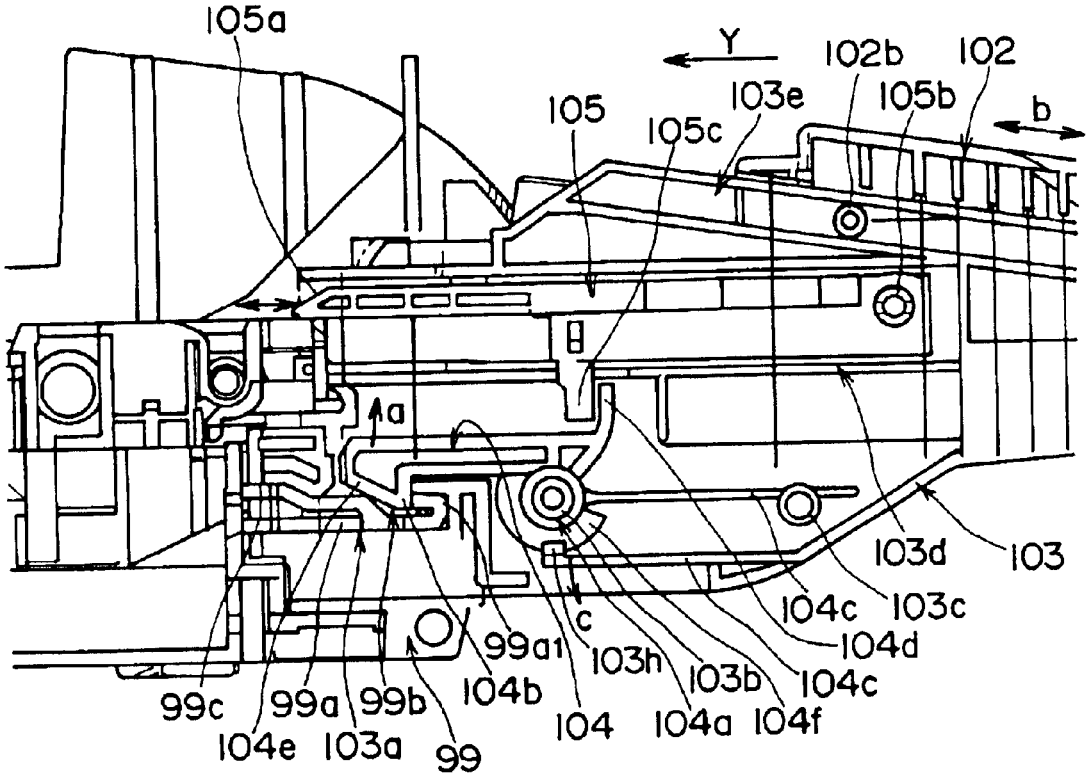
FIG. 36 is a vertical sectional view of the connective portion of the main assembly of the recording apparatus, and the connective portion of the CD conveying portion shown in FIG. 35, in the ninth embodiment of the present invention, showing the structure of the connective mechanism when the two connective portions are in the connected state.
Figure 37:
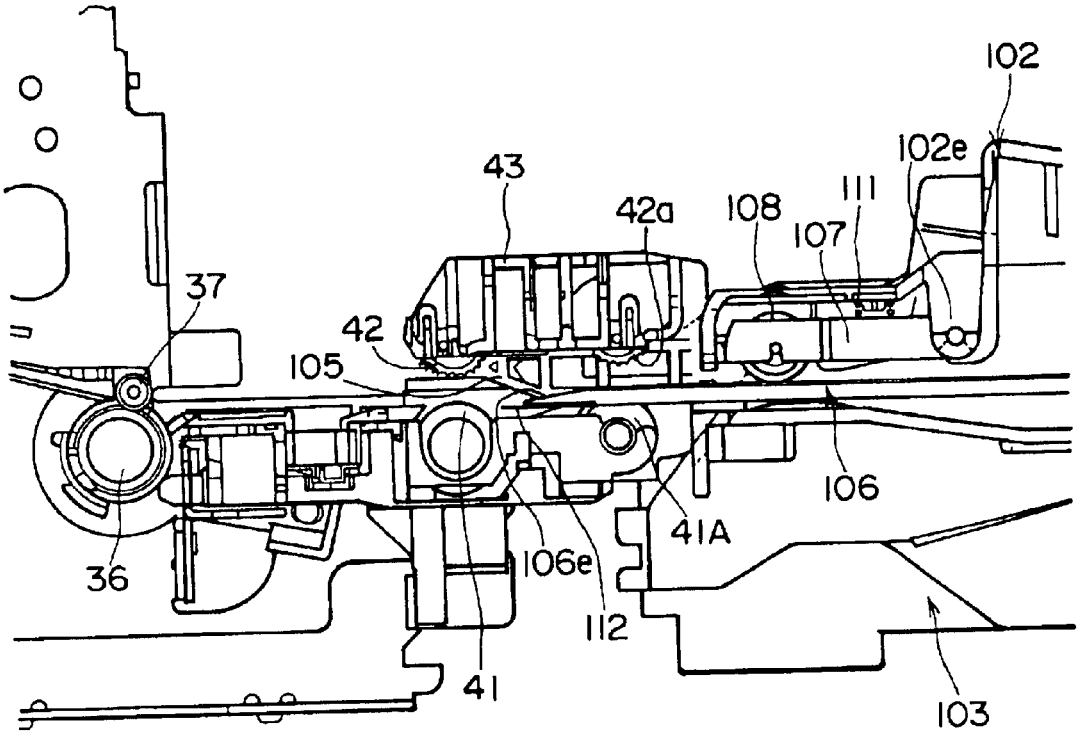
FIG. 37 is a vertical sectional view of the connective portion of the main assembly of the recording apparatus, and the connective portion of the CD conveying portion, showing how the CD conveying portion is connected to the main assembly of the recording apparatus.
Figure 38:
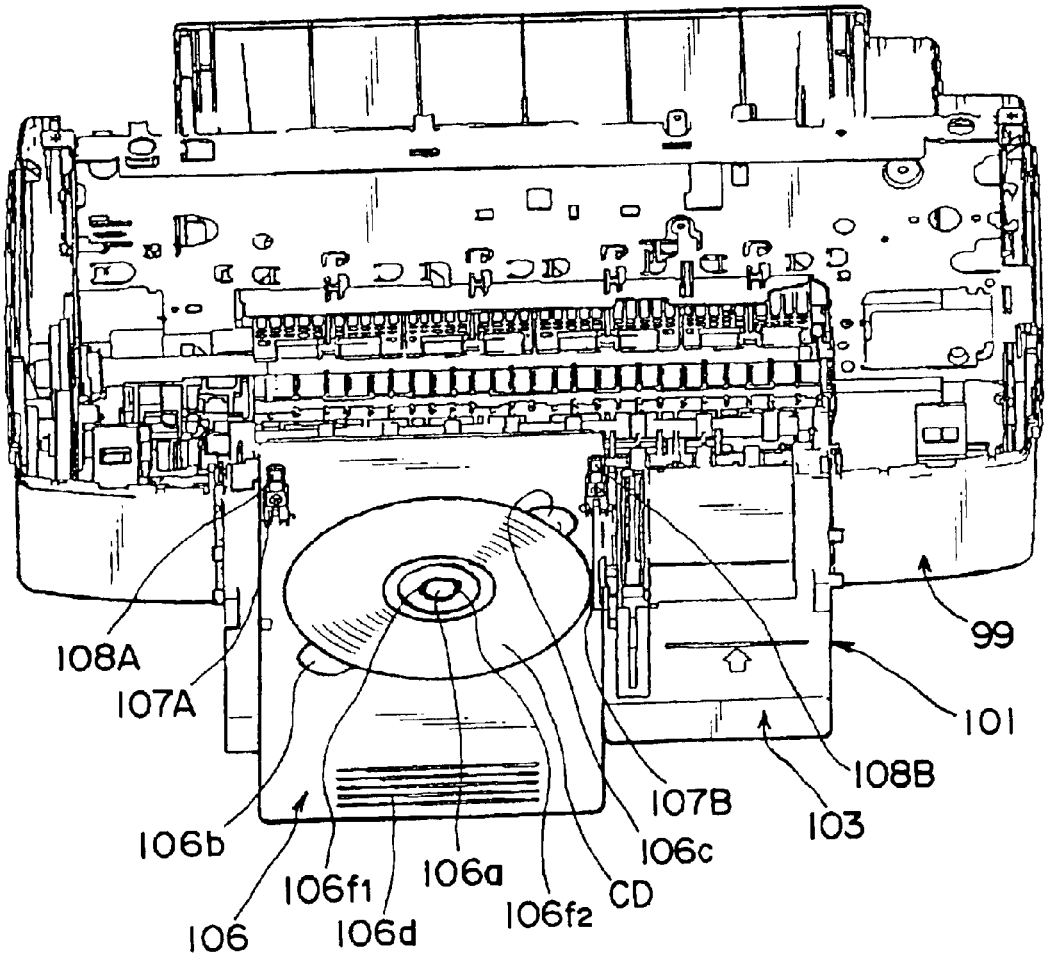
FIG. 38 is a partially broken perspective view of the recording apparatus, CD conveying portion, tray, and a CD, in the first embodiment of the present invention, as seen from diagonally above the front side of the apparatus, showing their states when the tray, which is holding the CD, is in the CD conveying portion attached to the recording apparatus.
Figure 39:
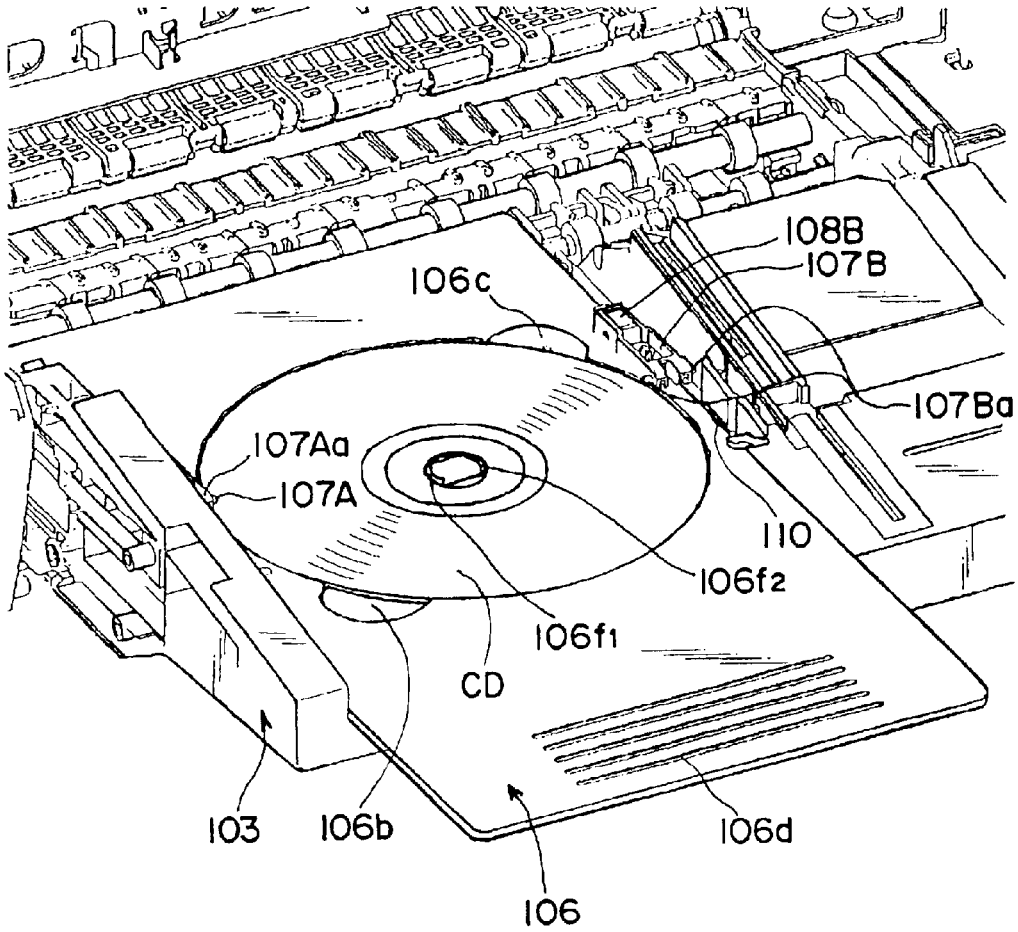
FIG. 39 is an enlarged frontal perspective view of the tray shown in FIG. 38, and its adjacencies.
Figure 40:
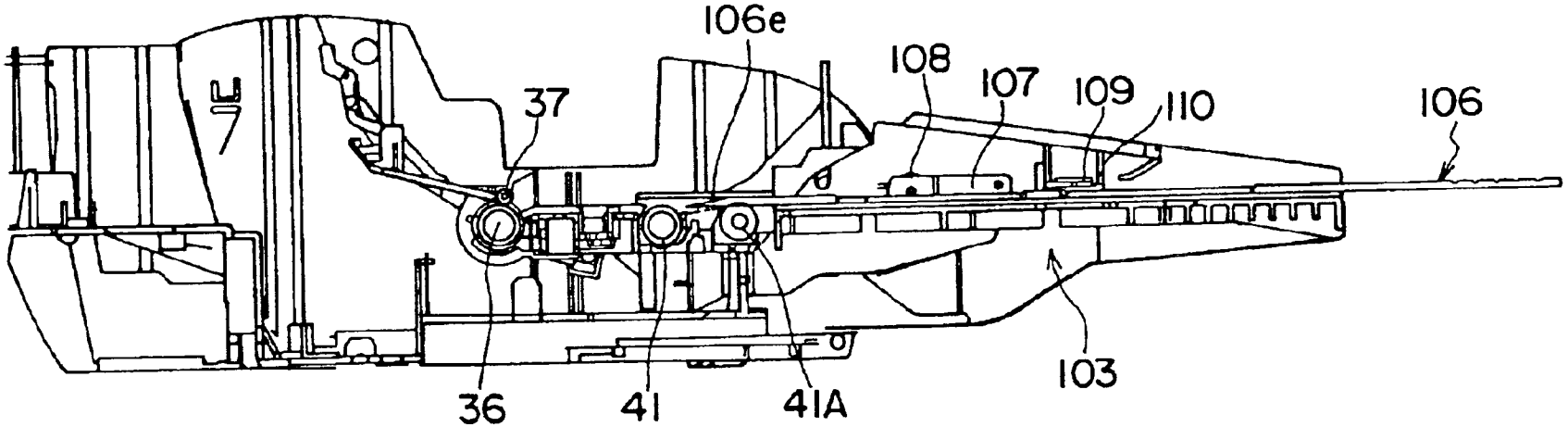
FIG. 40 is a vertical sectional view of the recording apparatus, CD conveying portion, tray, and a CD, shown in FIG. 39, showing their states when the CD is set in the recording apparatus.
Figure 41:
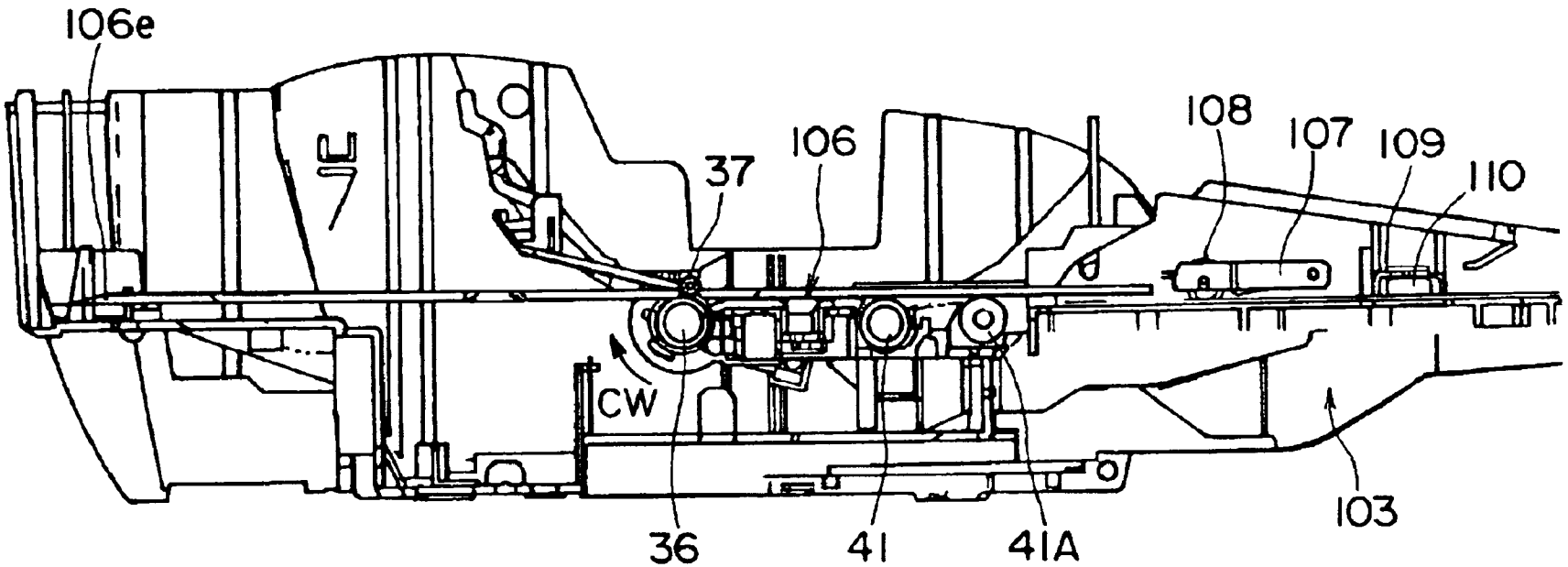
FIG. 41 is a vertical sectional view of the recording apparatus, CD conveying portion, tray, and a CD, shown in FIG. 39, showing their states immediately before recording begins to be made on the CD in the main assembly of the recording apparatus.
Figure 42:
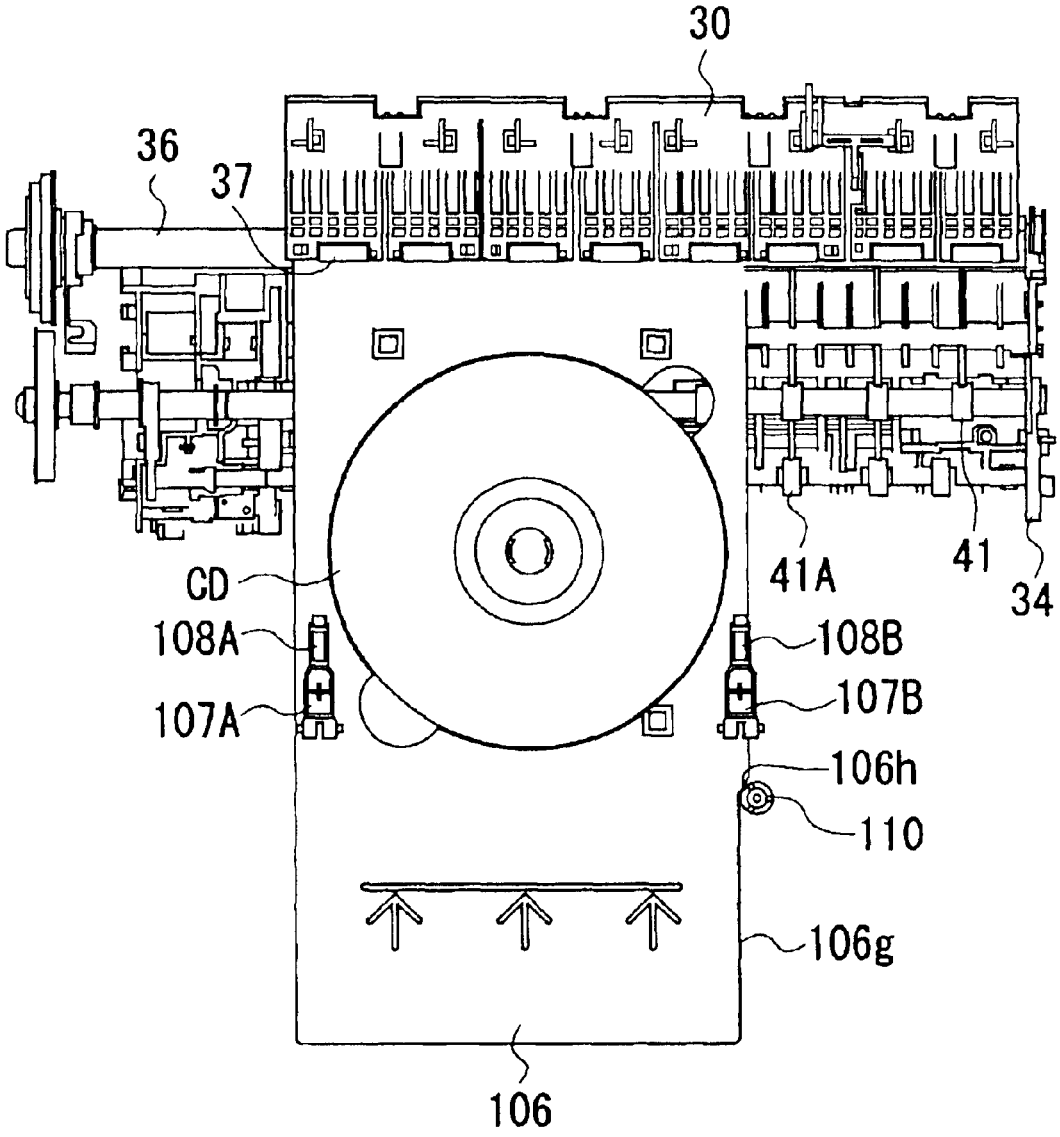
FIG. 42 is a partially broken top plan view of the recording apparatus, shown in FIG. 41, immediately after the completion of the recording on the CD.
Figure 51:
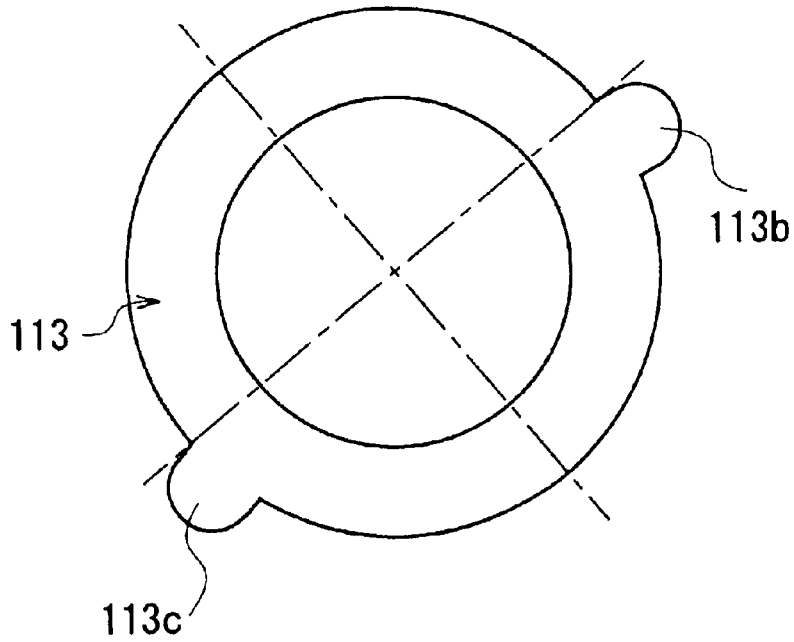
FIG. 51 is a schematic top plan view of one of the variations of the tray adaptor mountable in the tray used with the recording apparatus, in any of the embodiments of the present invention, which will be described later.

FIG. 36 is a vertical sectional view of the connective portion of the main assembly of the recording apparatus, and the connective portion of the CD conveyance portion in the main assembly, showing the structures thereof, and FIG. 37 is a vertical sectional view of the connective portion of the main assembly of the recording apparatus, and the connective portion of the CD conveying portion, showing how the CD conveying portion is connected to the main assembly of the recording apparatus. FIG. 38 is a partially broken perspective view, as seen from the top front side, of the combination of the recording apparatus, the tray in the main assembly of the recording apparatus, and a CD in the tray, in the ninth embodiment of the present invention, and FIG. 39 is an enlarged perspective view, as seen from the top left front side, of the tray in the recording apparatus shown in FIG. 38, and a CD in the tray. FIG. 40 is a vertical sectional view of the CD disposed in the main assembly of the recording apparatus, and its adjacencies, as shown in FIG. 39, and FIG. 41 is a vertical section view of the CD disposed in the main assembly of the recording apparatus, shown in FIG. 39, and ready to be recorded, and its adjacencies. FIG. 42 is a partially broken top plan view of the recording apparatus shown in FIG. 41, showing the tray and a CD in the tray, after the completion of the recording on the CD, and FIG. 51 is a schematic top plan view of one of the variations of the tray adaptor mountable in the tray used with the recording apparatus, in any of the preceding embodiments of the present invention.

Next, the recording apparatus in the ninth embodiment will be described with reference to FIGS. 32–42. The bottom case 99, sliding cover 102, and tray guide 103 of the recording apparatus are symmetrical with respect to their center lines parallel to the recording medium conveyance direction. The tray guide 103 has a pair of hooks 104 and a pair of arms 105, which are attached to the left and right sides of the tray guide 103, respectively. Referring to FIGS. 32 and 33, as an operator pushes the CD conveyance portion 101 so that the CD conveyance portion 101 slides straight into the recording apparatus main assembly in the direction of an arrow mark Y in FIG. 32, the CD conveyance portion 101 is inserted into the bottom case 99. Then, the sliding cover 102 is to be moved toward the recording apparatus main assembly. As the sliding cover 102 is moved, an opening 102*a* appears on the front side, allowing the operator to insert the tray 106, which is holding a CD, into a predetermined position in the CD conveyance portion 101 to start a recording (printing) operation. The tray guide 103, which will be described later in more detail, is provided with a plurality of ribs 103*f*1–103*f*5, which are on the bottom surface of the slot into which the tray 106 is inserted. The provision of the ribs 103*f*1–103*f*5, which support the tray 106, reduces the contact area between the bottom surface of the slot and the tray 106, reducing thereby the friction between the CD conveyance portion 101 and tray 106. In other words, the provision of the ribs 103*f*1–103*f*5 contributes to the improvement in the tray conveyance.

Figure 35:
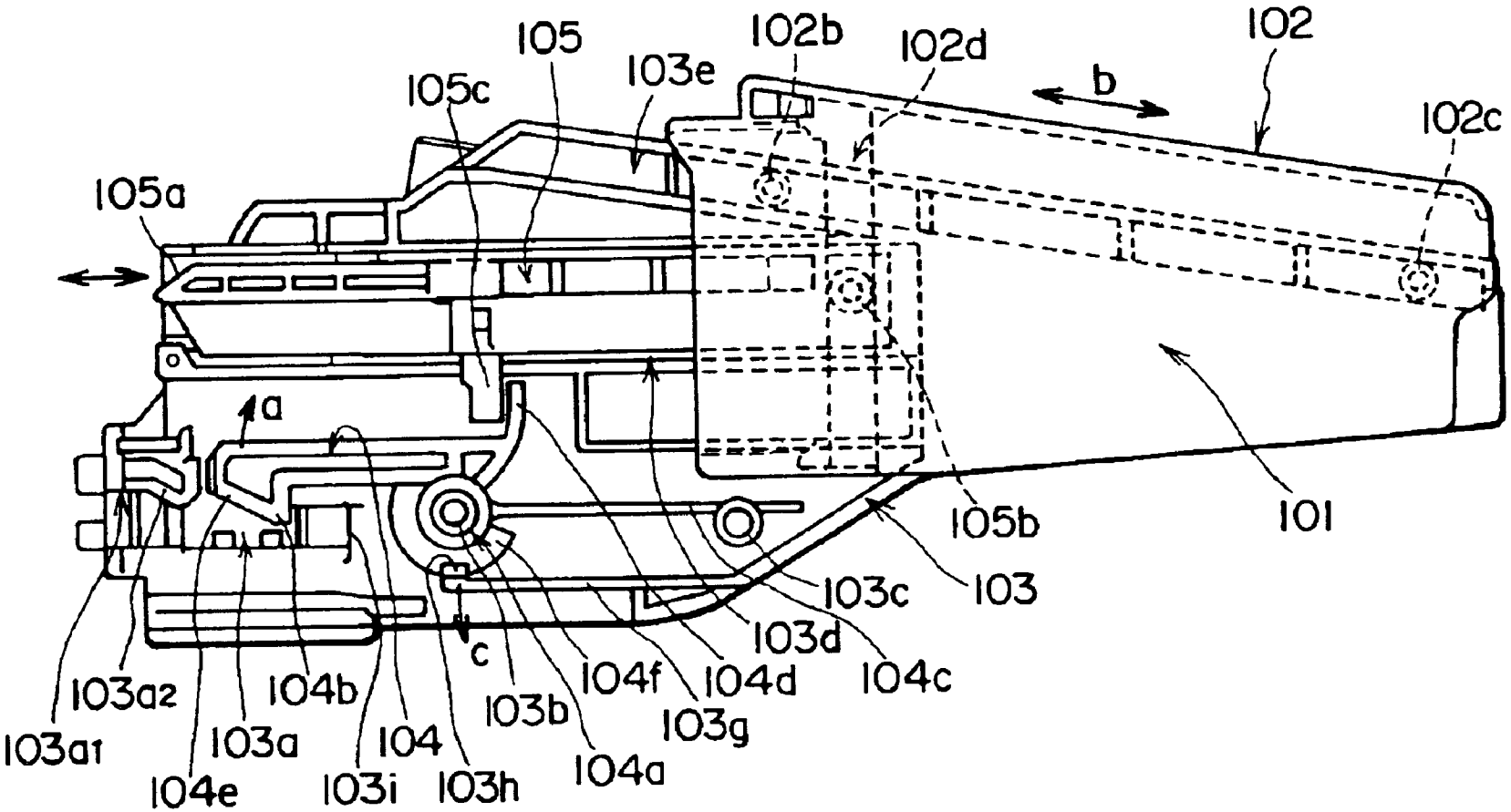
FIG. 35 is a vertical sectional view of the CD conveying portion shown in FIG. 32.

Referring to FIGS. 32–42, the bottom case 99 is provided with a pair of projections 99*a*, which fit in the grooves 103*a* (FIG. 35) of the tray guide 103 as a supporting member for supporting the tray 106. The tray 106 will be described later. Referring to FIGS. 35 and 36, the tray guide 103 has a pair of hooks 104, which are formed of resin. Each hook 104 is supported by a shaft 103*b* so that it can be rotated about the shaft 103*b*. The shaft 104 is fitted in the hole 104*a* of the tray guide 103. The hook 104 is attached to the tray guide 103 by inserting the shaft 103*b* through the hole 104*a* of the hook 104, from the direction perpendicular to the side walls of the tray guide 103. When attaching the hook 104 in the above described manner, the flange portion 104*f* of the hook 104 comes into contact with the elastic rib 103*g* of the tray guide 103. However, the portion 103*h* of the elastic rib 103*g*, which comes into contact with the flange portion 104*f*, is tapered. Therefore, the flange portion 104*f* slides on the surface of the tapered portion of the portion 103*h* of the elastic rib 103*g*, while causing the portion 103*h* to rotate in the direction of an arrow mark c. As a result, the hook 104 is allowed to settle in a predetermined position.

The contact portion 103 returns to the original location due to its resiliency, and remains in contact with the flange portion 104*f*, preventing the hook 104 from slipping out in the axial direction of the shaft 103*b*. The hook 104 is also provided with a thin portion 104*c*, like a plate spring, which is on the side opposite to the claw portion 104*b*, with respect to the hole 104*a*. The hook 104 is attached to the tray guide 103 so that this spring-like portion 104*c* is kept pressed upon the shaft 103*c* of the tray guide 103. Therefore, the claw portion 104*b* is kept pressured toward the projection 99*a* of the bottom case 99, by the resiliency of the spring-like portion 104*c* of the hook 104. Referring to FIGS. 32, 35 and 36, as the CD conveyance portion 101 is slid in the direction of an arrow mark Y (FIG. 32), the claw portion 104*b* of the hook 104 drops into the slot 99*b* (FIGS. 32 and 36) of the projection 99*a*. As a result, the CD conveyance portion 101 is accurately positioned relative to the recording apparatus main assembly. The groove 103*a* of the tray guide 103 is wider across the entrance portion 103*a*1; in other words, it has a slanted surface 103*a*2, allowing the projection 99*a* of the bottom case to smoothly enter the groove 103*a*.

When the hook 4 interlocks with the projection 99*a*, the hook 104 comes into contact with the tip 99*a*1 of the projection 99*a*. However, the hook 104 is provided with the slanted portion 104*e*. Therefore, as the tray guide 103 is pushed, the hook 104 rides over the tip 99*a*1 while being rotated by the tip 99*a*1 in the direction of the arrow mark a, and then, as soon as the claw portion 104*b* of the hook rides over the tip 99*a*1, it is made to snap into the slot 99*b* by the resiliency of the spring-like thin portion 104*c*, and the tip 99*a*1 of the bottom case 99 comes into contact with the surface 103*i* of the tray guide 103. As a result, the tray guide 103 is accurately positioned relative to the recording apparatus main assembly in terms of the direction of the arrow mark Y, in which the CD conveyance portion 101 is conveyed. Incidentally, the hook 104 is desired to be formed of a slippery substance, for example, polyacetal. The tray guide 103 is also provided with a pair of guiding grooves 103*d*, in which the pair of arms 105 slidably fit, one for one. Each arm 105 is provided with a boss 105*b*, which fits in the groove 102*d* located on the back side of the sliding cover 102. The sliding cover 102 is provided with a pair of bosses 102*b* and 102*c*, which slidably fit in the pair of guiding grooves 103*e* of the tray guide 103. When the sliding cover 102 is moved in the direction of an arrow mark b, the positional relationship of the sliding cover 102 relative to the tray guide 103 is controlled by the pair of bosses 102*b* and 102*c*, and the pair of the guiding grooves 103*e*.

To the sliding cover 102, the above described pair of arms 105 are connected so that as the sliding cover 102 is moved in the direction of the arrow mark b, the arms 105 are horizontally moved by the movement of the sliding cover 102. Thus, as the sliding cover 102 is moved toward the recording apparatus main assembly, each arm 105 protrudes inward of the recording apparatus main assembly, as shown in FIG. 37, inserts itself between the platen 34, and the spur wheel base 34 which rotatably supports the spur wheels 42 and 42*a*, and moves the spur base upward. As a result, a space large enough for the tray 106 to be passed through is formed between the platen 34 and spur wheel base 43. At the same time, the arms 105 enters between the platen 34 and spur wheel base 42; the tapered end portion 105*a* of the arm 105 makes it possible for the arm 105 to smoothly enter between the platen 34 and spur wheel base 42. Further, when the tray guide103 is in the recording apparatus main assembly and the sliding cover 102 is open, the arm 105 remains between the platen 34 and spur wheel base 42, being fixed in position, whereas when the arm 105 is in its retracted position in the tray guide 103, it remains loose relative to the tray guide 103. Referring to FIGS. 37–39, the leading end portion 106*e* of the tray 106 is tapered so that it is easier for the leading end portion 106*e* to be nipped by the combination of the conveyance roller 36 and pinch roller 37. The leading end portion 106*e* is provided with a piece of thin plate, more specifically, a piece of Mylar, PET sheet, or the like, which is attached to the tip of the leading end portion 106*e*. Next, referring to FIG. 30, the CD locking portion (center of CD accommodating recess) 106*e* of the tray 106 is provided with a pair of claws 106*f*1 and 106*f*2 which are separately located to keep a CD locked in the correct position. These claws 106*f*1 and 106*f*2 are integral parts of the tray 106, and are resilient. They keep a CD locked in the correct position by being fitted into the center hole of the CD.

Figure 44:
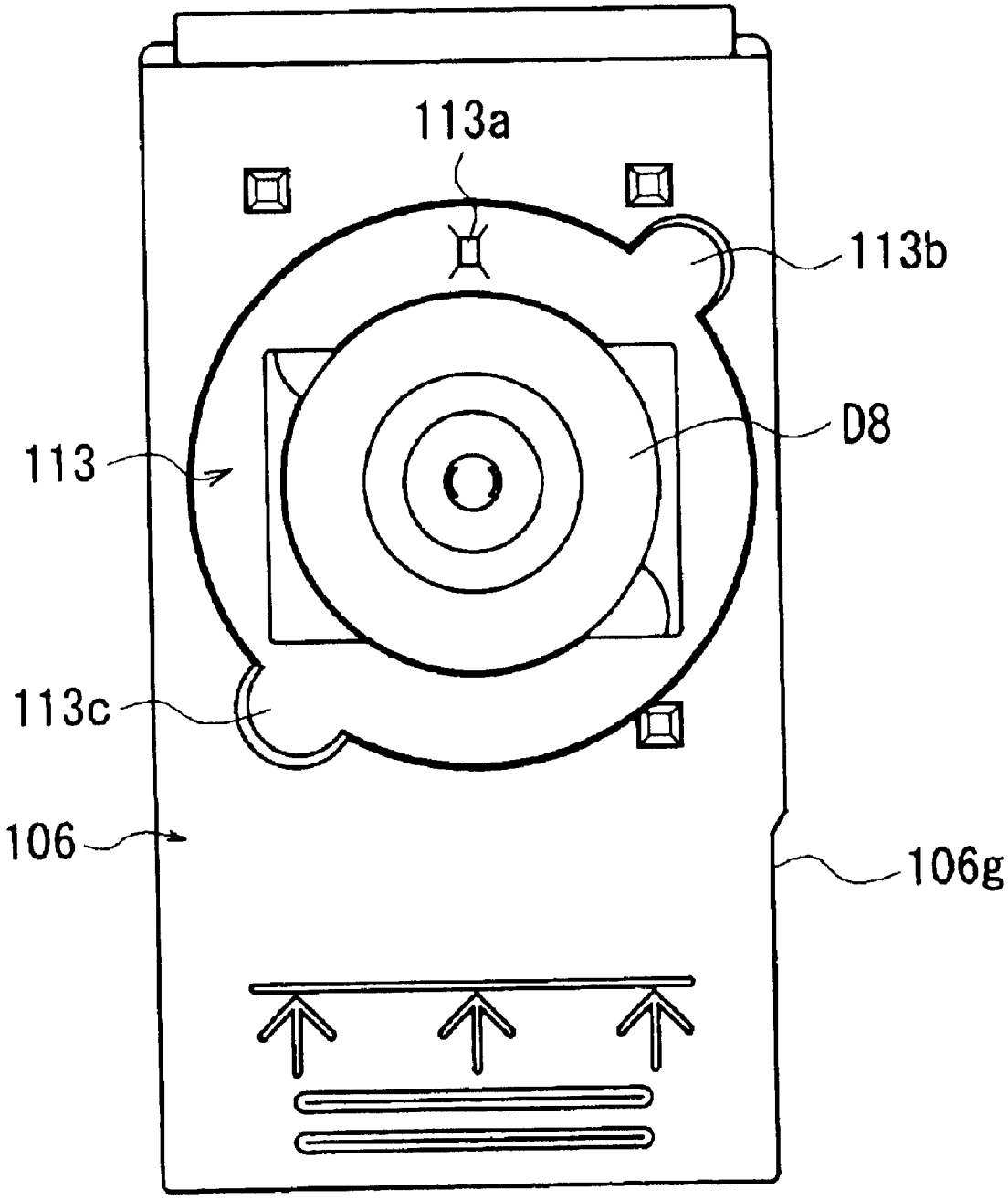
FIG. 44 is a schematic top plan view of the tray shown in FIG. 43, when the tray adaptor and an 8 cm CD are in their proper positions in the tray.
Figure 45:
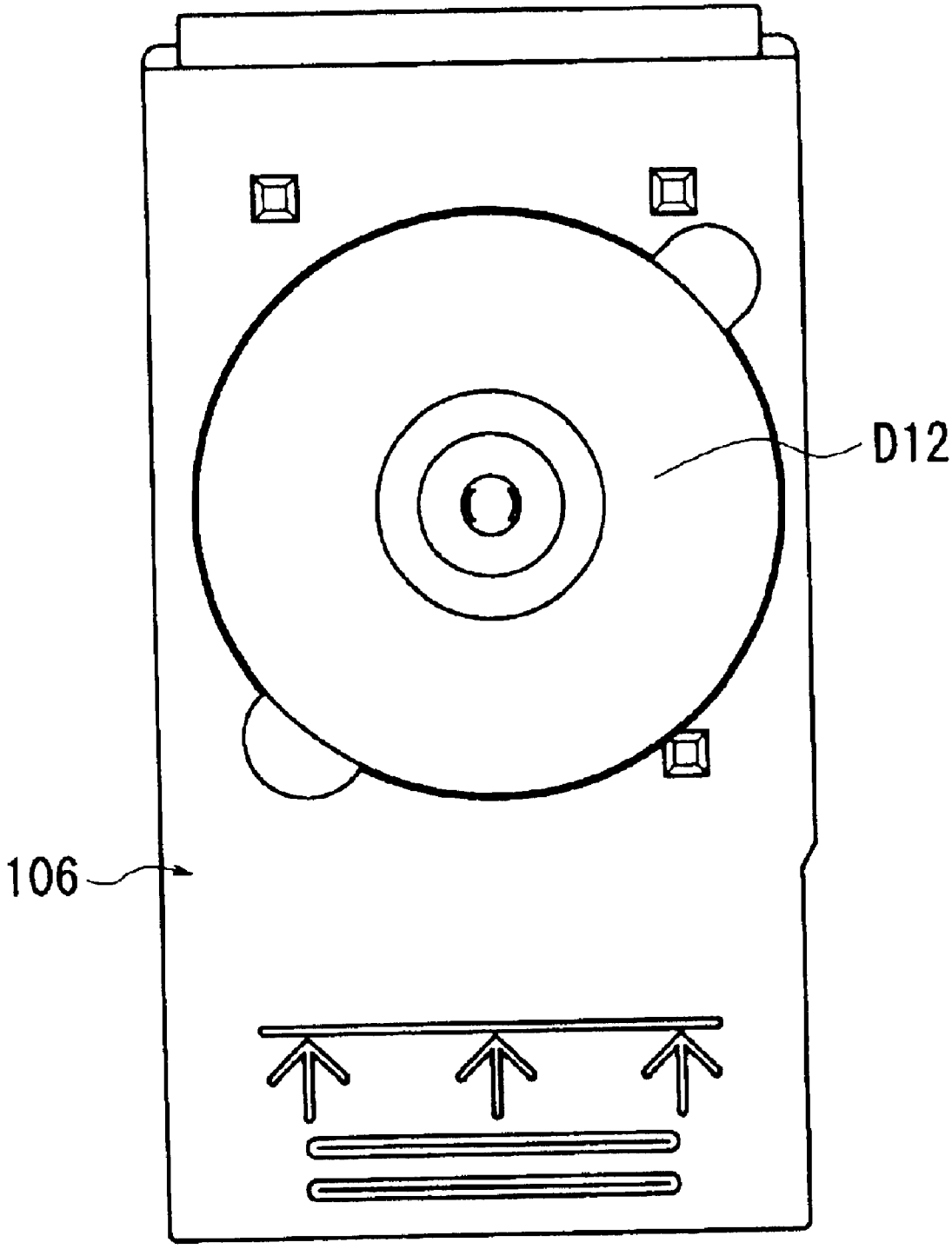
FIG. 45 is a schematic top plan view of the tray shown in FIG. 43, when the tray adaptor and an 8 cm CD are in its proper position in the tray.

Designated by referential signs 106*b*, 106*c*, 106*m*, and 106*n* are holes (CD removal holes) of the tray 106, where fingers are hooked for removing a CD from the tray 106. Designated by a referential sign 106*d* are grooves of the tray 106, where fingers are placed to make it easier to handle the tray 106. Further, the tray 106 is provided with a plurality of position detection marks (reflective marks) 106*g*, 106*h*, 106*i*, 106*j*, and 106*k*, among which the mark 106*k* has a hole 106*l*. These marks enable the tray position detection sensor 71 on the recording head 7 to detect the precise position of the tray 106, that is, the precise position of the CD in tray 106. If an 8 cm CD (D8) shown in FIG. 44, or a card-type CD (DC) shown in FIG. 46, instead of a CD of the normal size, that is, a 12 cm CD (D12) shown in FIG. 45, is mounted in the CD placement recess of the tray 106*a*, a step is created between the top edge of the peripheral surface of the 8 cm CD (D8) or card-type CD (DC), and the bottom surface of the CD placement recess of the tray 106, negatively affecting the efficiency with which the tray 106 is conveyed by the conveyance rollers or the like. Thus, when mounting these CDs of an odd size or shape, a tray adaptor (CD adaptor) 113 shown in FIG. 31 is employed to prevent the problem.

The tray adaptor 113 is provided with an opening 113*z*, the contour of which is virtually identical to the contour of the shape created by overlapping a disc, the diameter of which is the same as, or slightly greater than, that of the 8 cm CD (D8), and a rectangle, which is identical in shape as that of a card-type CD, and the size of which is the same as, or slightly larger than, the card-type CD (DC). Further, the tray adaptor 113 has a plurality of positioning projections (attachment lobes) 113*b* and 113*c*, which are fitted in the holes 106*b* and 106*c* of the tray 106 to accurately position the tray adaptor 113 relative to the tray 106. Moreover, the tray adaptor 113 is provided with a rectangular hole (tray adaptor type detection hole) 113*a*, which extends in the direction parallel to the tray conveyance direction so that after the mounting of the 8 cm CD (D8) in the tray 106 with the use of the tray adaptor 113, the tray adaptor type detection mark (reflective mark) 106*j* of the tray 106 is partially visible.

Further, in order to prevent the problem that the erroneous mounting of the tray adaptor by a user prevents the hole 113*a* from aligning with the mark 106*j* (FIG. 30) of the tray 106 in the direction perpendicular to the tray 106, the tray adaptor 113 is provided with a set of letters or a symbol designated by a referential symbol 113*d*, the presence and direction of which are helpful to align the hole 113*a* with the mark 106*j* in the direction perpendicular to the tray 106. In addition, the projections 113*b* and 113*c* are different in shape, preventing thereby the tray adaptor 113 from being mounted upside down. The holes 106*b* and 106*c* of the tray 106 are shaped so that the projections 113*b* and 113*c* of the tray adaptor 113 perfectly fit in the holes 106*b* and 106*c*, respectively, to position the tray adaptor 113 relative to the tray 106. When the projections 113*b* and 113*c* are the same in shape, they are desired to be nonsymmetrically positioned with respect to the center of the CD placement opening of the tray adaptor 113. After the placement of the card-type CD (DC) in the tray 106 with the use of the tray adaptor 113, the recording medium presence (absence) detection mark 106*l* of the tray 106 is partially visible.

Referring to FIG. 38, designated by referential numerals 107A and 107B are roller holders, by which the rollers 108A and 108B are rotatably supported, respectively, and which are located in the adjacencies of the left and right sides, respectively, of the tray 106 to evenly press down the tray 106. The roller holders 107A and 107B have shafts 107A*a* and 107B*a*, respectively, which are fitted in the bearings 102*e* of the sliding cover 102, one for one, so that the roller holders 107A and 107B can be rotatable about the shafts 107A*a* and 107B*a*, respectively. They are kept pressured downward by the springs 111 shown in FIG. 37. Designated by a referential numeral 110 is a roller, which is rotatably attached to the tray guide 103 and is made to keep the tray 106 pressured by the force generated by an unshown spring.

FIGS. 37 and 40 are side views of the tray 106 and tray guide 103, after the tray 106 which was holding a CD was inserted into the tray guide 103, to a predetermined position, following the guiding surface of the tray guide 103. In the drawings, the leading edge of the tray 106 is in contact with the discharge roller 41A. The tray 106 is in the predetermined position, with its leading end being pressed upon the discharge roller 41A by the rollers 108A and 108B which are under the pressure from the aforementioned springs 111, while being kept pressured side way by the roller 110. As the conveyance roller 36 is rotated in the counterclockwise direction (direction of arrow mark CCW in FIG. 40) of the drawings while the recording apparatus is in the above described condition, the discharge roller 41A is rotated also in the same direction, while conveying the tray 106. After the leading edge 106*e* of the tray 106 is nipped by the conveyance roller 36 and pinch roller 37, the tray 106 is conveyed further into the recording apparatus by the conveyance roller 36, pinch roller 37, and discharge roller 41A.

More specifically, the tray 106 is conveyed a predetermined distance by the conveyance roller 36, which is driven by an unshown LF motor (line feed motor, that is, conveyance motor). FIG. 41 shows the recording medium in the tray 106, ready to be recorded by the recording head 7, and its adjacencies. As recording begins, the conveyance roller 36 and discharge roller 41A are rotated in the clockwise direction in the drawing (direction of arrow mark CW), and the tray 106 is conveyed toward the front side of the recording apparatus by the conveyance roller 36, pinch roller 37, and discharge roller 41A, while an image is recorded on the recording medium by the recording head 7. In this embodiment, during the recording by the recording head 7, the tray 106 remains sandwiched by the conveyance roller 36 and pinch roller 37. Then, after the completion of the recording, the tray 106 is conveyed toward the front side of the recording apparatus (rightward in FIG. 41) by the discharge roller 41A, from when the leading edge 106*e* of the tray 106 loses contact with the conveyance roller 36 and pinch roller 37 until the leading edge 106*e* of the tray 106 loses contact with the discharge roller 41A.

Referring to FIG. 42, designed by a referential numeral 106*g* is the portion of the right edge of the tray 106, which is slightly recessed from the edge of the forward portion, in terms of the tray insertion direction. In the range corresponding to this recessed portion 106*g*, the side roller 110 does not contact the tray 106, and therefore, the tray 106 is not come under the pressure from the side roller 110. FIG. 42 shows the state of the tray 106, CD therein, in the recording apparatus, at the end of the recording on a CD. At the beginning of recording (FIG. 33), the tray 106 is more inward of the recording apparatus main assembly than at the end of the recording (FIG. 42). In other words, from the beginning of recording to the end of recording, that is, while the tray 106 remains sandwiched by the conveyance roller 36 and pinch roller 37, the tray 106 is not subjected to the pressure from the side pressure roller 110. Incidentally, a portion 10*h* of the right edge of the tray 106, on the outward side of which the edge is recessed (recessed edges 106*g*) is slanted to gradually reduce the pressure applied by the side pressure roller 110 as the tray 106 is inserted. After the completion of the recording on a CD, the tray 106 is removed from the tray guide 103, and the sliding cover 102 is moved toward the front side of the recording apparatus. After the moving of the sliding cover 102, the recording apparatus appears as shown in FIG. 32. Then, the sliding cover 106 is to be moved further toward the front side. As the sliding cover 102 is moved further toward the front side, the projection 105*c* of the arm 105 shown in FIG. 36 comes into contact with the projection 104*d* of the hook 104, and rotates the hook 104 in the direction of an arrow mark a, causing the claw portion 104*b* to come out of the slot 99*b*. As a result, the tray guide 103 is freed from the bottom case 99, and the CD conveyance portion (CD unit) 101 comes out of the recording apparatus main assembly.

In this embodiment (ninth embodiment), the roller holders 107A and 107B, the shafts of which rotatably support the rollers 108A and 108B, on the left and right sides, respectively, are attached to the sliding cover 102. However, they may be attached to the tray guide 103. Also in this embodiment (ninth embodiment), the member for applying lateral pressure to the tray 106 is the roller 110, that is, a rotational member. However, a plate spring may be substituted for the roller 110. When recording is made on an ordinary recording medium, for example, a sheet of paper, using the recording apparatus in this embodiment, the following actions occur in the recording apparatus. That is, a sheet P sent from an unshown sheet feeding apparatus is conveyed to a predetermined position, and an image is formed on the sheet P by the recording head 7 while the recording head 7 is shuttled along a shaft 511 in the direction of the arrow mark A in the drawing, by an unshown motor, through a belt 552. Then, the sheet P is conveyed a predetermined distance by the conveyance roller 36 and pinch roller 37, and recording is made in the direction of the arrow mark A by the recording head 7; in other words, each time the sheet P is conveyed by the predetermined distance, recording is made on the sheet P in the direction of the arrow mark A. After the leading edge of the sheet P reaches the discharge roller 41A, the above described recording action is repeated while the sheet P is held sandwiched not only by the conveyance roller 36 and pinch roller 37 but also by the pair of discharge rollers 41. Eventually, recording is made across the entirety of the sheet P. The recording head 7 is provided with the tray position detection sensor (on-head sensor) 71, which is capable of detecting, at a high degree of accuracy, the reflection type mark (position detection marks 106*g*, 106*h*, 106*i* . . . ) on the tray 106, based on the received amount of the reflected light.

Figure 43:
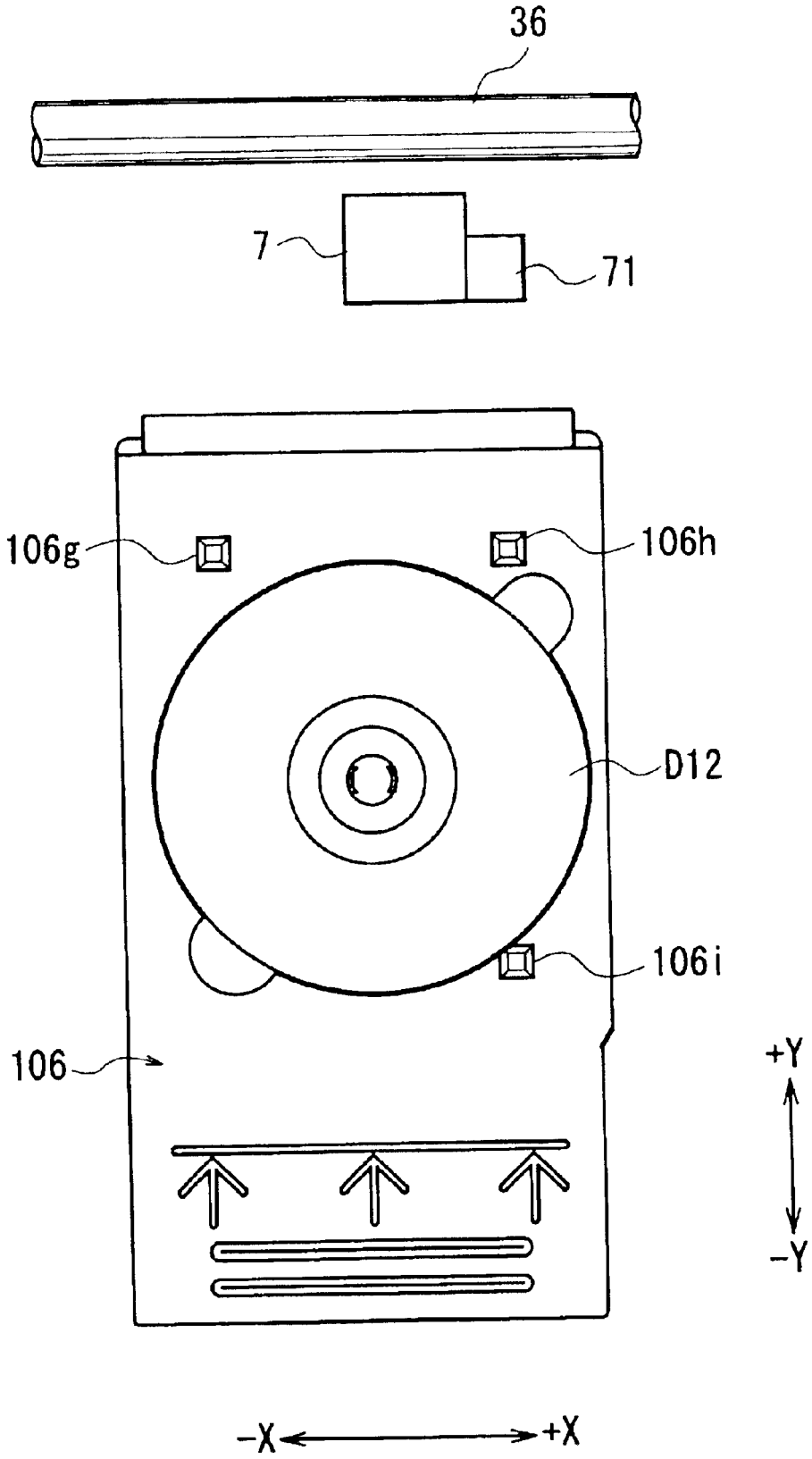
FIG. 43 is a schematic top plan view of the tray, recording head, and tray position detection sensor, in the recording apparatus, in the ninth embodiment of the present invention, showing the directions in which the tray is conveyed, the directions in which the recording head and tray position detection sensor are moved, and their positional relationship.
Figure 46:
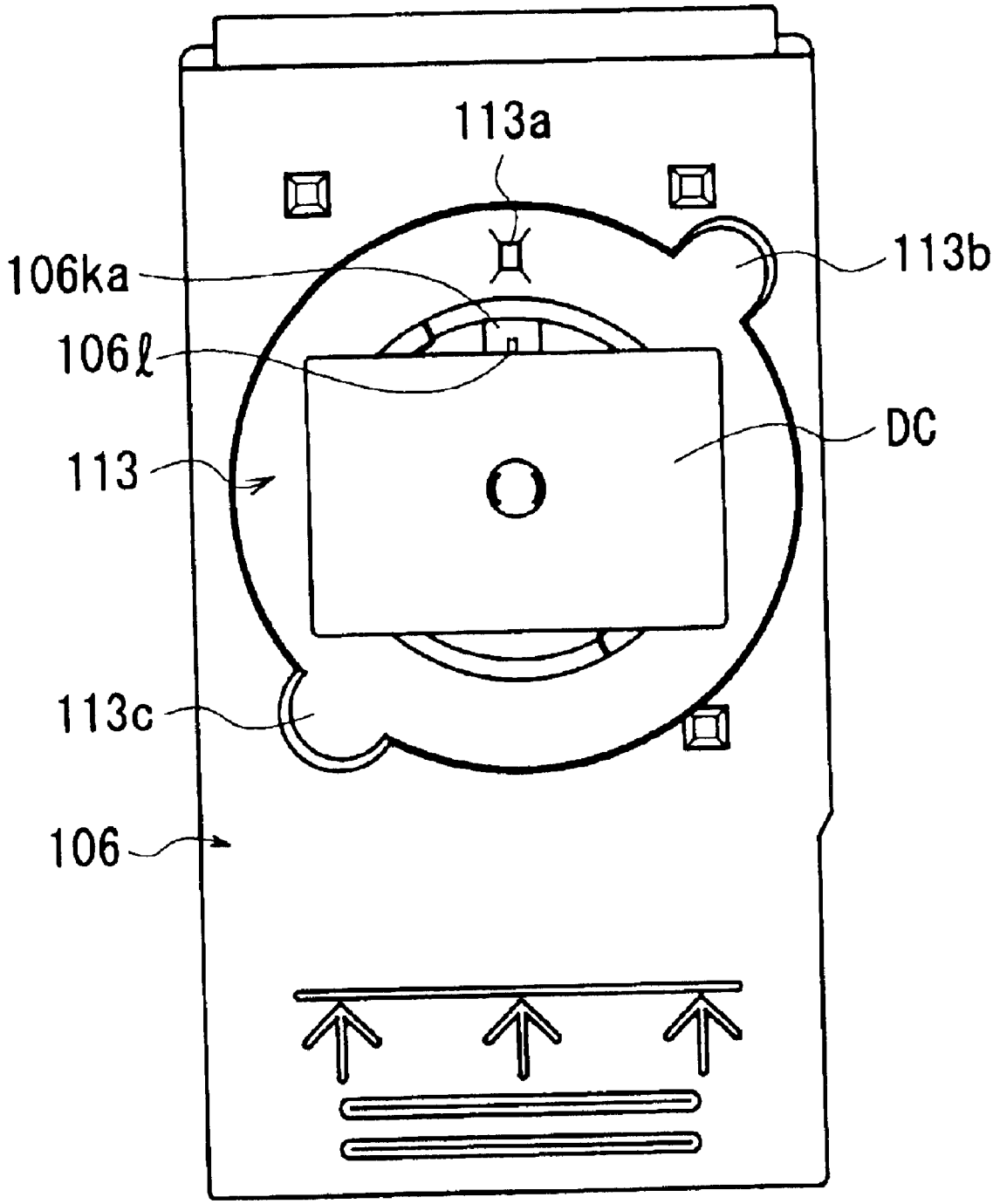
FIG. 46 is a schematic top plan view of the tray shown in FIG. 43, when the tray adaptor and a card-type cm CD are in their proper positions in the tray.
Figure 47:
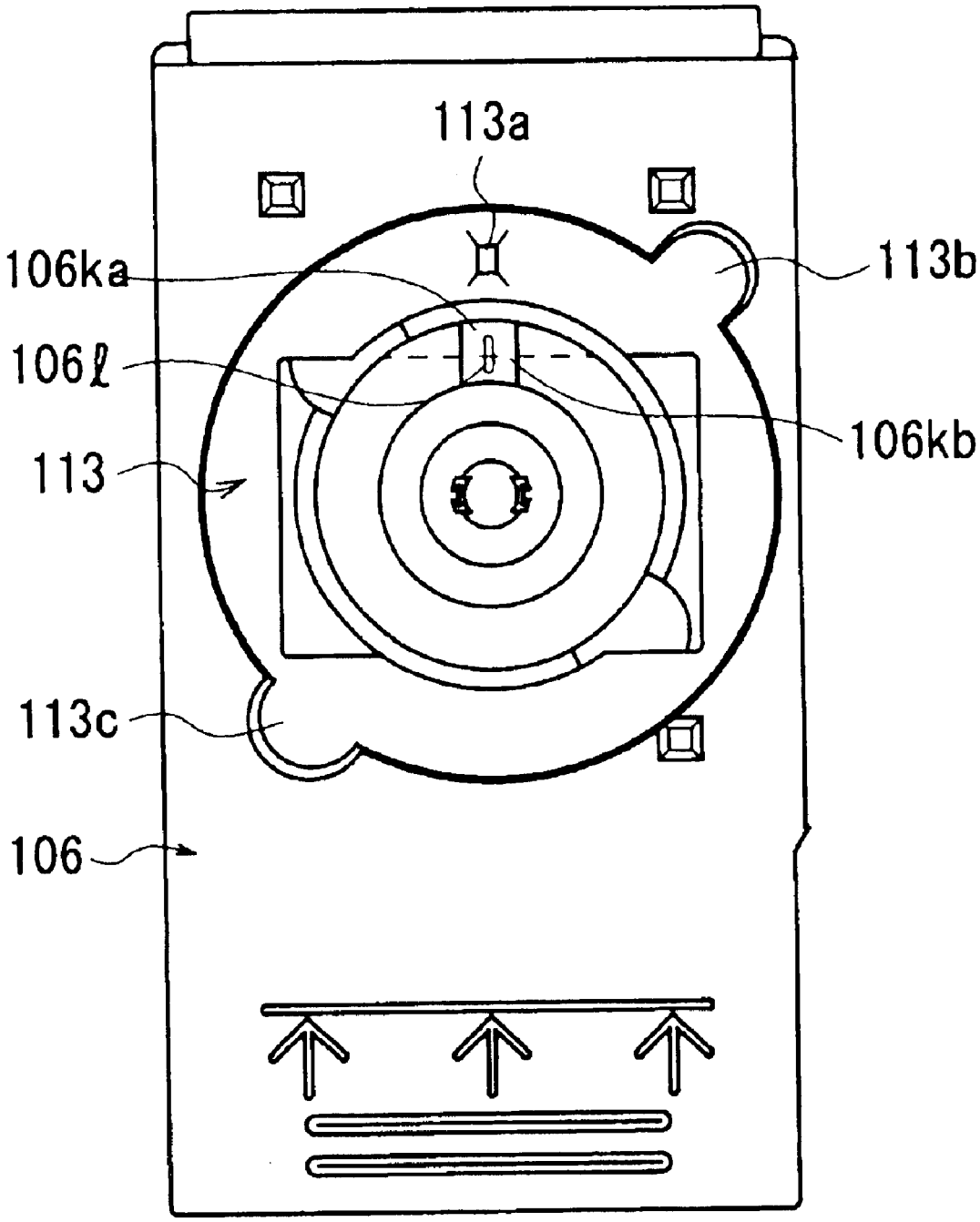
FIG. 47 is a schematic top plan view of the tray shown in FIG. 43, when the tray adaptor is in its proper position in the tray, with no CD in the tray.
Figure 48:
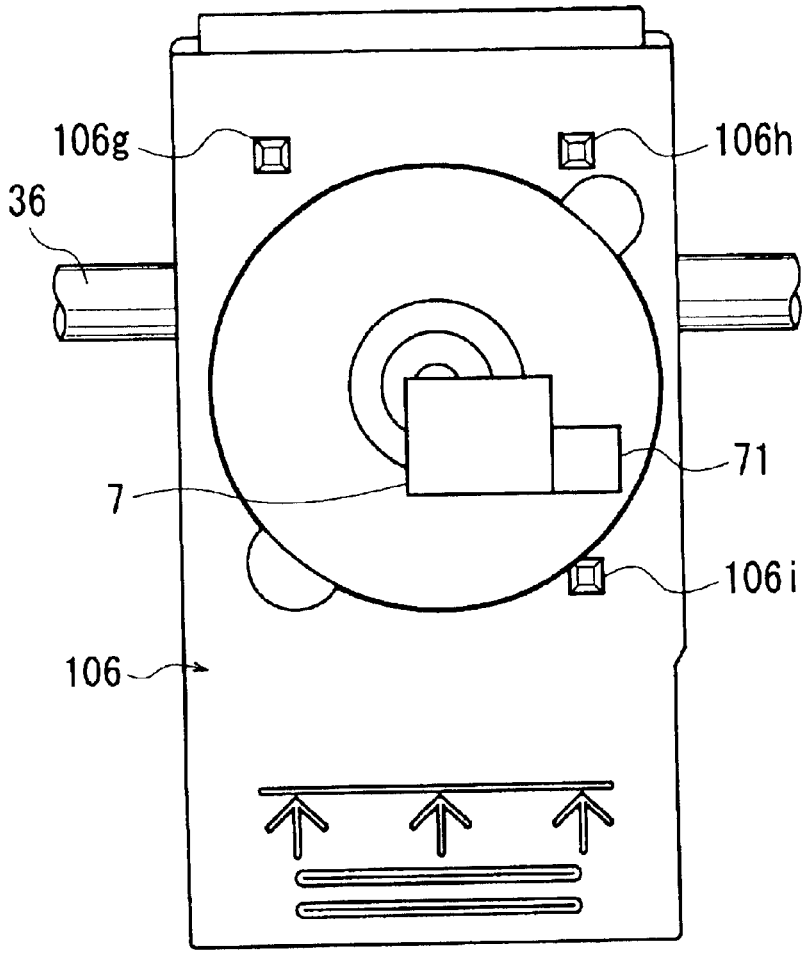
FIG. 48 is a schematic top plan view of the tray, recording head, and tray position detection sensor, in the recording apparatus, in the ninth embodiment of the present invention, showing their positional relationship when the tray is too far in the CD conveying portion due to user error.

Next, referring to FIGS. 43–48, an operation for recording on a CD with the use of the CD conveyance portion 101 will be described. FIG. 43 is a schematic top plan view of the tray 106 used with the recording apparatus, in the ninth embodiment of the present invention, showing the direction in which the tray 106 is conveyed, and the direction in which the recording head 7 and tray position sensor (on-head sensor) 71 are moved. FIG. 44 is a schematic top plan view of the tray 106 shown in FIG. 43, which is used with the recording apparatus, in the ninth embodiment of the present invention, and which is holding the tray adaptor 113 and an 8 cm CD (D8) in the opening of the tray adaptor 113. FIG. 45 is a schematic top plan view of the tray 106 in the ninth embodiment of the present invention, which is holding a 12 cm CD (D12). FIG. 46 is a schematic top plan view of the tray 106 shown in FIG. 43, which is used with the recording apparatus, in the ninth embodiment of the present invention, and which is holding the tray adaptor 113 and a card-type cm CD (DC) in the opening of the tray adaptor 113. FIG. 47 is schematic top plan view of the tray 106 shown in FIG. 43, which is holding the tray adaptor 113, with no CD in the tray adaptor. FIG. 48 is a schematic top plan view of the tray 106 which is used with the recording apparatus, in the ninth embodiment of the present invention, and which is too deep in the recording apparatus main assembly due to user error.

After a user sets the tray 106 in the tray guide 103, the tray 106 is conveyed in the direction of the arrow mark Y to the recording starting position, while remaining sandwiched by the conveyance roller 36 and pinch roller 37. While the tray 106 is conveyed, the tray position sensor 71, as a tray position detection means, is kept at a point in the moving range of the recording head 7 (sensor 71), in terms of the direction of an arrow mark X in the drawing, at which the tray position sensor 71 is presumed to align with the position detection mark 106*h* of the tray 106 in terms of the direction of arrow mark Y. The tray 106 is slightly moved in the direction of an arrow mark +Y or −Y to detect the accurate position of the position detection mark 106*h* in terms of the Y direction, and the detected accurate position of the detection mark 106*h* is stored in a host or the like. After the detection of the accurate position of the detection mark 106*h*, the recording head 7 is temporarily stopped, with the tray position sensor 71 accurately aligned with the position detection mark 106*h* in terms of the direction perpendicular to the tray 106. Then, the recording head 7 is moved a predetermined distance in the +X direction shown in FIG. 43, and then, in the −X direction, to detect the accurate position of the position detection mark 106*h* in terms of the X direction by the position detection sensor (on-head sensor) 71. Based on the accurate position of the position detection mark 106*h*, the amount of the deviation of the tray 106 in the X direction can be calculated. Next, the recording head 7 is moved in −X direction to detect the position of the position detection mark 106*g* in terms of the X direction by the tray position detection sensor 71. Then, the tray 106 is slightly moved in the +Y direction and −Y direction so that the accurate position of the position detection mark 106*g* in terms of the Y direction can be detected by the tray position detection sensor 71. The detected accurate position of the position detection mark 106*g* is stored in the host or the like.

Based on the accurate positions of the position detection marks 106*h* and 106*g* stored in the host or the like, the degree of the slant of the tray 106 can be calculated. Then, recording is made while making compensation based on the obtained amount of the deviation in terms of the left or right direction and degree of the slant of the tray 106, with reference to the recording data prepared in consideration of the deviation of the tray 106 in the left or right direction and the degree of slant of the tray 106. Therefore, images with no positional deviation can be recorded. However, if a user pushes the tray 106 too far into the recording apparatus as shown in FIG. 48, it is impossible for the tray position detection sensor (on-head sensor) 71 to begin detecting the position detection mark 106*h*, ending up detecting the mark 106*i* first. In such a case, the conveyance of the tray 106 is temporarily stopped, and the accurate position of the mark 106*i* is detected as if the mark 106*h* is detected as described above. In this case, however, the attempt to detect the position of the mark 106*g* by the tray position sensor 71 fails, proving that the detected position detection mark was the position detection mark 106*i*. Then, the tray 106 is moved a predetermined distance in the −Y direction in FIG. 43 by the conveyance roller 36 and pinch roller 37, and the process of detecting the position of the mark 106*h* is started.

Next, based on the accurate positions of the position detection marks 106*h* and 106*g*, the distance by which the tray 106 was moved is calculated. Then, the tray 106 and recording head 7 are moved until the tray position sensor 71 perfectly aligns with the mark 106*j* in terms of the direction perpendicular to the tray 106 to begin detecting the mark 106*j* in FIG. 43 by the tray position sensor 71. When the CD in the tray 106 is a 12 cm CD (D12) as shown in FIG. 45, the mark 106*j* is hidden by the 12 cm CD (D12). Therefore, the recording head 7 is moved further in the +X or −X direction to measure the fluctuation in the amount of the reflected light. If the fluctuation is relatively small, it is determined that the CD in the tray 106 is a 12 cm Cd (D12). When using the tray adaptor 113 as shown in FIG. 44, or when neither the tray adaptor 113 nor recording medium (CD) is in the tray 106 as shown in FIG. 30, a part, or the entirety of the mark 106*j* can be detected through the hole (tray adaptor type detection hole) 113*a*. More specifically, the tray position detection sensor 71 is moved in the +X and −X directions over the mark 106*j* to detect the fluctuation in the amount of the reflected light. If the amount of the reflected light detected by the sensor 71 when the sensor 71 is above the center portion of the mark 106*j* is substantially greater than that detected by the sensor 71 when the sensor 71 is away from the center portion of the mark 106*j* in the +X or −X direction, it is determined that either the tray adaptor 113 is present or no recording medium (CD) is present.

Next, the tray 106 is moved in the +Y direction, and is temporarily stopped directly above the top portion 106*ka* of the mark 106*k* shown in FIG. 30. If an 8 cm CD (D8) is in the tray 106 as shown in FIG. 44, the mark 106*ka* is hidden by the 8 cm CD (D8). Next, the recording head 7 is moved in the +X and −X directions to detect the fluctuation in the amount of the reflected light. If the fluctuation in the amount of the reflected light is relatively small, it is determined that the recording medium in the tray 106 is an 8 cm CD (D8). If a card-type CD (DC) is in the tray 106 as shown in FIG. 46, or no recording medium (CD) is in the tray 106 as shown in FIG. 47 or 30, the top portion 106*ka* can be detected. Then, the tray position detection sensor 71 is moved in the +X and −X directions while being kept over the mark 106*ka*. If the amount of the reflected light detected by the sensor 71 when the sensor 71 is above the center portion of the mark 106*ka* is substantially greater than that detected by the sensor 71 when the sensor 71 is away from the center portion of the mark 106*ka* in the +X or −X direction, it is determined that either a card-type CD (DC) is in the tray 106 or no recording medium (CD) is present.

Next, the tray 106 is moved in the +Y direction, and is temporarily stopped directly above the top portion 106 kb of the mark 106*k* shown in FIG. 30. If an 8 cm CD (D8) is in the tray 106 as shown in FIG. 44, the top portion 106 kb of the mark 106*k* is hidden by the 8 cm CD (D8). Next, the recording head 7 is moved in the +X and −X directions to detect the fluctuation in the amount of the reflected light. If the fluctuation in the amount of the reflected light is relatively small, it is determined that the recording medium in the tray 106 is a card-type CD (DC). As for the presence or absence of the tray adaptor 113 in the tray 106, the tray position detection sensor 71 is moved in the +X and −X directions while being kept over the mark 106*j*. If the amount of the reflected light detected by the sensor 71 when the sensor 71 is above the center portion of the mark 106*j* is substantially greater than that detected by the sensor 71 when the sensor 71 is away from the center portion of the mark 106*j* in the +X or −X direction, it is determined that the tray adaptor 113 is present. Incidentally, the above described position detection and control can be accurately carried out even when the photosensor used as the tray position detection sensor (on-head sensor) 71 is an inexpensive one. However, the employment of an expensive sensor, that is, a sensor of higher sensitivity, makes it possible to eliminate the hole 1061 of the mark 106*k* of the tray 106. Further, the employment of a sensor of higher sensitivity makes it possible to eliminate the need for moving the tray position sensor 71 in the X direction to scan the fluctuation in the amount of the reflected light, temporarily stopping the tray 106 while moving the tray 106 in the Y direction, and the like operations.

It is possible through the above described procedures to determine which recording medium is in the tray 106, a 12 cm CD (D12) or a card-type CD (DC), whether or not a recording medium is in the tray 106, and the like. Also through the above described procedures, it is possible to carry out a recording operation (printing method) in accordance with the determinations, or to issue a warning when no recording medium is in the tray 106. When no recording medium is in the tray 106, it is an operational error. Therefore, a user is instructed by some method (for example, a warning message is displayed by the host) to mount a recording medium.

(Embodiment 10)

Figure 49:
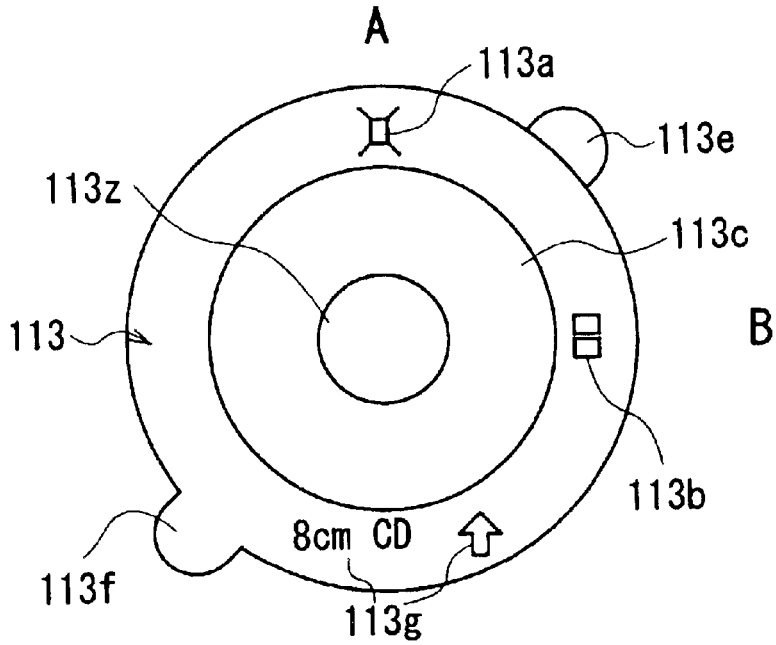
FIG. 49 is a schematic top plan view of the surface of one (top side)of the two surfaces of the tray adaptor used with the recording apparatus, in the tenth embodiment of the present invention.
Figure 52:
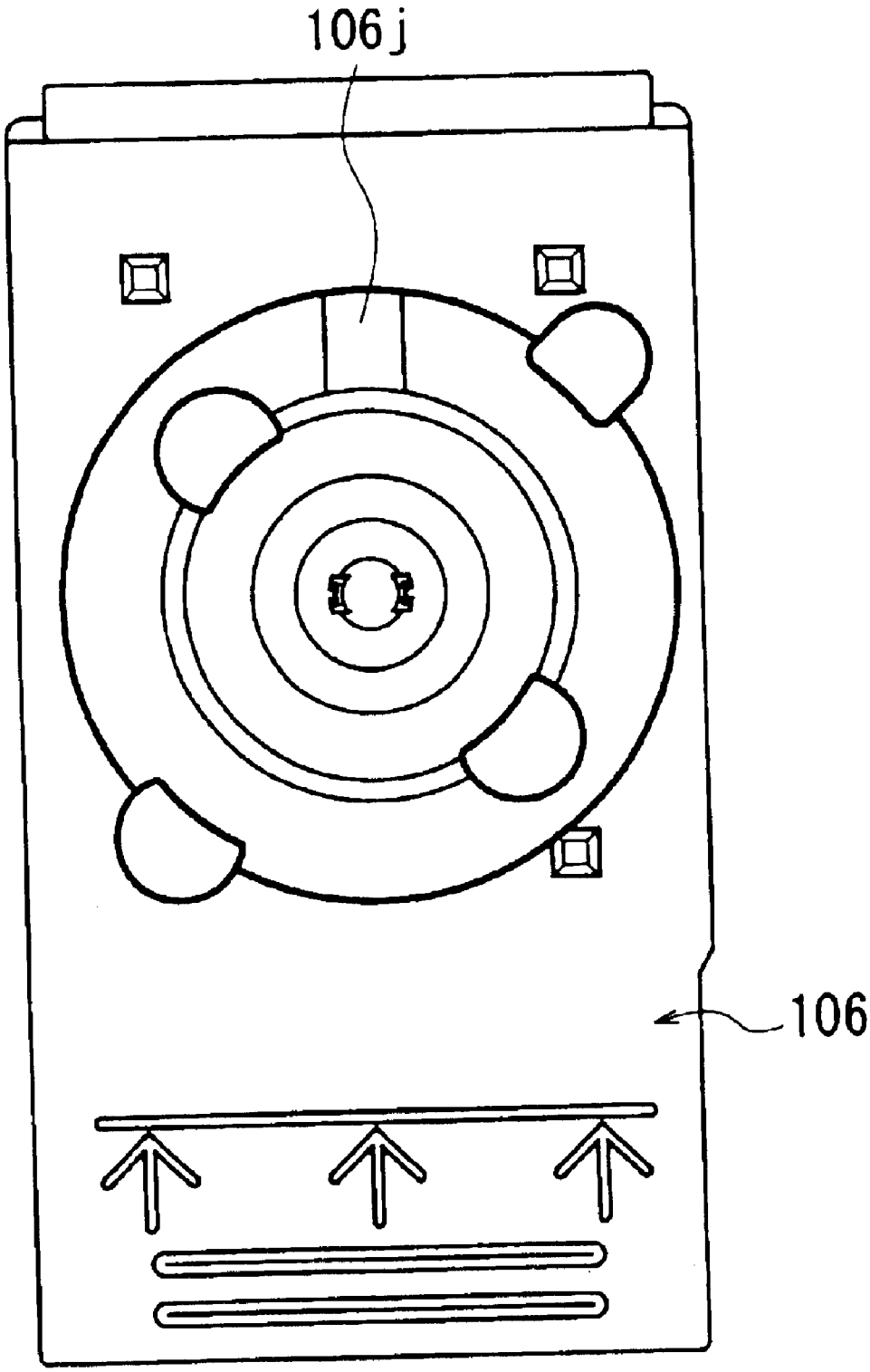
FIG. 52 a schematic top plan view of the tray compatible with the tray adaptors shown in FIGS. 49 and 50.

FIG. 49 is a schematic top plan view of the tray adaptor (CD adaptor) 113 used with the recording apparatus, in the tenth embodiment of the present invention, and FIG. 51 is a schematic bottom plan view of the tray adaptor shown in FIG. 49. FIG. 52 is a schematic top plan view of the tray 106 compatible with the tray adaptor 113 shown in FIGS. 49 and 50. Also in this tenth embodiment, the tray adaptor (CD adaptor) 113 is compatible with both an 8 cm CD (D8) and a card-type CD (DC), as in the ninth embodiment, except that in this tenth embodiment, one surface (top side) is structured for an 8 cm CD (D8) as shown in FIG. 49, and the other surface (bottom side) is structured for a card-type CD (DC) as shown in FIG. 50.

Referring to FIG. 49, the top side of the tray adaptor 113 is provided with a recess 113*c*, the diameter of which is the same as, or greater than, that of an 8 cm Cd (D8), and the depth of which is equivalent to the thickness of a CD (roughly 1.2 mm). Referring to FIG. 52, the tray adaptor 113 is provided with a tray adaptor type detection hole (recording medium type detection hole) 113*a*, which is located so that when the tray adaptor 113 is in the tray 106, the tray adaptor type detection mark (recording medium type detection mark) 106*j*, shown in FIG. 52, of the tray 106 can be partially detected. Also, the tray adaptor 113 is provided with an opening (hole) 113*z* which is located at the center of the recess 113*c* in order to accommodate the CD locking portion (CD positioning portion) 106*a* located at the center of the tray 106. Further, in order to prevent a user from erroneously mounting a recording medium in such a manner that the tray adaptor detection hole (recording medium type detection hole) 113*a* does not overlap with the tray adaptor type detection mark (recording medium type detection mark) 106*j* shown in FIG. 52, the tray adaptor 113 is also provided with a set of letters or a symbol designated by a referential numeral 113*g*, as is the tray adaptor 113 in the ninth embodiment. With the presence of the set of letters 113*g* or the symbol 113*g*, the user can easily set a recording medium with reference to the direction of the set of letters 113*g* or symbol 113*g* so that the hole 113*a* is positioned directly above the mark 106*j*.

Figure 50:
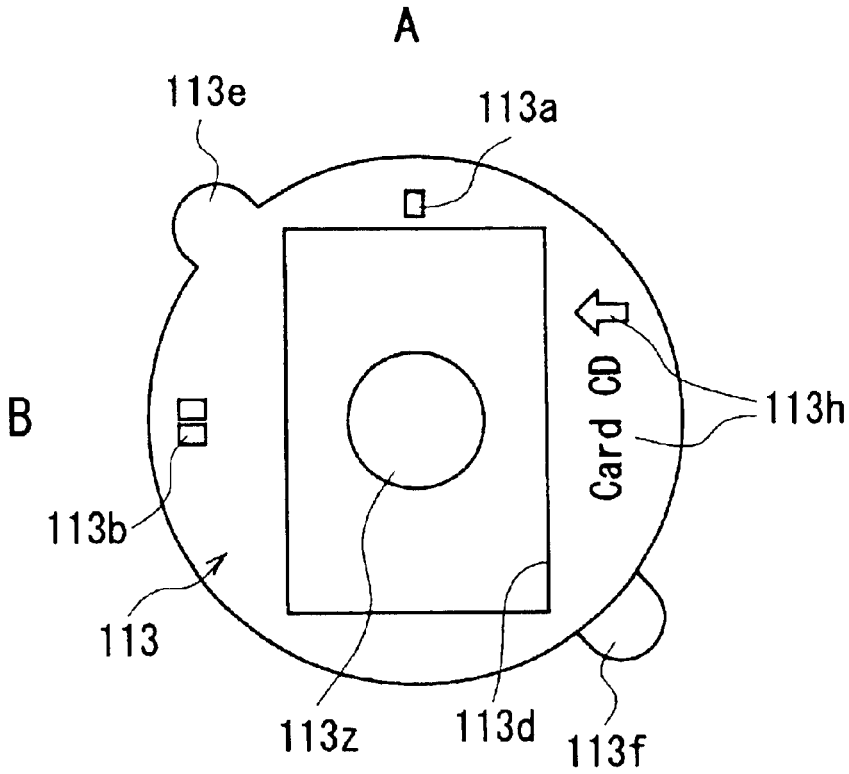
FIG. 50 is a schematic top plan view of the other surface (reverse side) of the tray adaptor shown in FIG. 49.

Referring to FIG. 50, the bottom side of the tray adaptor 113 is provided with a rectangular recess 113*d*, which is identical in shape, and is the same in size as, or slightly larger than, a card-type CD (DC), and the depth of which is equivalent to the thickness of a CD (roughly 1.2 mm). Further, the tray adaptor 113 is provided with projections 113*e* and 113*f* for accurately positioning the tray adaptor relative to the tray 106. These projections 113*e* and 113*f* are symmetrically positioned with respect to the center of the tray adaptor 113. Therefore, when mounting the tray adaptor 113 to use its bottom side, the tray adaptor 113 is to be mounted so that the B side (FIG. 50) of the tray adaptor 113 comes to the top in FIG. 50. In other words, the tray adaptor 113 is to be positioned so that the projections 113*e* and 113*f* of the tray adaptor 113 fit into the CD removal holes 106*b* and 106*c*, respectively, of the tray 106. Further, the tray adaptor 113 is provided with a tray adaptor type detection hole (recording medium type detection hole) 113*b*, which is located so that when the tray adaptor 113 is in the tray 106 to use the bottom side of the tray adaptor 113, the tray adaptor type detection mark (recording medium type detection mark) 106*j*, as the means to be detected for position detection, shown in FIG. 52, of the tray 106 can be partially detected, as when the top side is used. Further, in order to prevent a user from erroneously mounting a recording medium in such a manner that the tray adaptor detection hole (recording medium type detection hole) 113*b* does not overlap with the tray adaptor type detection mark (recording medium type detection mark) 106*j* shown in FIG. 52, the tray adaptor 113 is also provided with a set of letters or a symbol designated by a referential numeral 113*h*. With the presence of the set of letters 113*h* or the symbol 113*h*, the user can easily set a recording medium with reference to the direction of the set of letters 113*h* or symbol 113*h* so that the hole 113*b* is positioned directly above the mark 106*j*.

As will be evident from the above description, whether a recording medium is in the tray or not, and the type of the recording medium in the tray, can be determined by carrying out the operations similar to those in the ninth embodiment, with reference to the tray adaptor type detection hole (recording medium type detection hole) 113*b*. In other words, the marks 106*k*, hole 106*l*, etc., which the tray in the ninth embodiment has, can be eliminated. Therefore, it is possible to reduce cost, and also, reduce the time necessary for recording medium identification. Further, unlike the trays in the preceding embodiments, the placement of a card-type CD in the tray 106 (bottom side of the tray 106) leaves virtually no recess (portion with step), improving thereby the CD conveyance performance.

(Embodiment 11)

In the tenth embodiment described above, the tray adaptor was structured so that an 8 cm CD (D8) was mounted on one side (top side) of the tray adaptor, and a card-type CD (DC) was mounted on the other side (bottom side) of the tray adaptor, and the recording medium type was identified accordingly. Instead, the tray adaptor may be provided with a set of letters, a symbol, or the like, which shows the orientation of the tray adaptor relative to the tray, in relation to the type of a recording medium, so that the orientation of the tray adaptor can be changed in accordance with the recording medium to be used, as well as the marks, the shape of which can be detected by the tray position sensor 71 as a tray position detecting means to determine whether or not a recording medium is in the tray, or to identify the type of the recording medium (CD) in the tray; this is the method employed by the recording apparatus in the eleventh embodiment to identify the type of the recording medium in the tray. More specifically, the tray adaptor 113 is mounted in the tray in the orientation indicated by the set of letters, the symbol, or the like on the tray adaptor 113, and the recording medium identification mark is identified, based on its shape, by the tray position detection sensor (on-head sensor) 71 to determine which recording medium is in the tray, an 8 cm CD (D8) or a card-type CD (DC).

(Embodiment 12)

Figure 53:
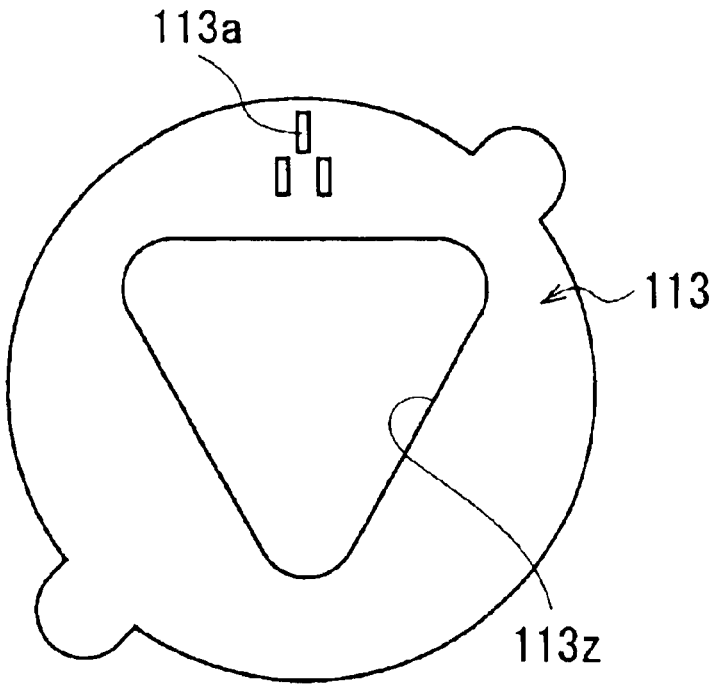
FIG. 53 is a schematic top plan view of one of the variations of the tray adaptor mountable in the CD conveying portion used with the recording apparatus, in the twelfth embodiment of the present invention, showing an example of the tray adaptor openings different in shape from the conventional ones, and an example of the tray adaptor type detection holes different from the conventional ones.
Figure 54:
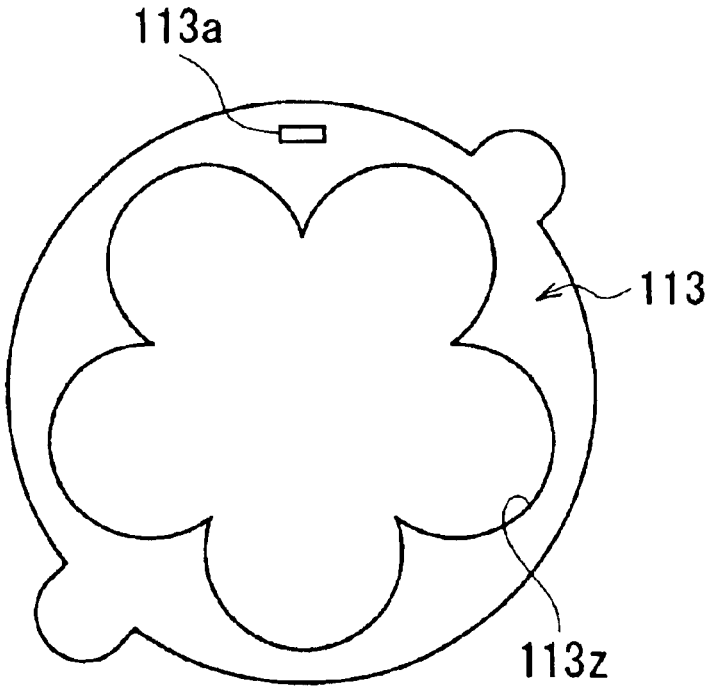
FIG. 54 is a schematic top plan view of another variation of the tray adaptor mountable in the CD conveying portion used with the recording apparatus, in the twelfth embodiment of the present invention, showing another example of the tray adaptor openings different in shape from the conventional ones, and another example of the tray adaptor type detection holes different from the conventional ones.
Figure 55:
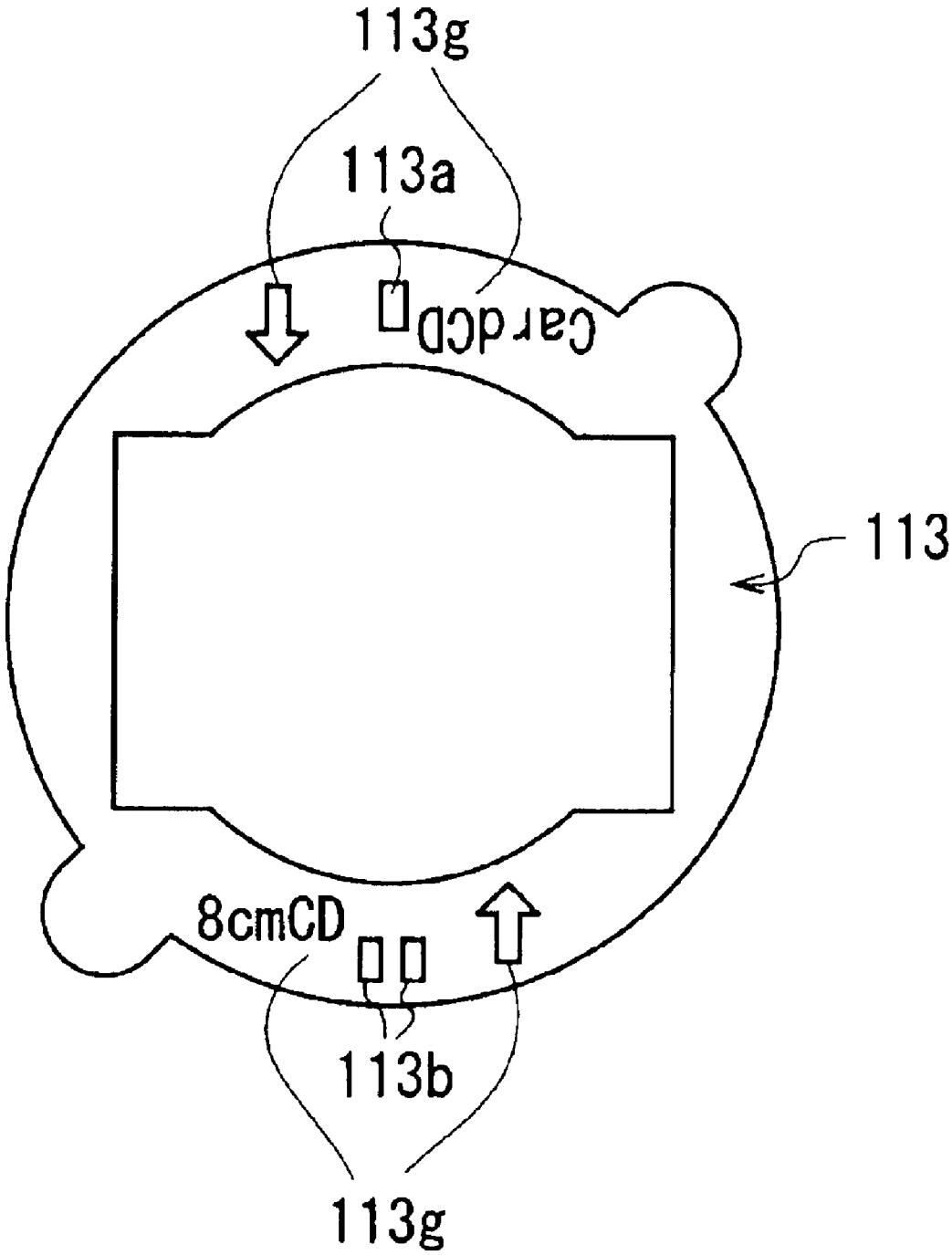
FIG. 55 is a schematic top plan view of another variation of the tray adaptor mountable in the CD conveying portion used with the recording apparatus, in the twelfth embodiment of the present invention, which has two tray adaptor type detection holes different in location, and two sets of letters or symbols for showing the tray adaptor orientation, which are different in location.

FIG. 53 is a schematic top plan view of an example of a tray adaptor used with the CD conveyance tray for the recording apparatus, in the twelfth embodiment of the present invention, and FIG. 54 is a schematic top plan view of another example of a tray adaptor used with the CD conveyance tray for the recording apparatus, in the twelfth embodiment of the present invention. In recent years, there have been increased number of the CD shapes. Therefore, a tray adaptor (CD adaptor) must be prepared for each of the different CD shapes. Consequently, it has become imperative to be able to identify CDs different in shape in order to prevent recording errors or to make improvement in recording medium conveyance. Some of the answers to this need are to prepare a tray adaptor for each type of a CD, and to provide each tray adaptor with the tray adaptor type detection hole 113*a*, as shown in FIG. 53 or 54, the difference in shape of which is detectable, and which is located so that it corresponds in position to the tray adaptor type detection mark (recording medium type detection mark) 106*j*, as the means to be detected for tray adaptor type identification, the recording medium presence (absence) detection mark 106*k*, shown in FIG. 30, in the ninth embodiment, and the tray adaptor type detection mark (recording medium type detection mark) 106*j* (FIG. 52), shown in FIGS. 49 and 50, in the tenth embodiment, so that recording can be made according to the shape of a CD; and to provide each tray adaptor with a pair of tray adaptor type detection holes 113*a* and 113*b*, as shown in FIG. 55, the difference in shape of which is detectable, and which are different in location, so that recording can be made according to the shape of a CD. Described above is the recording medium (CD) identification means of the recording apparatus, in the twelfth embodiment of the present invention.

The ninth–eleventh embodiments of the present invention were described with reference to the tray adaptor usable with recording media of two different types. However, a tray adaptor may be provided with a two tray adaptor type detection holes which correspond in position to the marks on the tray 106, one for one, and which are different in shape. Such a structural arrangement also makes it possible to identify a recording medium just as effectively as the structural arrangement in the ninth–eleventh embodiments. Further, the ninth–eleventh embodiments may be employed in combination to realize a structural arrangement for identifying various recording media.

Further, the preceding embodiments of the present invention were described with reference to an ink jet recording apparatus as a recording apparatus. However, the present invention is also applicable to a recording apparatus which employs a recording method other than an ink jet recording method, for example, a wire-dot recording method, a thermal recording method, a laser beam recording method, or the like, and such an application will accomplish the same operational effects as those accomplished by the preceding embodiments. Further, not only is the present invention is applicable to a monochromatic recording apparatus, but also a color recording apparatus which records in various colors with the use of a single or plurality of recording heads, a tone recording apparatus which records in multiple densities of the same color with the use of a single ink, and a recording apparatus which operates in the combination of the operational modes of the preceding recording apparatuses, and such an application will accomplish the same effects as those accomplished by the preceding embodiments.

Further, the preceding embodiments were described with reference to a serial type recording apparatus, which records by moving the recording head as a recording means in the primary scanning direction. However, the present invention is also applicable to a line type recording apparatus, which has a line-type recording head long enough to reach from one edge of a recording medium to the other in terms of the width direction of the recording medium, and which records by moving the recording head only in the secondary scanning direction, and such an application will accomplish the same effects as those accomplished by the preceding embodiments.

Further, the present invention is also applicable to such an ink jet recording apparatus, that is, as an ink jet recording apparatus which records with the use of liquid ink, and which is structured to employ a replaceable head cartridge integrally comprising a recording head and an ink container, as well as an ink jet recording apparatus structured so that the recording head is connected to a separate ink container with the use of an ink supply tube or the like. In other words, the present invention is applicable regardless of recording head structure, ink container structure, and the arrangement between the recording head and ink container. Such an application will bring forth the same effects as those brought by the preceding embodiments.

Further, the present invention is also applicable to an ink jet recording apparatus employing an electromechanical transducer such as a piezoelectric element. However, when it is applied to an ink jet recording apparatus employing a recording means which uses thermal energy to eject ink, it brings forth superior effects, because such a recording means can accomplish a higher level of recording density and can record at a higher level of precision.

While the invention has been described with reference to the structures disclosed herein, it is not confined to the details set forth, and this application is intended to cover such modifications or changes as may come within the purposes of the improvements or the scope of the following claims.

What is claimed is:

1. A recording apparatus for effecting recording on a recording material by recording means, said apparatus comprising:

a tray, mountable to said recording apparatus, for stacking a recording material;

a feeding roller for feeding said tray;

a portion to be detected, provided on said tray to permit detection of a position of said tray;

a tray position detecting portion for detecting the portion to be detected;

wherein a position of recording material stacked on said tray is detected by detecting the position of the portion to be detected.

2. An apparatus according to claim 1, wherein said portion to be detected is provided at each of a plurality of positions of said tray.

3. An apparatus according to claim 2, wherein said portions to be detected are arranged in a direction substantially perpendicular to a feeding direction of said tray.

4. An apparatus according to claim 2, wherein said portions to be detected are arranged in the feeding direction of said tray.

5. An apparatus according to claim 2, wherein said portions to be detected are arranged in a direction crossing with a feeding direction of said tray at a predetermined angle.

6. An apparatus according to claim 1, wherein said portion to be detected has a square or rectangular configuration having a side which is perpendicular to a feeding direction of said tray and a side which is parallel with the feeding direction.

7. An apparatus according to claim 2, wherein said portions to be detected have configurations or sizes which are different from each other.

8. An apparatus according to claim 1, wherein said tray position detecting portion includes a light emission detecting means, and the portion to be detected has a reflecting surface for reflecting light emitted by said tray position detecting portion, wherein a peripheral portion of said reflecting surface is lower than the reflecting surface and is inclined at a predetermined angle with respect to the reflecting surface.

9. An apparatus according to claim 1, wherein said tray position detecting portion includes a light emission detecting means, and said portion to be detected includes a reflecting surface for reflecting light emitted by said tray position detecting portion, and the reflecting surface includes a mirror surface having a reflectance which is higher than a predetermined reflectance.

10. An apparatus according to claim 2, wherein the position of said tray is detected using one of said portions to be detected.

11. An apparatus according to claim 2, wherein the position of said tray and a state of feeding thereof are detected using two or more portions to be detected, and a recording position is recorded on the basis of a result of the detection.

12. An apparatus according to claim 2, wherein a mounting reference for the recording material is disposed on a line connecting two of the portions to be detected.

13. An apparatus according to claim 1, wherein said recording material has a mounting or positioning hole substantially at a center portion thereof, and wherein said tray includes a mounting or positioning portion corresponding to the hole.

14. An apparatus according to claim 1, wherein said portion to be detected is disposed outside a region of the recording material with respect to a direction perpendicular to a feeding direction of said tray.

15. An apparatus according to claim 1, further comprising a pinch roller rotatable by said feeding roller, and said portion to be detected is disposed at a position not contacted by said pinch roller.

16. An apparatus according to claim 1, further comprising a tray guide for guiding said tray when said tray is inserted into said recording apparatus.

17. A recording apparatus for effecting recording on a recording material by recording means, said apparatus comprising:

a tray, mountable to said recording apparatus, for stacking a recording material;

a feeding roller for feeding said tray;

a portion to be detected provided in said tray to permit detection of presence of the recording material on said tray;

a recording material detecting portion for detecting the portion to be detected.

18. An apparatus according to claim 17, wherein said portion to be detected is formed at a position of said tray where the recording material is stacked.

19. An apparatus according to claim 17, wherein said portion to be detected is provided at each of a plurality of positions of said tray.

20. An apparatus according to claim 19, wherein said portions to be detected having configurations which are different from each other.

21. An apparatus according to claim 17, wherein when said recording material detecting portion detects said portion to be detected, absence of the recording material on said tray is detected.

* * * * *

UNITED STATES PATENT AND TRADEMARK OFFICE

CERTIFICATE OF CORRECTION

PATENT NO. : 6,871,946 B2
DATED : March 29, 2005
INVENTOR(S) : Haruyuki Yanagi et al.

It is certified that error appears in the above-identified patent and that said Letters Patent is hereby corrected as shown below:

Column 5,
Line 55, “DC” should read -- CD --.

Column 21,
Line 38, “Cd.” should read -- CD. --.

Column 23,
Line 25, “DC” should read -- CD --.

Column 31,
Line 53, “designed” should read -- designated --; and
Line 58, “is” should read -- does --.

Column 34,
Line 16, “12 cm Cd” should read -- 12 cm CD --.

Column 35,
Line 45, “8 cm Cd” should read -- 8 cm CD --.

Column 37,
Line 67, “is” (second occurrence) should be deleted.

Column 40,
Line 24, “presence” should read -- a presence --.

Signed and Sealed this

Thirteenth Day of September, 2005

JON W. DUDAS
*Director of the United States Patent and Trademark Office*